US009001163B2

(12) United States Patent
Kabe et al.

(10) Patent No.: US 9,001,163 B2
(45) Date of Patent: Apr. 7, 2015

(54) METHOD OF DRIVING IMAGE DISPLAY DEVICE

(75) Inventors: Masaaki Kabe, Kanagawa (JP); Toshiyuki Nagatsuma, Kanagawa (JP); Shunsuke Noichi, Kanagawa (JP); Yasuyuki Matsui, Kanagawa (JP); Soichiro Kurokawa, Kanagawa (JP); Akira Sakaigawa, Kanagawa (JP); Amane Higashi, Aichi (JP)

(73) Assignee: Japan Display Inc., Tokyo (JP)

( * ) Notice: Subject to any disclaimer, the term of this patent is extended or adjusted under 35 U.S.C. 154(b) by 20 days.

(21) Appl. No.: 13/553,279

(22) Filed: Jul. 19, 2012

(65) Prior Publication Data

US 2013/0027441 A1 Jan. 31, 2013

(30) Foreign Application Priority Data

Jul. 29, 2011 (JP) ..... 2011-166593

(51) Int. Cl.
*G09G 3/34* (2006.01)
*G09G 5/02* (2006.01)

(52) U.S. Cl.
CPC ..... *G09G 3/3413* (2013.01); *G09G 5/02* (2013.01); *G09G 3/3426* (2013.01);
CPC ..... *G09G 2300/0426* (2013.01); *G09G 2300/0452* (2013.01); *G09G 2320/0242* (2013.01); *G09G 2320/0666* (2013.01); *G09G 2330/021* (2013.01); *G09G 2340/06* (2013.01)

(58) Field of Classification Search
CPC ..... G09G 5/02; G09G 5/10; G09G 3/36; G09G 3/2003; G09G 3/3406; G09G 2320/023; G02B 6/00
See application file for complete search history.

(56) References Cited

U.S. PATENT DOCUMENTS

2007/0025683 A1* 2/2007 Nobori ..... 385/147
2009/0289965 A1* 11/2009 Kurokawa et al. ..... 345/690

(Continued)

FOREIGN PATENT DOCUMENTS

| | | |
|---|---|---|
| JP | 3167026 | 3/2001 |
| JP | 3805150 | 5/2006 |
| JP | 2008-282048 | 11/2008 |
| JP | 2009-271349 | 11/2009 |
| JP | 2010-033014 | 2/2010 |

OTHER PUBLICATIONS

Japanese Examination Report issued in connection with related Japanese patent application No. JP 2011-166593 dated May 13, 2014.

*Primary Examiner* — Waseem Moorad
*Assistant Examiner* — Sujit Shah
(74) *Attorney, Agent, or Firm* — Dentons US LLP

(57) ABSTRACT

A method of driving an image display device including (A) an image display panel in which pixels each having first to fourth subpixels displaying first to third primary colors and fourth color, respectively are arranged in a two-dimensional matrix, and (B) a signal processor, in an i-th image display frame, in the signal processor, first to fourth subpixel output signals are obtained on the basis of at least first to fourth subpixel input signals and a corrected expansion coefficient $\alpha'_{i-0}$, and output to the first to fourth subpixels, respectively, the maximum value $V_{max}(S)$ of luminosity with saturation S in an HSV color space is obtained in the signal processor or stored in the signal processor, and in the i-th image display frame, in the signal processor, (a) saturation $S_i$ and luminosity $V_i(S)$ in pixels are obtained, (b) an expansion coefficient $\alpha_{i-0}$ is obtained, and (c) the corrected expansion coefficient $\alpha'_{i-0}$ is determined.

7 Claims, 24 Drawing Sheets

(56) References Cited

U.S. PATENT DOCUMENTS

2009/0315921 A1* 12/2009 Sakaigawa et al. ..... 345/694
2011/0012915 A1* 1/2011 Nobori et al. ..... 345/589
2011/0181633 A1 7/2011 Higashi et al.
2011/0181635 A1* 7/2011 Kabe et al. ..... 345/694
2012/0050345 A1* 3/2012 Higashi et al. ..... 345/690

* cited by examiner (EXAMPLE 1)

METHOD OF DRIVING IMAGE DISPLAY DEVICE

FIELD

The present disclosure relates to a method of driving an image display device.

BACKGROUND

In recent years, in an image display device, such as a color liquid crystal display, enhancement in performance involves an increase in power consumption. In particular, for example, in a color liquid crystal display, enhancement in definition, expansion of a color reproduction range, or an increase in luminance involves an increase in power consumption of a planar light source device (backlight). In order to solve this problem, a technique in which each display pixel has a four-subpixel configuration with, for example, a white display subpixel displaying white in addition to three subpixels including a red display subpixel displaying red, a green display subpixel displaying green, and a blue display subpixel displaying blue, thereby improving luminance using the white display subpixel is attracting attention. With the four-subpixel configuration, since high luminance is obtained with the same power consumption as in the related art, if the luminance is the same as in the related art, it is possible to reduce power consumption in the planar light source device and to improve display quality.

For example, a color image display device described in Japanese Patent No. 3167026 has a unit which generates three kinds of color signals from an input signal using an additive primary color process, and a unit which adds the color signals of the three hues at an equal ratio to generate an auxiliary signal, and supplies four kinds of display signals in total including the auxiliary signal and three kinds of color signals obtained by subtracting the auxiliary signal from the signals of the three hues to a display unit. A red display subpixel, a green display subpixel, and a blue display subpixel are driven by the three kinds of color signals, and a white display subpixel is driven by the auxiliary signal.

Japanese Patent No. 3805150 describes a liquid crystal display which includes a liquid crystal panel in which a red output subpixel, a green output subpixel, a blue output subpixel, and a luminance subpixel form one main pixel unit such that color display can be performed. The liquid crystal display has a calculation unit which calculates a digital value W for driving the luminance subpixel and digital values Ro, Go, and Bo for driving the red output subpixel, the green output subpixel, and the blue output subpixel using digital values Ri, Gi, and Bi of a red input subpixel, a green input subpixel, and a blue input subpixel obtained from an input image signal. The calculation unit calculates the digital values Ro, Go, Bo, and W which satisfy the following relationship and with which enhancement in luminance from a configuration, in which only the red input subpixel, the green input subpixel, and the blue input subpixel are provided, is achieved with the addition of the luminance subpixel.

$$Ri:Gi:Bi=(Ro+W):(Go+W):(Bo+W)$$

On the other hand, according to the technique described in Japanese Patent No. 3167026 or Japanese Patent No. 3805150, while the luminance of the white display subpixel is increased, the luminance of the red display subpixel, the green display subpixel, and the blue display subpixel is not increased. In order to solve this problem, for example, JP-A-2010-033014 describes a method of driving an image display device, in which each pixel has a first subpixel displaying a first primary color, a second subpixel displaying a second primary color, a third subpixel displaying a third primary color, and a fourth subpixel displaying a fourth color. According to this method, an expansion coefficient $\alpha_0$ is calculated, and an output signal is obtained on the basis of the concerned expansion coefficient $\alpha_0$.

SUMMARY

The method of driving an image display device described in JP-A-2010-033014 is excellent in that it is possible to reliably achieve an increase in luminance, to achieve improvement in display quality, and to reduce power consumption in the planar light source device. The expansion coefficient $\alpha_0$ is determined in each image display frame, and the luminance of the planar light source device (backlight) is decreased on the basis of the expansion coefficient $\alpha_0$. However, when the variation between the expansion coefficient $\alpha_0$ in a certain image display frame and the expansion coefficient $\alpha_0$ in an image display frame next to this image display frame is large, flickering may be observed in an image.

Accordingly, it is desirable to provide a method of driving an image display device in which flickering is less likely to occur in an image even when the variation between the expansion coefficient $\alpha_0$ in a certain image display frame and the expansion coefficient $\alpha_0$ in an image display frame next to this image display frame is large.

A first embodiment of the present disclosure is directed to a method of driving an image display device. The image display device includes (A) an image display panel in which pixels each having a first subpixel displaying a first primary color, a second subpixel displaying a second primary color, a third subpixel displaying a third primary color, and a fourth subpixel displaying a fourth color are arranged in a two-dimensional matrix, and (B) a signal processor. In an i-th image display frame, in the signal processor, a first subpixel output signal is obtained on the basis of at least a first subpixel input signal and a corrected expansion coefficient $\alpha'_{i-0}$, and output to the first subpixel, a second subpixel output signal is obtained on the basis of at least a second subpixel input signal and the corrected expansion coefficient $\alpha'_{i-0}$, and output to the second subpixel, a third subpixel output signal is obtained on the basis of at least a third subpixel input signal and the corrected expansion coefficient $\alpha'_{i-0}$, and output to the third subpixel, and a fourth subpixel output signal is obtained on the basis of the first subpixel input signal, the second subpixel input signal, and the third subpixel input signal, and output to the fourth subpixel.

A second embodiment of the present disclosure is directed to a method of driving an image display device. The image display device includes (A) an image display panel in which pixels each having a first subpixel displaying a first primary color, a second subpixel displaying a second primary color, and a third subpixel displaying a third primary color are arranged in a two-dimensional matrix in a first direction and a second direction, at least a first pixel and a second pixel arranged in the first direction forms a pixel group, and a fourth subpixel displaying a fourth color is arranged between the first pixel and the second pixel in each pixel group, and (B) a signal processor. In an i-th image display frame, in the signal processor, in regard to the first pixel, a first subpixel output signal is obtained on the basis of at least a first subpixel input signal and a corrected expansion coefficient $\alpha'_{i-0}$, and output to the first subpixel, a second subpixel output signal is obtained on the basis of at least a second subpixel input signal and the corrected expansion coefficient $\alpha'_{i-0}$, and output to the second subpixel, and a third subpixel output signal is obtained on the basis of at least a third subpixel input signal and the corrected expansion coefficient $\alpha'_{i-0}$, and output to the third subpixel, in regard to the second pixel, a first subpixel output signal is obtained on the basis of at least a first subpixel input signal and the corrected expansion coefficient $\alpha'_{i-0}$, and output to the first subpixel, a second subpixel output signal is obtained on the basis of at least a second subpixel input signal and the corrected expansion coefficient $\alpha'_{i-0}$, and output to the second subpixel, and a third subpixel output signal is obtained on the basis of at least a third subpixel input signal and the corrected expansion coefficient $\alpha'_{i-0}$, and output to the third subpixel, and in regard to the fourth subpixel, a fourth subpixel output signal is obtained on the basis of a fourth subpixel control first signal obtained from the first subpixel input signal, the second subpixel input signal, and the third subpixel input signal to the first pixel and a fourth subpixel control second signal obtained from the first subpixel input signal, the second subpixel input signal, and the third subpixel input signal to the second pixel, and output to the fourth subpixel.

A third embodiment of the present disclosure is directed to a method of driving an image display device. The image display device includes (A) an image display panel in which P×Q pixel groups in total of P pixel groups in a first direction and Q pixel groups in a second direction are arranged in a two-dimensional matrix, and (B) a signal processor. Each pixel group has a first pixel and a second pixel in the first direction, the first pixel has a first subpixel displaying a first primary color, a second subpixel displaying a second primary color, and a third subpixel displaying a third primary color, and the second pixel has a first subpixel displaying a first primary color, a second subpixel displaying a second primary color, and a fourth subpixel displaying a fourth color. In an i-th image display frame, in the signal processor, a third subpixel output signal to a (p,q)th [where p=1, 2, . . . , P, and q=1, 2, . . . , and Q] first pixel when counting in the first direction is obtained on the basis of at least a third subpixel input signal to a (p,q)th first pixel, a third subpixel input signal to a (p,q)th second pixel, and a corrected expansion coefficient $\alpha'_{i-0}$, and output to the third subpixel of the (p,q)th first pixel, and a fourth subpixel output signal to the (p,q)th second pixel is obtained on the basis of a fourth subpixel control second signal obtained from a first subpixel input signal, a second subpixel input signal, and the third subpixel input signal to the (p,q)th second pixel, a fourth subpixel control first signal obtained from a first subpixel input signal, a second subpixel input signal, and a third subpixel input signal to an adjacent pixel adjacent to the (p,q)th second pixel in the first direction, and the corrected expansion coefficient $\alpha'_{i-0}$, and output to the fourth subpixel of the (p,q)th second pixel.

A fourth embodiment of the present disclosure is directed to a method of driving an image display device. The image display device includes (A) an image display panel in which $P_0 \times Q_0$ pixels in total of $P_0$ pixels in a first direction and $Q_0$ pixels in a second direction are arranged in a two-dimensional matrix, and (B) a signal processor. Each pixel has a first subpixel displaying a first primary color, a second subpixel displaying a second primary color, a third subpixel displaying a third primary color, and a fourth subpixel displaying a fourth color. In an i-th image display frame, in the signal processor, a first subpixel output signal is obtained on the basis of at least a first subpixel input signal and a corrected expansion coefficient $\alpha'_{i-0}$, and output to the first subpixel, a second subpixel output signal is obtained on the basis of at least a second subpixel input signal and the corrected expansion coefficient $\alpha'_{i-0}$, and output to the second subpixel, a third subpixel output signal is obtained on the basis of at least a third subpixel input signal and the corrected expansion coefficient $\alpha'_{i-0}$, and output to the third subpixel, and a fourth subpixel output signal to a (p,q)th [where p=1, 2, . . . , and $P_0$, and q=1, 2, . . . , and $Q_0$] pixel when counting in the second direction is obtained on the basis of a fourth subpixel control second signal obtained from a first subpixel input signal, a second subpixel input signal, and a third subpixel input signal to the (p,q)th pixel and a fourth subpixel control first signal obtained from a first subpixel input signal, a second subpixel input signal, and a third subpixel input signal to an adjacent pixel adjacent to the (p,q)th pixel in the second direction, and output to the fourth subpixel of the (p,q)th pixel.

A fifth embodiment of the present disclosure is directed to a method of driving an image display device. The image display device includes (A) an image display panel in which P×Q pixel groups in total of P pixel groups in a first direction and Q pixel groups in a second direction are arranged in a two-dimensional matrix, and (B) a signal processor. Each pixel group has a first pixel and a second pixel in the first direction, the first pixel has a first subpixel displaying a first primary color, a second subpixel displaying a second primary color, and a third subpixel displaying a third primary color, and the second pixel has a first subpixel displaying a first primary color, a second subpixel displaying a second primary color, and a fourth subpixel displaying a fourth color. In an i-th image display frame, in the signal processor, a fourth subpixel output signal is obtained on the basis of a fourth subpixel control second signal obtained from a first subpixel input signal, a second subpixel input signal, and a third subpixel input signal to a (p,q)th [where p=1, 2, . . . , and P and q=1, 2, . . . , and Q] second pixel when counting in the second direction, a fourth subpixel control first signal obtained from a first subpixel input signal, a second subpixel input signal, and a third subpixel input signal to an adjacent pixel adjacent to the (p,q)th second pixel in the second direction, and a corrected expansion coefficient $\alpha'_{i-0}$, and output to the fourth subpixel of the (p,q)th second pixel, and a third subpixel output signal is obtained on the basis of at least a third subpixel input signal to the (p,q)th second pixel, a third subpixel input signal to a (p,q)th first pixel, and the corrected expansion coefficient $\alpha'_{i-0}$, and output to the third subpixel of the (p,q)th first pixel.

In the method of driving an image display device according to the first to fifth embodiments of the present disclosure, the maximum value $V_{max}(S)$ of luminosity with saturation S in an HSV color space enlarged by adding a fourth color as a variable is obtained in the signal processor or stored in the signal processor, and in the i-th image display frame, in the signal processor (a) saturation $S_i$ and luminosity $V_i(S)$ in a plurality of pixels are obtained on the basis of subpixel input signal values in the plurality of pixels, (b) an expansion coefficient $\alpha_{i-0}$ is obtained on the basis of at least one of the values of $V_{max}(S)/V_i(S)$ obtained in the plurality of pixels, and (c) the corrected expansion coefficient $\alpha'_{i-0}$ is determined on the basis of a corrected expansion coefficient $\alpha'_{(i-j)-0}$ applied in advance in an (i−j)th image display frame (where j is a positive integer equal to or greater than 1) and the expansion coefficient $\alpha_{i-0}$ obtained in the i-th image display frame.

Here, saturation S and luminosity V(S) are represented as follows.

$$S=(\mathrm{Max}-\mathrm{Min})/\mathrm{Max}$$

$$V(S)=\mathrm{Max}$$

Max: a maximum value among three subpixel input signal values including a first subpixel input signal value, a second subpixel input signal value, and a third subpixel input signal value to the pixel Min: a minimum value among three subpixel input signal values including a first subpixel input signal value, a second subpixel input signal value, and a third subpixel input signal value to the pixel.

The saturation S can have a value from 0 to 1, the luminosity V(S) can have a value from 0 to $(2^n-1)$, and n is the number of display gradation bits. "H" of "HSV color space" means the hue representing the type of color, "S" means saturation (saturation or chroma) representing vividness of a color, and "V" means luminosity (brightness value or lightness value) representing brightness of a color. The same applies to the following description. The upper limit value of j can range from 1 to 8.

With the method of driving an image display device according to the first to fifth embodiments of the present disclosure, the color space (HSV color space) is enlarged by adding the fourth color, and the subpixel output signals are obtained on the basis of at least the subpixel input signals and the corrected expansion coefficient $\alpha'_{i-0}$. In this way, since the output signal values are expanded on the basis of the corrected expansion coefficient $\alpha'_{i-0}$, unlike the related art, there is no case where, while the luminance of the white display subpixel is increased, the luminance of the red display subpixel, the green display subpixel, and the blue display subpixel is not increased. That is, for example, it is possible to increase not only the luminance of the white display subpixel but also the luminance of the red display subpixel, the green display subpixel, and the blue display subpixel.

The corrected expansion coefficient $\alpha'_{i-0}$ is determined on the basis of the corrected expansion coefficient $\alpha'_{(i-j)-0}$ applied in advance in the (i−j)th image display frame and the expansion coefficient $\alpha_{i-0}$ obtained in the i-th image display frame. Therefore, it is possible to provide a method of driving an image display device which can reduce the variation between the corrected expansion coefficient $\alpha'_{(i-j)-0}$ in the (i−j)th image display frame and the corrected expansion coefficient $\alpha'_{i-0}$ in the i-th image display frame and in which flickering is less likely to occur in an image.

With the method of driving an image display device according to the first embodiment of the present disclosure, it is possible to decrease the luminance of the planar light source device on the basis of the corrected expansion coefficient $\alpha'_{i-0}$, thereby achieving reduction in power consumption in the planar light source device.

With the method of driving an image display device according to the second and third embodiments of the present disclosure, the signal processor obtains and outputs the fourth subpixel output signal from the first subpixel input signal, the second subpixel input signal, and the third subpixel input signal to the first pixel and the second pixel of each pixel group. That is, since the fourth subpixel output signal is obtained on the basis of the input signal to adjacent first and second pixels, the optimization of the output signal to the fourth subpixel is achieved. With the method of driving an image display device according to the second and third embodiments of the present disclosure, since one fourth subpixel is disposed for a pixel group having at least the first pixel and the second pixel, it is possible to suppress a decrease in the area of the opening region for the subpixels. As a result, it is possible to reliably achieve an increase in luminance, making it possible to achieve improvement in display quality and to reduce power consumption in the planar light source device.

With the method of driving an image display device according to the fourth embodiment of the present disclosure, the fourth subpixel output signal to the (p,q)th pixel is obtained on the basis of the subpixel input signals to the (p,q)th pixel and the subpixel input signals to an adjacent pixel adjacent to this pixel in the second direction. That is, since the fourth subpixel output signal to a certain pixel is obtained on the basis of also the input signals to an adjacent pixel adjacent to the certain pixel, the optimization of the output signal to the fourth subpixel is achieved. Since the fourth subpixel is provided, it is possible to reliably achieve an increase in luminance, making it possible to achieve improvement in display quality and to reduce power consumption in the planar light source device.

With the method of driving an image display device according to the fifth embodiment of the present disclosure, the fourth subpixel output signal to the (p,q)th second pixel is obtained on the basis of the subpixel input signals to the (p,q)th second pixel and the subpixel input signals to an adjacent pixel adjacent to the second pixel in the second direction. That is, since the fourth subpixel output signal to the second pixel forming a certain pixel group is obtained on the basis of not only the input signals to the second pixel forming the certain pixel group but also the input signals to an adjacent pixel adjacent to the second pixel, the optimization of the output signal to the fourth subpixel is achieved. Since one fourth subpixel is disposed for a pixel group having the first pixel and the second pixel, it is possible to suppress a decrease in the area of the opening region for the subpixels. As a result, it is possible to reliably achieve an increase in luminance, making it possible to achieve improvement in display quality and to reduce power consumption in the planar light source device.

DETAILED DESCRIPTION

Figure 1:
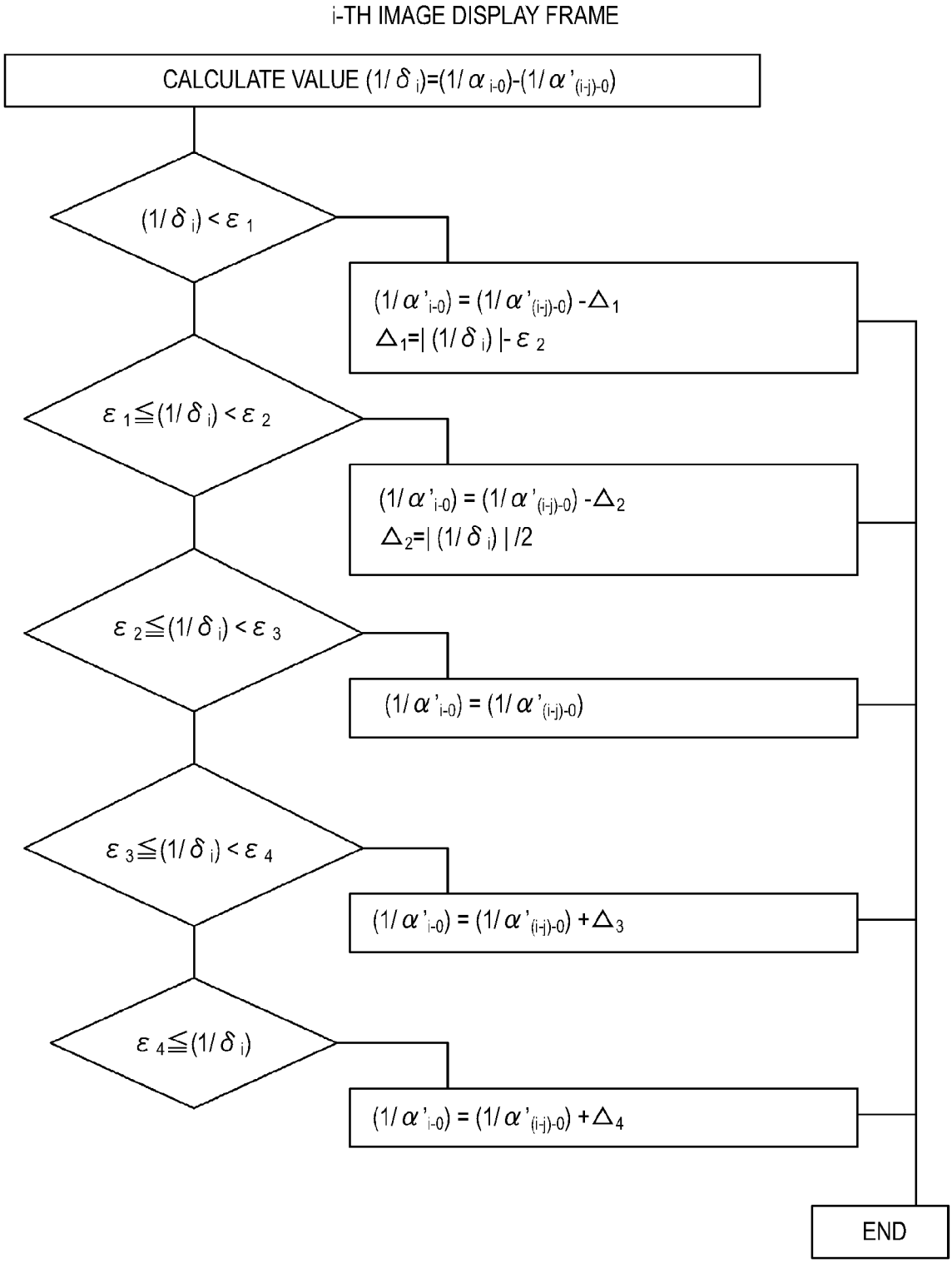
FIG. 1 is a diagram showing a flow for calculating a corrected expansion coefficient in an image display device of Example 1.

Hereinafter, the present disclosure will be described on the basis of examples with reference to the drawings. However, the present disclosure is not limited to the examples, and various numerical values, materials, and the like specified in the examples are merely illustrative. The description will be provided in the following sequence.

1. General description of a method of driving an image display device according to first to fifth embodiments of the present disclosure
2. Example 1 (a method of driving an image display device according to the first embodiment of the present disclosure)
3. Example 2 (a modification of Example 1)
4. Example 3 (another modification of Example 1)
5. Example 4 (a method of driving an image display device according to the second embodiment of the present disclosure)
6. Example 5 (a modification of Example 4)
7. Example 6 (another modification of Example 4)
8. Example 7 (a method of driving an image display device according to the third embodiment of the present disclosure)
9. Example 8 (a modification of Example 7)
10. Example 9 (a method of driving an image display device according to the fourth embodiment of the present disclosure)
11. Example 10 (a method of driving an image display device according to the fifth embodiment of the present disclosure), others

[General Description of a Method of Driving an Image Display Device According to the First to Fifth Embodiments of the Present Disclosure]

In a method of driving an image display device according to the first to fifth embodiments of the present disclosure, when $\Delta_1>\Delta_2>0$, $\Delta_4>\Delta_3>0$, a first predetermined value is $\epsilon_1$, a second predetermined value is $\epsilon_2$, a third predetermined value is $\epsilon_3$, a fourth predetermined value is $\epsilon_4$, $\epsilon_1<\epsilon_2<0$, and $\epsilon_4>\epsilon_3>0$, (A) if a value of $(1/\delta_i)=(1/\alpha_{i-0})-(1/\alpha'_{(i-j)-0})$ is smaller than the first predetermined value $\epsilon_1$, a corrected expansion coefficient $\alpha'_{i-0}$ can be calculated on the basis of the following expression, $$(1/\alpha'_{i-0})=(1/\alpha'_{(i-j)-0})-\Delta_1$$

(B) if $(1/\delta_i)$ is equal to or greater than the first predetermined value $\epsilon_1$ and smaller than the second predetermined value $\epsilon_2$, the corrected expansion coefficient $\alpha'_{i-0}$ can be calculated on the basis of the following expression, $$(1/\alpha'_{i-0})=(1/\alpha'_{(i-j)-0})-\Delta_2$$

(C) if $(1/\delta_i)$ is equal to or greater than the second predetermined value $\epsilon_2$ and smaller than the third predetermined value $\epsilon_3$, the corrected expansion coefficient $\alpha'_{i-0}$ can be calculated on the basis of the following expression, $$(1/\alpha'_{i-0})=(1/\alpha'_{(i-j)-0})$$

(D) if $(1/\delta_i)$ is equal to or greater than the third predetermined value $\epsilon_3$ and smaller than the fourth predetermined value $\epsilon_4$, the corrected expansion coefficient $\alpha'_{i-0}$ can be calculated on the basis of the following expression, and $$(1/\alpha'_{i-0})=(1/\alpha'_{(i-j)-0})+\Delta_3$$

(E) if $(1/\delta_i)$ is equal to or greater than the fourth predetermined value $\epsilon_4$, the corrected expansion coefficient $\alpha'_{i-0}$ can be calculated on the basis of the following expression.

$$(1/\alpha'_{i-0})=(1/\alpha'_{(i-j)-0})+\Delta_4$$

The values $\Delta_1$, $\Delta_2$, $\Delta_3$, $\Delta_4$, $\epsilon_1$, $\epsilon_2$, $\epsilon_3$, and $\epsilon_4$ may be fixed, may be switched by an image observer using, for example, a switch or the like, or may be automatically switched depending on a screen (image).

In the method of driving an image display device according to the first to fifth embodiments of the present disclosure including the above-described preferred mode, a planar light source device (backlight) which illuminates an image display panel is further provided, and the brightness of the planar light source device is controlled using the corrected expansion coefficient $\alpha'_{i-0}$. In this case, the brightness of the planar light source device which is controlled using the corrected expansion coefficient $\alpha'_{i-0}$ is the brightness of the planar light source device in an (i+k)th image display frame (where $0 \leq k \leq 5$). Accordingly, image flickering is less likely to occur. Specifically, it should suffice that the brightness of the planar light source device (the luminance of the light source) which illuminates the image display device is decreased on the basis of the corrected expansion coefficient $\alpha'_{i-0}$.

In the method of driving an image display device according to the first to fifth embodiments of the present disclosure including the above-described mode and configuration, although the expansion coefficient $\alpha_{i-0}$ is calculated on the basis of at least one of the values $V_{max}(S)/V_i(S)$ [$\equiv\alpha(S)$] calculated in a plurality of pixels, the expansion coefficient $\alpha_{i-0}$ may be calculated on the basis of one value (for example, the smallest value $\alpha_{min}$), multiple values $\alpha(S)$ may be calculated in sequence from the smallest value and the average value ($\alpha_{ave}$) of these values may be set as the expansion coefficient $\alpha_{i-0}$, or any value among $(1\pm0.4)\cdot\alpha_{ave}$ may be set as the expansion coefficient $\alpha_{i-0}$. Alternatively, if the number of pixels when multiple values $\alpha(S)$ are calculated in sequence from the smallest value is equal to or smaller than a predetermined number, multiple values $\alpha(S)$ may be calculated again in sequence from the smallest value after changing the number of multiple values.

Alternatively, in the method of driving an image display device according to the first to fifth embodiments of the present disclosure, the expansion coefficient $\alpha_{i-0}$ may be determined such that the ratio of pixels, in which the value of expanded luminosity obtained from the product of luminosity $V_1(S)$ and the expansion coefficient $\alpha_{i-0}$ exceeds the maximum value $V_{max}(S)$, as to all pixels is equal to or smaller than a predetermined value ($\beta_{PD}$). For convenience, this driving system is called "driving method-A". The predetermined value $\beta_{PD}$ can range from 0.003 to 0.05. That is, the expansion coefficient $\alpha_{i-0}$ may be determined such that the ratio of pixels, in which the value of expanded luminosity obtained from the product of luminosity $V_i(S)$ and the expansion coefficient $\alpha_{i-0}$ exceeds the maximum value $V_{max}(S)$, is equal to or greater than 0.3% and equal to or smaller than 5% as to all pixels.

In the driving method-A, saturation $S_i$ and luminosity $V_i(S)$ in a plurality of pixels are obtained on the basis of subpixel input signal values of a plurality of pixels, and the expansion coefficient $\alpha_{i-0}$ is determined such that the ratio of pixels, in which the value of expanded luminosity obtained from the product of the luminosity $V_i(S)$ and the expansion coefficient $\alpha_{i-0}$ exceeds the maximum value $V_{max}(S)$, as to all pixels is equal to or smaller than a predetermined value ($\beta_{PD}$). Therefore, it is possible to achieve the optimization of the output signals to the subpixels and to prevent the occurrence of a phenomenon where so-called "gradation loss" is conspicuous and an unnatural image is generated. It is also possible to reliably achieve an increase in luminance and reduction in power consumption in the entire image display device.

Alternatively, in the method of driving an image display device according to the first to fifth embodiments of the present disclosure, assuming that the luminance of a group of a first subpixel, a second subpixel, and a third subpixel forming a pixel (the first embodiment of the present disclosure or the fourth embodiment of the present disclosure) or a pixel group (the second embodiment of the present disclosure, the third embodiment of the present disclosure, or the fifth embodiment of the present disclosure) when a signal having a value corresponding to the maximum signal value of a first subpixel output signal is input to the first subpixel, a signal having a value corresponding to the maximum signal value of a second subpixel output signal is input to the second subpixel, and a signal having a value corresponding to the maximum signal value of a third subpixel output signal is input to the third subpixel is $BN_{1-3}$, and the luminance of a fourth subpixel when a signal having a value corresponding to the maximum signal value of a fourth subpixel output signal is input to a fourth subpixel forming a pixel (the first embodiment of the present disclosure or the fourth embodiment of the present disclosure) or a pixel group (the second embodiment of the present disclosure, the third embodiment of the present disclosure, or the fifth embodiment of the present disclosure) is $BN_4$, the following expression may be established.

$$\alpha_{i-0}=(BN_4/BN_{1-3})+1$$

Broadly speaking, a mode in which the expansion coefficient $\alpha_{i-0}$ is represented using a function of $(BN_4/BN_{1-3})$ may be made. For convenience, this driving system is called "driving method-B".

In the driving method-B, the expansion coefficient $\alpha_{i-0}$ is represented by the following expression.

$$\alpha_{i-0}=(BN_4/BN_{1-3})+1$$

Therefore, it is possible to prevent the occurrence of a phenomenon where so-called "gradation loss" is conspicuous and an unnatural image is generated. It is also possible to reliably achieve an increase in luminance and reduction in power consumption in the entire image display device.

Alternatively, in the method of driving an image display device according to the first to fifth embodiments of the present disclosure, a mode may be made in which, when a color defined with (R,G,B) is displayed in a pixel, and the ratio of pixels, in which the hue H and the saturation S in the HSV color space are within the ranges defined with the following expressions, as to all pixels exceeds a predetermined value $\beta'_{PD}$ (for example, specifically, 2%), the expansion coefficient $\alpha_{i-0}$ is set to be equal to or smaller than a predetermined value $\alpha'_{PD}$ (specifically, for example, equal to or smaller than 1.3).

$$40 \leq H \leq 65$$

$$0.5 \leq S \leq 1.0$$

The lower limit value of the expansion coefficient $\alpha_{i-0}$ is 1.0. The same applies to the following description. For convenience, this driving system is called "driving method-C".

With (R,G,B), when the value of R is the maximum, the hue H is represented by the following expression.

$$H=60(G-B)/(\text{Max}-\text{Min})$$

When the value of G is the maximum, the hue H is represented by the following expression.

$$H=60(B-R)/(\text{Max}-\text{Min})+120$$

When the value of B is the maximum, the hue H is represented by the following expression.

$$H=60(R-G)/(\text{Max}-\text{Min})+240$$

The saturation is represented by the following expression.

$$S=(\text{Max}-\text{Min})/\text{Max}$$

Max: a maximum value among three subpixel input signal values including a first subpixel input signal value, a second subpixel input signal value, and a third subpixel input signal value to the pixel Min: a minimum value among three subpixel input signal values including a first subpixel input signal value, a second subpixel input signal value, and a third subpixel input signal value to the pixel Through various tests, when yellow is greatly mixed in the color of an image, if the expansion coefficient $\alpha_{i-0}$ exceeds the predetermined value $\alpha'_{PD}$ (for example, $\alpha'_{PD}$=1.3), it was determined that an unnatural colored image is generated. In the driving method-C, when the ratio of pixels, in which the hue H and the saturation S in the HSV color space are within predetermined ranges, as to all pixels exceeds the predetermined value $\beta'_{PD}$ (for example, specifically, 2%) (in other words, when yellow is greatly mixed in the color of an image), the expansion coefficient $\alpha_{i-0}$ is set to be equal to or smaller than the predetermined value $\alpha'_{PD}$ (for example, specifically, equal to or smaller than 1.3). Accordingly, even when yellow is greatly mixed in the color of an image, it is possible to achieve the optimization of the output signals to the subpixels and to prevent this image from becoming an unnatural image. It is also possible to reliably achieve an increase in luminance and reduction in power consumption in the entire image display device.

Alternatively, in the method of driving an image display device according to the first to fifth embodiments of the present disclosure, a mode may be made in which, when a color defined with (R,G,B) is displayed in a pixel, and the ratio of pixels, in which (R,G,B) satisfies the following expressions, as to all pixels exceeds the predetermined value $\beta'_{PD}$ (for example, specifically, 2%), the expansion coefficient $\alpha_{i-0}$ may be set to be equal to or smaller than the predetermined value $\alpha'_{PD}$ (for example, specifically, equal to or smaller than 1.3). For convenience, this driving system is called "driving method-D".

With (R,G,B), when the value of R is the maximum value and the value of B is the minimum value, the values of R, G, and B satisfy the following expressions.

$$R \geq 0.78 \times (2^n - 1)$$

$$G \geq (2R/3) + (B/3)$$

$$B \leq 0.50R$$

Alternatively, with (R,G,B), when the value of G is the maximum value and the value of B is the minimum value, the values of R, G, and B satisfy the following expressions.

$$R \geq (4B/60) + (56G/60)$$

$$G \geq 0.78 \times (2^n - 1)$$

$$B \leq 0.50R$$

Here, n is the number of display gradation bits.

In the driving method-D, when the ratio of pixels, which has a specific value in (R,G,B), as to all pixels exceeds the predetermined value $\beta'_{PD}$ (for example, specifically, 2%) (in other words, when yellow is greatly mixed in the color of an image), the expansion coefficient $\alpha_{i-0}$ is set to be equal to or smaller than the predetermined value $\alpha'_{PD}$ (for example, specifically, equal to or smaller than 1.3). Therefore, even when yellow is greatly mixed in the color of an image, it is possible to achieve the optimization of the output signals to the subpixels and to prevent this image from becoming an unnatural image. It is also possible to reliably achieve an increase in luminance and reduction in power consumption in the entire image display device. It is also possible to determine whether or not yellow is greatly mixed in the color of an image with a little calculation amount, to reduce the circuit scale of the signal processor, and to achieve reduction in calculation time.

Alternatively, in the method of driving an image display device according to the first to fifth embodiments of the present disclosure, a mode may be made in which, when the ratio of pixels, which display yellow, as to all pixels exceeds the predetermined value $\beta'_{PD}$ (for example, specifically, 2%), the expansion coefficient $\alpha_{i-0}$ is set to be equal to or smaller than a predetermined value (for example, specifically, equal to or smaller than 1.3). For convenience, this driving system is called "driving method-E".

In the driving method-E, when the ratio of pixels, which display yellow, as to all pixels exceeds the predetermined value $\beta'_{PD}$ (for example, specifically, 2%), the expansion coefficient $\alpha_{i-0}$ is set to be equal to or smaller than a predetermined value (for example, specifically, equal to or smaller than 1.3). Therefore, it is possible to achieve the optimization of the output signals to the subpixels and to prevent this image from becoming an unnatural image. It is also possible to reliably achieve an increase in luminance and reduction in power consumption in the entire image display device.

In the method of driving an image display device according to the first embodiment of the present disclosure (hereinafter, may be referred to as "the first embodiment of the present disclosure") or the method of driving an image display device according to the fourth embodiment of the present disclosure (hereinafter, may be referred to as "the fourth embodiment of the present disclosure") including the above-described preferred mode, the configuration, and the driving method-A to the driving method-E, in regard to a (p,q)th pixel (where, $1 \leq p \leq P_0$ and $1 \leq q \leq Q_0$), the signal processor may have a configuration in which a first subpixel input signal having a signal value $x_{1-(p,q)}$, a second subpixel input signal having a signal value $x_{2-(p,q)}$, and a third subpixel input signal having a signal value $x_{3-(p,q)}$.

are input thereto.

The signal processor may be configured to output a first subpixel output signal having a signal value $X_{1-(p,q)}$ for determining the display gradation of a first subpixel, a second subpixel output signal having a signal value $X_{2-(p,q)}$ for determining the display gradation of a second subpixel, a third subpixel output signal having a signal value $X_{3-(p,q)}$ for determining the display gradation of a third subpixel, and a fourth subpixel output signal having a signal value $X_{4-(p,q)}$ for determining the display gradation of a fourth subpixel.

In the method of driving an image display device according to the second embodiment of the present disclosure (hereinafter, may be referred to as "the second embodiment of the present disclosure"), the method of driving an image display device according to the third embodiment of the present disclosure (hereinafter, may be referred to as "the third embodiment of the present disclosure"), or the method of driving an image display device according to the fifth embodiment of the present disclosure (hereinafter, may be referred to as "the fifth embodiment of the present disclosure") including the above-described mode, the configuration, and the driving method-A to the driving method-E, in regard to a first pixel forming a (p,q)th pixel group (where $1 \leq p \leq P$ and $1 \leq q \leq Q$), a first subpixel input signal having a signal value $x_{1-(p,q)-1}$, a second subpixel input signal having a signal value $x_{2-(p,q)-1}$, and a third subpixel input signal having a signal value $x_{3-(p,q)-1}$, are input to the signal processor, and in regard to a second pixel forming the (p,q)th pixel group, a first subpixel input signal having a signal value $x_{1-(p,q)-2}$, a second subpixel input signal having a signal value $x_{2-(p,q)-2}$, and a third subpixel input signal having a signal value $x_{3-(p,q)-2}$ are input to the signal processor.

The signal processor outputs, in regard to the first pixel forming the (p,q)th pixel group, a first subpixel output signal having a signal value $X_{1-(p,q)-1}$ for determining the display gradation of a first subpixel, a second subpixel output signal having a signal value $X_{2-(p,q)-1}$ for determining the display gradation of a second subpixel, and a third subpixel output signal having a signal value $X_{3-(p,q)-1}$ for determining the display gradation of a third subpixel, and outputs, in regard to the second pixel forming the (p,q)th pixel group, a first subpixel output signal having a signal value $X_{1-(p,q)-2}$ for determining the display gradation of a first subpixel, a second subpixel output signal having a signal value $X_{2-(p-q)-2}$ for determining the display gradation of a second subpixel, and a third subpixel output signal having a signal value $X_{3-(p,q)-2}$ for determining the display gradation of a third subpixel (the second embodiment of the present disclosure), and outputs, in regard to a fourth subpixel, a fourth subpixel output signal having a signal value $X_{4-(p,q)-2}$ for determining the display gradation of the fourth subpixel (the second, third, or fifth embodiment of the present disclosure).

In the third embodiment of the present disclosure, in regard to an adjacent pixel adjacent to the (p,q)th pixel, the signal processor may have a configuration in which a first subpixel input signal having a signal value $x_{1-(p',q)}$, a second subpixel input signal having a signal value $x_{2-(p',q)}$, and a third subpixel input signal having a signal value $x_{3-(p',q)}$ are input thereto.

In the fourth and fifth embodiments of the present disclosure, in regard to an adjacent pixel adjacent to the (p,q)th pixel, the signal processor may have a configuration in which a first subpixel input signal having a signal value $x_{1-(p,q')}$, a second subpixel input signal having a signal value $x_{2-(p,q')}$, and a third subpixel input signal having a signal value $x_{3-(p,q')}$ are input thereto.

$Max_{(p,q)}$, $Min_{(p,q)}$, $Max_{(p,q)-1}$, $Min_{(p,q)-1}$, $Max_{(p,q)-2}$, $Min_{(p,q)-2}$, $Max_{(p',q)-1}$, $Min_{(p',q)-1}$, $Max_{(p,q')}$, and $Min_{(p,q')}$ are defined as follows.

$Max_{(p,q)}$: the maximum value among three subpixel input signal values including the first subpixel input signal value $x_{1-(p,q)}$, the second subpixel input signal value $x_{2-(p,q)}$, and the third subpixel input signal value $x_{3-(p,q)}$ to the (p,q)th pixel $Min_{(p,q)}$: the minimum value among three subpixel input signal values including the first subpixel input signal value $x_{1-(p,q)}$, the second subpixel input signal value $x_{2-(p,q)}$, and the third subpixel input signal value $x_{3-(p,q)}$ to the (p,q)th pixel $Max_{(p,q)-1}$: the maximum value among three subpixel input signal values including the first subpixel input signal value $x_{1-(p,q)-1}$, the second subpixel input signal value $x_{2-(p,q)-1}$, and the third subpixel input signal value $x_{3-(p,q)-1}$ to the (p,q)th first pixel $Min_{(p,q)-1}$: the minimum value among three subpixel input signal values including the first subpixel input signal value $x_{1-(p,q)-1}$, the second subpixel input signal value $x_{2-(p,q)-1}$, and the third subpixel input signal value $x_{3-(p,q)-1}$ to the (p,q)th first pixel $Max_{(p,q)-2}$: the maximum value among three subpixel input signal values including the first subpixel input signal value $x_{1-(p,q)-2}$, the second subpixel input signal value $x_{2-(p,q)-2}$, and the third subpixel input signal value $x_{3-(p,q)-2}$ to the (p,q)th second pixel $Min_{(p,q)-2}$: the minimum value among three subpixel input signal values including the first subpixel input signal value $x_{1-(p,q)-2}$, the second subpixel input signal value $x_{2-(p,q)-2}$, and the third subpixel input signal value $x_{3-(p,q)-2}$ to the (p,q)th second pixel $Max_{(p',q)-1}$: the minimum value among three subpixel input signal values including the first subpixel input signal value $x_{1(p',q)}$, the second subpixel input signal value $x_{2-(p',q)}$, and the third subpixel input signal value $x_{3-(p',q)}$ to an adjacent pixel adjacent to the (p,q)th second pixel in the first direction $Min_{(p',q)-1}$: the minimum value among three subpixel input signal values including the first subpixel input signal value $x_{1-(p',q)}$, the second subpixel input signal value $x_{2-(p',q)}$, and the third subpixel input signal value $x_{3-(p',q)}$ to an adjacent pixel adjacent to the (p,q)th second pixel in the first direction $Max_{(p,q')}$: the maximum value among three subpixel input signal values including the first subpixel input signal value the second subpixel input signal value $x_{2-(p,q')}$, and the third subpixel input signal value $x_{3-(p,q')}$ to an adjacent pixel adjacent to the (p,q)th second pixel in the second direction $Min_{(p,q')}$: the minimum value among three subpixel input signal values including the first subpixel input signal value the second subpixel input signal value $x_{2-(p,q')}$, and the third subpixel input signal value $x_{3-(p,q')}$ to an adjacent pixel adjacent to the (p,q)th second pixel in the second direction In the first embodiment of the present disclosure, a configuration in which the fourth subpixel output signal value is calculated on the basis of at least the value of Min and the corrected expansion coefficient $\alpha'_{i-0}$ may be made. Specifically, the fourth subpixel output signal value $X_{4-(p,q)}$ can be obtained from the following expression. Here, $c_{11}$, $c_{12}$, $c_{13}$, $c_{14}$, $c_{15}$, and $c_{16}$ are constants. What kind of value or expression is used as the value of $X_{4-(p,q)}$ may be appropriately determined by experimentally manufacturing an image display device and performing image evaluation by an image observer, for example.

$$X_{4-(p,q)}=c_{11}(Min_{(p,q)})\cdot\alpha'_{i-0} \quad (1\text{-}1)$$

or $$X_{4-(p,q)}=c_{12}(Min_{(p,q)})^2\cdot\alpha'_{i-0} \quad (1\text{-}2)$$

or $$X_{4-(p,q)}=c_{13}(Max_{(p,q)})^{1/2}\alpha'_{i-0} \quad (1\text{-}3)$$

or $$X_{4-(p,q)}=c_{14}\{\text{product of either}(Min_{(p,q)}/Max_{(p,q)}) \text{ or } (2^n-1) \text{ and } \alpha'_{i-0}\} \quad (1\text{-}4)$$

or $$X_{4-(p,q)}=c_{15}[\text{product of either } \{(2^n-1)\times Min_{(p,q)}/(Max_{(p,q)}-Min_{(p,q)}\} \text{ or } (2^n-1) \text{ and } \alpha'_{i-0}] \quad (1\text{-}5)$$

or $$X_{4-(p,q)}=c_{16}\{\text{product of smaller value of } (Max_{(p,q)})^{1/2} \text{ and } Min_{(p,q)} \text{ and } \alpha'_{i-0}\} \quad (1\text{-}6)$$

In the first embodiment of the present disclosure or the fourth embodiment of the present disclosure, the following configuration may be made:

the first subpixel output signal is obtained on the basis of at least the first subpixel input signal and the corrected expansion coefficient $\alpha'_{i-0}$, the second subpixel output signal is obtained on the basis of at least the second subpixel input signal and the corrected expansion coefficient $\alpha'_{i-0}$, and the third subpixel output signal is obtained on the basis of at least the third subpixel input signal and the corrected expansion coefficient $\alpha'_{i-0}$.

More specifically, in the first embodiment of the present disclosure or the fourth embodiment of the present disclosure, when $\chi$ is set as a constant depending on the image display device, in the signal processor, the first subpixel output signal value $X_{1-(p,q)}$, the second subpixel output signal value $X_{2-(p,q)}$ and the third subpixel output signal value $X_{3-(p,q)}$ to the (p,q) th pixel (or a set of a first subpixel, a second subpixel, and a third subpixel) can be obtained from the following expression. A fourth subpixel control second signal value $SG_{2-(p,q)}$, a fourth subpixel control first signal value $SG_{1-(p,q)}$, and a control signal value (third subpixel control signal value) $SG_{3-(p,q)}$ will be described below.

First Embodiment of Present Disclosure $$X_{1-(p,q)}=\alpha'_{i-0}\cdot x_{1-(p,q)}-\chi\cdot X_{4-(p,q)} \quad (1\text{-A})$$

$$X_{2-(p,q)}=\alpha'_{i-0}\cdot x_{2-(p,q)}-\chi X_{4-(p,q)} \quad (1\text{-B})$$

$$X_{3-(p,q)}=\alpha'_{i-0}\cdot x_{3-(p,q)}-\chi\cdot X_{4-(p,q)} \quad (1\text{-C})$$

Fourth Embodiment of Present Disclosure $$X_{1-(p,q)}=\alpha'_{i-0}\cdot x_{1-(p,q)}-\chi\cdot SG_{2-(p,q)} \quad (1\text{-D})$$

$$X_{2-(p,q)}=\alpha'_{i-0}\cdot x_{2-(p,q)}-\chi\cdot SG_{2-(p,q)} \quad (1\text{-E})$$

$$X_{3-(p,q)}=\alpha'_{i-0}\cdot x_{3-(p,q)}-\chi\cdot SG_{2-(p,q)} \quad (1\text{-F})$$

Assuming that the luminance of a group of a first subpixel, a second subpixel, and a third subpixel forming a pixel (the first embodiment of the present disclosure or the fourth embodiment of the present disclosure) or a pixel group (the second embodiment of the present disclosure, the third embodiment of the present disclosure, or the fifth embodiment of the present disclosure) when a signal having a value corresponding to the maximum signal value of a first subpixel output signal is input to a first subpixel, a signal having a value corresponding to the maximum signal value of a second subpixel output signal is input to a second subpixel, and a signal having a value corresponding to the maximum signal value of a third subpixel output signal is input to a third subpixel is $BN_{1-3}$, and the luminance of a fourth subpixel when a signal having a value corresponding to the maximum signal value of a fourth subpixel output signal is input to the fourth subpixel forming a pixel (the first embodiment of the present disclosure or the fourth embodiment of the present disclosure) or a pixel group (the second embodiment of the present disclosure, the third embodiment of the present disclosure, or the fifth embodiment of the present disclosure) is $BN_4$, the constant $\chi$ can be represented by the following expression.

$$\chi=BN_4/BN_{1-3}$$

Accordingly, in the above-described driving method-B, the expression of $$\alpha_{i-0}=BN_4/BN_{1-3}+1$$

may be rewritten with $$\alpha_{i-0}=\chi+1.$$

The constant $\chi$ is a value specific to the image display device and is uniquely determined by the image display device. In regard to the constant $\chi$, the same applies to the following description.

In the second embodiment of the present disclosure, the following configuration may be made:

in regard to a first pixel, while the first subpixel output signal is obtained on the basis of at least the first subpixel input signal and the corrected expansion coefficient $\alpha'_{i-0}$, a first subpixel output signal (signal value $X_{1-(p,q)-1}$) is calculated on the basis of at least a first subpixel input signal (signal value $x_{1-(p,q)-1}$) the corrected expansion coefficient $\alpha'_{i-0}$, and a fourth subpixel control first signal (signal value $SG_{1-(p,q)}$), while the second subpixel output signal is obtained on the basis of at least the second subpixel input signal and the corrected expansion coefficient $\alpha'_{i-0}$, a second subpixel output signal (signal value $X_{2-(p,q)-1}$) is obtained on the basis at least a second subpixel input signal value $x_{2-(p,q)-1}$, the corrected expansion coefficient $\alpha'_{i-0}$, and a fourth subpixel control first signal (signal value $SG_{1-(p,q)}$), and while the third subpixel output signal is obtained on the basis of at least the third subpixel input signal and the corrected expansion coefficient $\alpha'_{i-0}$, a third subpixel output signal (signal value $X_{3-(p,q)-1}$) is obtained on the basis of at least a third subpixel input signal value $x_{3-(p,q)-1}$, the corrected expansion coefficient $\alpha'_{i-0}$, and a fourth subpixel control first signal (signal value $SG_{1-(p,q)}$); and in regard to the second pixel, while the first subpixel output signal is obtained on the basis of at least the first subpixel input signal and the corrected expansion coefficient $\alpha'_{i-0}$, a first subpixel output signal (signal value $X_{1-(p,q)-2}$) is obtained on the basis of at least a first subpixel input signal value $x_{i-(p,q)-2}$, the corrected expansion coefficient $\alpha'_{i-0}$, and a fourth subpixel control second signal (signal value $SG_{2-(p,q)}$), while the second subpixel output signal is obtained on the basis of at least the second subpixel input signal and the corrected expansion coefficient $\alpha'_{i-0}$, a second subpixel output signal (signal value $X_{2-(p,q)-2}$) is obtained on the basis of at least a second subpixel input signal value $x_{2-(p,q)-2}$, the corrected expansion coefficient $\alpha'_{i-0}$, and a fourth subpixel control second signal (signal value $SG_{2-(p,q)}$), and while the third subpixel output signal is obtained on the basis of at least the third subpixel input signal and the corrected expansion coefficient $\alpha'_{i-0}$, a third subpixel output signal (signal value $X_{3-(p,q)-2}$) is obtained on the basis of at least a third subpixel input signal value $x_{3-(p,q)-2}$, the corrected expansion coefficient $\alpha'_{i-0}$, and a fourth subpixel control second signal (signal value $SG_{2-(p,q)}$).

In the second embodiment of the present disclosure, as described above, although the first subpixel output signal value $X_{1-(p,q)-1}$ is calculated on the basis of the first subpixel input signal value $x_{1-(p,q)-1}$, the corrected expansion coefficient $\alpha'_{i-0}$, and the fourth subpixel control first signal value $SG_{1-(p,q)}$, the first subpixel output signal value $X_{i-(p,q)-1}$ can be obtained from the following expression.

$$[x_{1-(p,q)-1},\alpha'_{i-0},SG_{1-(p,q)}]$$

or $$[x_{1-(p,q)-1},x_{1-(p,q)-2},\alpha'_{i-0},SG_{1-(p,q)}]$$

Similarly, although the second subpixel output signal value $X_{2-(p,q)-1}$ is calculated on the basis of at least the second subpixel input signal value $x_{2-(p,q)-1}$, the corrected expansion coefficient $\alpha'_{i-0}$, and the fourth subpixel control first signal value $SG_{1-(p,q)}$, the second subpixel output signal value $X_{2-(p,q)-1}$ can be obtained from the following expression.

$$[x_{2-(p,q)-1}, \alpha'_{i-0}, SG_{1-(p,q)}]$$

or $$[x_{2-(p,q)-1}, x_{2-(p,q)-2}, \alpha'_{i-0}, SG_{1-(p,q)}]$$

Similarly, although the third subpixel output signal value $X_{3-(p,q)-1}$ is calculated on the basis of at least the third subpixel input signal value $X_{3-(p,q)-1}$, the corrected expansion coefficient $\alpha'_{i-0}$, and the fourth subpixel control first signal value $SG_{1-(p,q)}$, the third subpixel output signal value $X_{3-(p,q)-1}$ can be obtained from the following expression.

$$[x_{3-(p,q)-1}, \alpha_{i-}, SG_{1-(p,q)}]$$

or $$[x_{3-(p,q)-1}, x_{3-(p,q)-2}, \alpha_{i-}, SG_{1-(p,q)}]$$

The same can apply to the output signal values $X_{1-(p,q)-2}$, $X_{2-(p,q)-2}$, and $X_{3-(p,q)-2}$.

More specifically, in the second embodiment of the present disclosure, in the signal processor, the output signal values $X_{1-(p,q)-1}$, $X_{2-(p,q)-1}$, $X_{3-(p,q)-1}$, $X_{1-(p,q)-2}$, $X_{2-(p,q)-2}$, and $X_{3-(p,q)-2}$ can be obtained from the following expressions.

$$X_{1-(p,q)-1} = \alpha'_{i-0} \cdot x_{1-(p,q)-1} - \chi \cdot SG_{1-(p,q)} \quad (2\text{-A})$$

$$X_{2-(p,q)-1} = \alpha'_{i-0} \cdot x_{2-(p,q)-1} - \chi \cdot SG_{1-(p,q)} \quad (2\text{-B})$$

$$X_{3-(p,q)-1} = \alpha'_{i-0} \cdot x_{3-(p,q)-1} - \chi \cdot SG_{1-(p,q)} \quad (2\text{-C})$$

$$X_{1-(p,q)-2} = \alpha'_{i-0} \cdot x_{1-(p,q)-2} - \chi \cdot SG_{2-(p,q)} \quad (2\text{-D})$$

$$X_{2-(p,q)-2} = \alpha'_{i-0} \cdot x_{2-(p,q)-2} - \chi \cdot SG_{2-(p,q)} \quad (2\text{-E})$$

$$X_{3-(p,q)-2} = \alpha'_{i-0} \cdot x_{3-(p,q)-2} - \chi \cdot SG_{2-(p,q)} \quad (2\text{-F})$$

In the third or fifth embodiment of the present disclosure, in regard to a second pixel, the following configuration may be made:

while the first subpixel output signal is obtained on the basis of at least the first subpixel input signal and the corrected expansion coefficient $\alpha'_{i-0}$, a first subpixel output signal (signal value $X_{1-(p,q)-2}$) is obtained on the basis of at least a first subpixel input signal value $x_{1-(p,q)-2}$, the corrected expansion coefficient $\alpha'_{i-0}$, and a fourth subpixel control second signal (signal value $SG_{2-(p,q)}$), and while the second subpixel output signal is obtained on the basis of at least the second subpixel input signal and the corrected expansion coefficient $\alpha'_{i-0}$, a second subpixel output signal (signal value $X_{2-(p,q)-2}$) is obtained on the basis of at least a second subpixel input signal value $x_{2-(p,q)-2}$, the corrected expansion coefficient $\alpha'_{i-0}$, and a fourth subpixel control second signal (signal value $SG_{2-(p,q)}$).

In regard to a first pixel, the following configuration may be made:

while the first subpixel output signal is obtained on the basis of at least the first subpixel input signal and the corrected expansion coefficient $\alpha'_{i-0}$, the first subpixel output signal (signal value $X_{1-(p,q)-1}$) is obtained on the basis of at least the first subpixel input signal value $x_{1-(p,q)-1}$, the corrected expansion coefficient $\alpha'_{i-0}$, and the third subpixel control signal (signal value $SG_{3-(p,q)}$) or the fourth subpixel control first signal (signal value $SG_{1-(p,q)}$), while the second subpixel output signal is obtained on the basis of at least the second subpixel input signal and the corrected expansion coefficient $\alpha'_{i-0}$, the second subpixel output signal (signal value $X_{2-(p,q)-1}$) is obtained on the basis of at least the second subpixel input signal value $x_{2-(p,q)-1}$, the corrected expansion coefficient $\alpha'_{i-0}$, and the third subpixel control signal (signal value $SG_{3-(p,q)}$) or the fourth subpixel control first signal (signal value $SG_{1-(p,q)}$), and while the third subpixel output signal is obtained on the basis of at least the third subpixel input signal and the corrected expansion coefficient $\alpha'_{i-0}$, the third subpixel output signal (signal value $X_{3-(p,q)-1}$) is obtained on the basis of at least the third subpixel input signal values $x_{3-(p,q)-1}$ and $x_{3-(p,q)-2}$, the corrected expansion coefficient $\alpha'_{i-0}$, the third subpixel control signal (signal value $SG_{3-(p,q)}$), and the fourth subpixel control second signal (signal value $SG_{2-(p,q)}$) or is obtained on the basis of at least the third subpixel input signal values $x_{3-(p,q)-1}$ and $x_{3-(p,q)-2}$ the corrected expansion coefficient $\alpha'_{i-0}$, the fourth subpixel control first signal (signal value $SG_{1-(p,q)}$) and the fourth subpixel control second signal (signal value $SG_{2-(p,q)}$).

More specifically, in the third embodiment of the present disclosure or the fifth embodiment of the present disclosure, in the signal processor, the output signal values $X_{1-(p,q)-2}$, $X_{2-(p,q)-2}$, $X_{1-(p,q)-1}$, $X_{2-(p,q)-1}$, and $X_{3-(p,q)-1}$ can be obtained from the following expressions.

$$X_{1-(p,q)-2} = \alpha'_{i-0} \cdot x_{1-(p,q)-2} - \chi \cdot SG_{2-(p,q)} \quad (3\text{-A})$$

$$X_{2-(p,q)-2} = \alpha'_{i-0} \cdot x_{2-(p,q)-2} - \chi \cdot SG_{2-(p,q)} \quad (3\text{-B})$$

$$X_{1-(p,q)-1} = \alpha'_{i-0} \cdot x_{1-(p,q)-1} - \chi \cdot SG_{1-(p,q)} \quad (3\text{-C})$$

$$X_{2-(p,q)-1} = \alpha'_{i-0} \cdot x_{2-(p,q)-1} - \chi \cdot SG_{1-(p,q)} \quad (3\text{-D})$$

or $$X_{1-(p,q)-1} = \alpha'_{i-0} \cdot x_{1-(p,q)-1} - \chi \cdot SG_{3-(p,q)} \quad (3\text{-E})$$

$$X_{2-(p,q)-1} = \alpha'_{i-0} \cdot x_{2-(p,q)-1} - \chi \cdot SG_{3-(p,q)} \quad (3\text{-F})$$

Assuming that $C_{31}$ and $C_{32}$ are set as constants, for example, the third subpixel output signal (third subpixel output signal value $X_{3-(p,q)-1}$) in the first pixel can be obtained from the following expression.

$$X_{3-(p,q)-1} = (C_{31} \cdot X'_{3-(p,q)-1} + C_{32} \cdot X'_{3-(p,q)-2}) / (C_{21} + C_{22} \quad (3\text{-a})$$

or $$X_{3-(p,q)-1} = C_{31} \cdot X'_{3-(p,q)-1} + C_{32} \cdot X'_{3-(p,q)-2} \quad (3\text{-b})$$

or $$X_{3-(p,q)-1} = C_{21} \cdot (X'_{3-(p,q)-1} - X'_{3-(p,q)-2}) + C_{22} \cdot X'_{3-(p,q)-2} \quad (3\text{-c})$$

Here, the following expressions are established.

$$X'_{3-(p,q)-1} = \alpha'_{i-0} \cdot x_{3-(p,q)-1} - \chi \cdot SG_{1-(p,q)} \quad (3\text{-d})$$

$$X'_{3-(p,q)-2} = \alpha'_{i-0} \cdot x_{3-(p,q)-2} - \chi \cdot SG_{2-(p,q)} \quad (3\text{-e})$$

or $$X'_{3-(p,q)-1} = \alpha'_{i-0} \cdot x_{3-(p,q)-1} - \chi \cdot SG_{3-(p,q)} \quad (3\text{-f})$$

$$X'_{3-(p,q)-2} = \alpha'_{i-0} \cdot x_{3-(p,q)-2} - \chi \cdot SG_{2-(p,q)} \quad (3\text{-g})$$

In the second to fifth embodiments of the present disclosure, specifically, the fourth subpixel control first signal (signal value $SG_{1-(p,q)}$) and the fourth subpixel control second signal (signal value $SG_{2-(p,q)}$) can be obtained from the following expression. Here, $c_{21}$, $c_{22}$, $c_{23}$, $c_{24}$, $c_{25}$, and $c_{26}$ are constants. What kind of values or expressions are used as the values of $X_{4-(p,q)}$ and $X_{4-(p,q)-2}$ may be appropriately determined by experimentally manufacturing an image display device and performing image evaluation by an image observer, for example.

$$SG_{1-(p,q)}=c_{21}(\mathrm{Min}_{(p,q)-1})\cdot\alpha'_{i-0} \quad (2\text{-}1\text{-}1)$$

$$SG_{2-(p,q)}=c_{21}(\mathrm{Min}_{(p,q)-2})\cdot\alpha'_{i-0} \quad (2\text{-}1\text{-}2)$$

or $$SG_{1-(p,q)}=c_{22}(\mathrm{Min}_{(p,q)-1})^2\cdot\alpha'_{i-0} \quad (2\text{-}2\text{-}1)$$

$$SG_{2-(p,q)}=c_{22}(\mathrm{Min}_{(p,q)-2})^2\cdot\alpha'_{i-0} \quad (2\text{-}2\text{-}2)$$

or $$SG_{1-(p,q)}=c_{23}(\mathrm{Max}_{(p,q)-1})^{1/2}\cdot\alpha'_{i-0} \quad (2\text{-}3\text{-}1)$$

$$SG_{2-(p,q)}=c_{23}(\mathrm{Max}_{(p,q)-2})^{1/2}\cdot\alpha'_{i-0} \quad (2\text{-}3\text{-}2)$$

or $$SG_{1-(p,q)}=c_{24}\{\text{product of either } (\mathrm{Min}_{(p,q)-1}/\mathrm{Max}_{(p,q)-1}) \text{ or } (2^n-1) \text{ and } \alpha'_{i-0}\} \quad (2\text{-}4\text{-}1)$$

$$SG_{2-(p,q)}=c_{24}\{\text{product of either } (\mathrm{Min}_{(p,q)-2}/\mathrm{Max}_{(p,q)-2}) \text{ or } (2^n-1) \text{ and } \alpha'_{i-0}\} \quad (2\text{-}4\text{-}2)$$

or $$SG_{1-(p,q)}=c_{25}[\text{product of either } \{(2^n-1)\cdot\mathrm{Min}_{(p,q)-1}/(\mathrm{Max}_{(p,q)-1}-\mathrm{Min}_{(p,q)-1})\} \text{ or } (2^n-1) \text{ and } \alpha'_{i-0}] \quad (2\text{-}5\text{-}1)$$

$$SG_{2-(p,q)}=c_{25}[\text{product of either } \{(2^n-1)\cdot\mathrm{Min}_{(p,q)-2}/(\mathrm{Max}_{(p,q)-2}-\mathrm{Min}_{(p,q)-2})\} \text{ or } (2^n-1) \text{ and } \alpha'_{i-0}] \quad (2\text{-}5\text{-}2),$$

or $$SG_{1-(p,q)}=c_{26}\{\text{product of smaller value of } (\mathrm{Max}_{(p,q)-1})^{1/2} \text{ and } \mathrm{Min}_{(p,q)-1} \text{ and } \alpha'_{i-0}\} \quad (2\text{-}6\text{-}1)$$

$$SG_{2-(p,q)}=c_{26}\{\text{product of smaller value of } (\mathrm{Max}_{(p,q)-2})^{1/2} \text{ and } \mathrm{Min}_{(p,q)-2} \text{ and } \alpha'_{i-0}\} \quad (2\text{-}6\text{-}2)$$

In the third embodiment of the present disclosure, $\mathrm{Max}_{(p,q)-1}$ and $\mathrm{Min}_{(p,q)-1}$ in the above-described expression may be replaced with $\mathrm{Max}_{(p',q)-1}$ and $\mathrm{Min}_{(p',q)-1}$. In the fourth and fifth embodiments of the present disclosure, $\mathrm{Max}_{(p,q)-1}$ and $\mathrm{Min}_{(p,q)-1}$ in the above-described expression may be replaced with $\mathrm{Max}_{(p,q')}$ and $\mathrm{Min}_{(p,q')}$. The control signal value (third subpixel control signal value) $SG_{3-(p,q)}$ can be obtained by substituting "$SG_{1-(p,q)}$" on the left side of the expressions (2-1-1), (2-2-1), (2-3-1), (2-4-1), (2-5-1), and (2-6-1) with "$SG_{3-(p,q)}$".

In the second to fifth embodiments of the present disclosure, when $C_{21}$, $C_{22}$, $C_{23}$, $C_{24}$, $C_{25}$, and $C_{26}$ are set as constants, a signal value $X_{4-(p,q)}$ can be obtained from the following expression.

$$X_{4-(p,q)}=(C_{21}\cdot SG_{1-(p,q)}+C_{22}\cdot SG_{2-(p,q)})/(C_{21}+C_{22}) \quad (2\text{-}11)$$

or $$X_{4-(p,q)}=C_{23}\cdot SG_{1-(p,q)}+C_{24}\cdot SG_{2-(p,q)} \quad (2\text{-}12)$$

or $$X_{4-(p,q)}=C_{25}(SG_{1-(p,q)}-SG_{2-(p,q)})+C_{26}\cdot SG_{2-(p,q)} \quad (2\text{-}13)$$

or root-mean-square, that is, $$X_{4-(p,q)}=[(SG_{1-(p,q)}^2+SG_{2-(p,q)}^2)/2]^{1/2} \quad (2\text{-}14)$$

In the third embodiment of the present disclosure or the fifth embodiment of the present disclosure, "$X_{4-(p,q)}$" in the expressions (2-11) to (2-14) may be substituted with "$X_{4-(p,q)-2}$".

One of the above-described expressions may be selected depending on the value of $SG_{1-(p,q)}$, one of the above-described expressions may be selected depending on the value of $SG_{2-(p,q)}$, or one of the above-described expressions may be selected depending on the values of $SG_{1-(p,q)}$ and $SG_{2-(p,q)}$. That is, in each pixel group, one of the above-described expressions may be fixedly used to obtain $X_{4-(p,q)}$ and $X_{4-(p,q)-2}$, or in each pixel group, or one of the above-described expressions may be selectively used to obtain $X_{4-(p,q)}$ and $X_{4-(p,q)-2}$.

In the second embodiment of the present disclosure or the third embodiment of the present disclosure, when the number of pixels forming each pixel group is $p_0$, $p_0=2$. However, $p_0$ is not limited to $p_0=2$, $p_0\geq 3$ may be used.

Although in the third embodiment of the present disclosure, an adjacent pixel is adjacent to the (p,q)th second pixel in the first direction, an adjacent pixel may be the (p,q)th first pixel or an adjacent pixel may be a (p+1,q)th first pixel.

In the third embodiment of the present disclosure, a configuration may be made in which first pixels are disposed to be adjacent to each other and second pixels are disposed to be adjacent to each other in the first direction, or a first pixel and a second pixel are disposed to be adjacent to each other in the second direction.

It is desirable that the first pixel has a first subpixel displaying a first primary color, a second subpixel displaying a second primary color, and a third subpixel displaying a third primary color sequentially arranged in the first direction, and the second pixel has a first subpixel displaying a first primary color, a second subpixel displaying a second primary color, and a fourth subpixel displaying a fourth color sequentially arranged in the first direction. That is, it is desirable that the fourth pixel is disposed in the downstream end portion of a pixel group in the first direction.

However, the layout is not limited thereto.

For example, a configuration may be made in which the first pixel has a first subpixel displaying a first primary color, a third subpixel displaying a third primary color, and a second subpixel displaying a second primary color in the first direction, and the second pixel has a first subpixel displaying a first primary color, a fourth subpixel displaying a fourth color, and a second subpixel displaying a second primary color arranged in the first direction.

One of 36 combinations of 6×6 in total may be selected. That is, 6 combinations can be given as the arrangement combinations of (first subpixel, second subpixel, third subpixel) in the first pixel, and 6 combinations can be given as the arrangement combinations of (first subpixel, second subpixel, fourth subpixel) in the second pixel. In general, the shape of a subpixel is a rectangle, but it is desirable to dispose a subpixel such that the long side of the rectangle is parallel to the second direction and the short side of the rectangle is parallel to the first direction.

In the fourth or fifth embodiment of the present disclosure, as an adjacent pixel adjacent to the (p,q)th pixel or an adjacent pixel adjacent to the (p,q)th second pixel, a (p,q−1)th pixel, a (p,q+1)th pixel, or a (p,q−1)th pixel and a (p,q+1)th pixel may be used.

In general, the shape of a subpixel is a rectangle, but it is desirable to dispose a subpixel such that the long side of the rectangle is parallel to the second direction and the short side of the rectangle is parallel to the first direction. However, the layout is not limited thereto.

As to a mode in which multiple pixels or pixel groups where the saturation $S_i$ and the luminosity $V_i(S)$ are to be obtained are used, there may be a mode in which all pixels or pixel groups are used or a mode in which (1/N) of all pixels or pixel groups. Note that "N" is a natural number equal to or greater than 2. As a specific value of N, factorial of 2, such as 2, 4, 8, 16, . . . , may be used. If the former mode is used, it is possible to maintain image quality at a maximum without change in image quality. If the latter mode is used, it is possible to achieve improvement in processing speed and simplification of the circuits of the signal processor.

In the embodiments of the present disclosure including the above-described preferred configuration and mode, a mode in which the fourth color is white may be made. However, a mode is not limited thereto, and the fourth color may be another color, for example, yellow, cyan, or magenta. In these cases, when the image display device is a color liquid crystal display, a configuration may be made in which the following units are further provided:

a first color filter which is disposed between the first subpixel and the image observer to transmit the first primary color, a second color filter which is disposed between the second subpixel and the image observer to transmit the second primary color, and a third color filter which is disposed between the third subpixel and the image observer to transmit the third primary color.

As a light source which forms a planar light source device, a light-emitting element, specifically, a light-emitting diode (LED) may be used. A light-emitting element using a light-emitting diode has small occupied volume, which is suitable for arranging a plurality of light-emitting elements. As a light-emitting diode serving as a light-emitting element, a white light-emitting diode (for example, a light-emitting diode in which an ultraviolet or blue light-emitting diode and a light-emitting particle are combined to emit white) may be used.

As the light-emitting particle, a red light-emitting fluorescent particle, a green light-emitting fluorescent particle, or a blue light-emitting fluorescent particle may be used. Examples of the material for the red light-emitting fluorescent particle include $Y_2O_3$:Eu, $YVO_4$:Eu, $Y(P,V)O_4$:Eu, $_{3.5}MgO\cdot_{0.5}MgF_2.Ge_2$:Mn, $CaSiO_3$:Pb,Mn, $Mg_6AsO_{11}$:Mn, $(Sr,Mg)_3(PO_4)_3$:Sn, $La_2O_2S$:Eu, $Y_2O_2S$:Eu, (ME:Eu)S [where "ME" means at least one kind of atom selected from the group consisting of Ca, Sr, and Ba, and the same applies to the following description], $(M:Sm)_x(Si,Al)_{12}(O,N)_{16}$ [where "M" means at least one kind of atom selected from the group consisting of Li, Mg, and Ca, and the same applies to the following description], $ME_2Si_5N_8$:Eu, (Ca:Eu)$SiN_2$, and (Ca:Eu)$AlSiN_3$. Examples of the material for the green light-emitting fluorescent particle include LaPO4:Ce,Tb, $BaMgAl_{10}O_{17}$:Eu,Mn, $Zn_2SiO_4$:Mn, $MgAl_{11}O_{19}$:Ce,Tb, and $Y_2SiO_5$:Ce,Tb, $MgAl_{11}O_{19}$:CE,Tb,Mn, and further include (ME:Eu)$Ga_2S_4$, $(M:RE)_x(Si,Al)_{12}(O,N)_{16}$ [where "RE" means Tb and Yb], $(M:Tb)_x(Si,Al)_{12}(O,N)_{18}$, and $(M:Yb)_x(Si,Al)_{12}(O,N)_{16}$. Examples of the material for the blue light-emitting fluorescent particle include $BaMgAl_{10}O_{17}$:Eu, $BaMg_2Al_{16}O_{27}$:Eu, $Sr_2P_2O_7$:Eu, $Sr_5(PO_4)_3Cl$:Eu, $(Sr,Ca,Ba,Mg)_5(PO_4)_3Cl$:EU, and $CaWO_4$, $CaWO_4$:Pb. The light-emitting particle is not limited to a fluorescent particle, and for example, with an indirect transition type silicon-based material, a light-emitting particle to which a quantum well structure using a quantum effect, such as a two-dimensional quantum well structure, a one-dimensional quantum well structure (quantum wire), or a zero-dimensional quantum well structure (quantum dots) localizes a carrier wave function so as to efficiently convert a carrier to light like a direct transition type may be used, or it is known that rare-earth atom added to a semiconductor material emits light keenly by interior transition, and a light-emitting particle to which this technique has been applied may be used.

Alternatively, as a light source which forms a planar light source device, a red light-emitting element (for example, light-emitting diode) which emits red (for example, main emission wavelength of 640 nm), a green light-emitting element (for example, GaN-based light-emitting diode) which emits green (for example, main emission wavelength of 530 nm), and a blue light-emitting element (for example, GaN-based light-emitting diode) which emits blue (for example, main emission wavelength of 450 nm) may be used in combination. Light-emitting elements which emit a fourth color, a fifth color, . . . other than red, green, and blue may be further provided.

A light-emitting diode may have a so-called face-up structure or may have a flip-chip structure. That is, a light-emitting diode includes a substrate and a light-emitting layer formed on the substrate, and may have a structure in which light is emitted from the light-emitting layer to the outside or may have a structure in which light from the light-emitting layer is emitted to the outside through the substrate. More specifically, a light-emitting diode (LED) has, for example, a laminate structure in which a first compound semiconductor layer having a first conduction type (for example, n type) formed on the substrate, an active layer formed on the first compound semiconductor layer, and a second compound semiconductor layer having a second conduction type (for example, p type) formed on the active layer, and includes a first electrode electrically connected to the first compound semiconductor layer and a second electrode electrically connected to the second compound semiconductor layer. The layers forming the light-emitting diode may be made of known compound semiconductor materials depending on the emission wavelength.

The planar light source device may be two types of planar light source devices (backlight), that is, a direct-type planar light source device described in JP-UM-A-63-187120 or JP-A-2002-277870 and an edge light-type (also referred to as side light-type) planar light source device described in, for example, JP-A-2002-131552.

The direct-type planar light source device may have a configuration in which the above-described light-emitting elements serving as light sources are disposed and arranged within a housing, but the configuration of the planar light source device is not limited thereto. When a plurality of red light-emitting elements, a plurality of green light-emitting elements, and a plurality of blue light-emitting elements are disposed and arranged in the housing, as the arrangement state of these light-emitting elements, an arrangement can be used in which a plurality of light-emitting element groups each having a red light-emitting element, a green light-emitting element, and a blue light-emitting element are put in a row in the screen horizontal direction of an image display panel (specifically, for example, liquid crystal display) to form a light-emitting element group array, and a plurality of light-emitting element group arrays are arranged in the screen vertical direction of the image display panel. As the light-emitting element group, combinations, such as (one red light-emitting element, one green light-emitting element, one blue light-emitting element), (one red light-emitting element, two green light-emitting elements, one blue light-emitting element), and (two red light-emitting element, two green light-emitting elements, one blue light-emitting element), can be used. The light-emitting element may have, for example, a light extraction lens described in the 128th page of Vol. 889 Dec. 20, 2004, Nikkei Electronics.

When the direct-type planar light source device has a plurality of planar light source units, one planar light source unit may have one light-emitting element group, or a plurality of two or more light-emitting element groups. Alternatively, one planar light source unit may have one white light-emitting diode or a plurality of two or more white light-emitting diodes.

When the direct-type planar light source device has a plurality of planar light source units, a partition wall may be disposed between planar light source units. As a material for the partition wall, specifically, a material, such as acrylic resin, polycarbonate resin, or ABS resin, which is not transparent to light emitted from a light-emitting element in a planar light source unit can be used, and as a material transparent to light emitted from a light-emitting element in a planar light source unit, methyl polymethacrylate resin (PMMA), polycarbonate resin (PC), polyarylate resin (PAR), polyethylene resin (PET), or glass may be used. The surface of the partition wall may have a light diffusion reflection function or may have a specular reflection function. In order to provide the light diffusion reflection function to the surface of the partition wall, protrusions and recessions may be formed in the surface of the partition wall through sandblasting, or a film (light diffusion film) having protrusions and recessions may be attached to the surface of the partition wall. In order to provide the specular reflection function to the surface of the partition wall, a light reflection film may be attached to the surface of the partition wall, or a light reflection layer may be formed on the surface of the partition wall through, for example, electroplating.

The direct-type planar light source device may include an optical function sheet group, such as a light diffusion plate, a light diffusion sheet, a prism sheet, and a polarization conversion sheet, or alight reflection sheet. A widely known material can be used as a light diffusion plate, a light diffusion sheet, a prism sheet, a polarization conversion sheet, and a light reflection sheet. The optical function sheet group may have various sheets separately disposed, or may be a laminated integral sheet. For example, a light diffusion sheet, a prism sheet, a polarization conversion sheet, and the like may be laminated as an integral sheet. Alight diffusion plate or an optical function sheet group is disposed between the planar light source device and the image display panel.

In the edge light-type planar light source device, a light guide plate is disposed to face the image display panel (specifically, for example, liquid crystal display), and a light-emitting element is disposed on the lateral surface (first lateral surface described below) of the light guide plate. The light guide plate has a first surface (bottom surface), a second surface (top surface) facing the first surface, a first lateral surface, a second lateral surface, a third lateral surface facing the first lateral surface, and a fourth lateral surface facing the second lateral surface. A specific shape of the light guide plate may be a wedge-shaped truncated pyramid shape as a whole. In this case, two opposing lateral surfaces of the truncated pyramid correspond to the first surface and the second surface, and the bottom surface of the truncated pyramid corresponds to the first lateral surface. It is desirable that a protruding portion and/or a recessed portion are provided in the surface portion of the first surface (bottom surface). Light is input from the first lateral surface of the light guide plate, and light is emitted from the second surface (top surface) toward the image display panel. The second surface of the light guide plate may be smooth (that is, may be a mirrored surface), or blasted texturing having light diffusion effect may be provided (that is, a minute serrated surface may be provided).

It is desirable that a protruding portion and/or a recessed portion are provided in the first surface (bottom surface) of the light guide plate. That is, it is desirable that a protruding portion, a recessed portion, or a recessed and protruding portion is provided in the first surface of the light guide plate. When the recessed and protruding portion is provided, the recessed portion and the protruding portion may be continuous or discontinuous. A protruding portion and/or a recessed portion provided in the first surface of the light guide plate may be a continuous protruding portion and/or recessed portion extending in a direction at a predetermined angle with respect to the light input direction to the light guide plate. In this configuration, as the cross-sectional shape of a continuous protruding shape or recessed shape of the light guide plate taken using a virtual plane perpendicular to the first surface in the light input direction to the light guide plate, a triangle; an arbitrary quadrangle including a square, a rectangle, and a trapezoid; an arbitrary polygon; and an arbitrary smooth curve including a circle, an ellipse, a parabola, a hyperbola, a catenary, and the like may be used. The direction at a predetermined angle with respect to the light input direction to the light guide plate is means the direction of 60 degrees to 120 degrees when the light input direction to the light guide plate is 0 degree. The same applies to the following description. Alternatively, the protruding portion and/or the recessed portion provided in the first surface of the light guide plate may be a discontinuous protruding portion and/or recessed portion extending in a direction at a predetermined angle with respect to the light input direction to the light guide plate. In this configuration, as the shape of a discontinuous protruding shape or recessed shape, various types of smooth curved surfaces, such as a polygonal column including a pyramid, a cone, a cylinder, a triangular prism, and a quadrangular prism, part of a sphere, part of a spheroid, part of a rotation paraboloid, and part of a rotating hyperboloid may be used. In the light guide plate, neither a protruding portion nor a recessed portion may be formed in the edge portion of the first surface. While light which is emitted from a light source and input to the light guide plate collides against the protruding portion or recessed portion formed in the first surface of the light guide plate and scattered, the height, depth, pitch, and shape of the protruding portion or recessed portion provided in the first surface of the light guide plate may be set fixedly, or may be changed as the distance from the light source increases. In the latter case, for example, the pitch of the protruding portion or recessed portion may be set finely as the distance from the light source increases. The pitch of the protruding portion or the pitch of the recessed portion means the pitch of the protruding portion or the pitch of the recessed portion in the light input direction to the light guide plate.

In the planar light source device including the light guide plate, it is desirable that a light reflection member is disposed to face the first surface of the light guide plate. The image display panel (specifically, for example, liquid crystal display) is disposed to face the second surface of the light guide plate. Light emitted from the light source is input to the light guide plate from the first lateral surface (for example, the surface corresponding to the bottom surface of the truncated pyramid) of the light guide plate, collides against the protruding portion or recessed portion of the first surface, is scattered, is emitted from the first surface, is reflected by the light reflection member, is input to the first surface again, is emitted from the second surface, and irradiates the image display panel. For example, a light diffusion sheet or a prism sheet may be disposed between the image display panel and the second surface of the light guide plate. Light emitted from the light source may be guided directly to the light guide plate, or may be guided indirectly to the light guide plate. In the latter case, for example, an optical fiber may be used.

It is desirable that the light guide plate is made of a material which seldom absorbs light emitted from the light source. Specifically, examples of the material for the light guide plate include, for example, glass and a plastic material (for example, PMMA, polycarbonate resin, acrylic resin, amorphous polypropylene resin, styrene resin including AS resin).

In the embodiments of the present disclosure, the driving method and driving conditions of the planar light source device are not particularly limited, and the light source may be collectively controlled. That is, for example, a plurality of light-emitting elements may be driven simultaneously. Alternatively, a plurality of light-emitting elements may be driven partially (dividedly driven). That is, when the planar light source device has a plurality of planar light source units, assuming that the display region of the image display panel is divided into S×T virtual display region units, a configuration may be made in which the planar light source device has S×T planar light source units corresponding to S×T display region units, and the emission states of the S×T planar light source units are controlled individually.

A driving circuit for driving the planar light source device and the image display panel includes, for example, a planar light source device control circuit having a light-emitting diode (LED) driving circuit, an arithmetic circuit, a storage device (memory), and the like, and an image display panel driving circuit having known circuits. A temperature control circuit may be included in the planar light source device control circuit. The luminance (display luminance) of a display region portion and the luminance (light source luminance) of the planar light source unit are controlled in each image display frame. Note that the number (images per second) of pieces of image information to be transmitted to the driving circuit for one second as an electrical signal is a frame frequency (frame rate), and the reciprocal of the frame frequency is frame time (unit: second).

A transmissive liquid crystal display includes, for example, a front panel having a transparent first electrode, a rear panel having a transparent second electrode, and a liquid crystal material disposed between the front panel and the rear panel.

More specifically, the front panel includes, for example, a first substrate made of a glass substrate or a silicon substrate, a transparent first electrode (also referred to as common electrode and made of, for example, ITO) provided on the inner surface of the first substrate), and a polarization film provided on the outer surface of the first substrate. In a transmissive color liquid crystal display, a color filter coated with an overcoat layer made of acrylic resin or epoxy resin is provided on the inner surface of the first substrate. The front panel has a configuration in which the transparent first electrode is formed on the overcoat layer. An alignment film is formed on the transparent first electrode. More specifically, the rear panel includes, for example, a second substrate made of a glass substrate or a silicon substrate, a switching element formed on the inner surface of the second substrate, a transparent second electrode (also referred to as pixel electrode and made of, for example, ITO) where conduction/non-conduction is controlled by the switching element, and a polarization film provided on the outer surface of the second substrate. An alignment film is formed on the entire surface including the transparent second electrode. Various members and a liquid crystal material which form a liquid crystal display including the transmissive color liquid crystal display may be known members and materials. As the switching element, a three-terminal element, such as a MOS-FET or thin film transistor (TFT) formed on a monocrystalline silicon semiconductor substrate and a two-terminal element, such as an MIM element, a varistor element, or a diode, may be used. Examples of an arrangement pattern of the color filters include an arrangement similar to a delta arrangement, an arrangement similar to a stripe arrangement, an arrangement similar to a diagonal arrangement, and an arrangement similar to a rectangle arrangement.

When the number $P_0 \times Q_0$ of pixels arranged in a two-dimensional matrix is represented with $(P_0,Q_0)$, specifically, as the value of $(P_0,Q_0)$, several display resolutions for image display, such as VGA(640,480), S-VGA(800,600), XGA (1024,768), APRC(1152,900), S-XGA(1280,1024), U-XGA (1600,1200), HD-TV(1920,1080), Q-XGA(2048,1536), (1920,1035), (720,480), and (1280,960), may be used, but the value of $(P_0,Q_0)$ is not limited to these values. The relationship between the value of $(P_0,Q_0)$ and the value of (S,T) can be shown in Table 1, but the relationship is not limited thereto. The number of pixels forming one display region unit can be 20×20 to 320×240, and preferably, 50×50 to 200×200. The number of pixels in a display region unit may be constant or may differ.

TABLE 1

| | Value of S | Value of T |
|---|---|---|
| VGA (640, 840) | 2-32 | 2-24 |
| S-VGA (800, 600) | 3-40 | 2-30 |
| XGA (1024, 768) | 4-50 | 3-39 |
| APRC (1152, 900) | 4-58 | 3-45 |
| S-XGA (1280, 1024) | 4-64 | 4-51 |
| U-XGA (1600, 1200) | 6-80 | 4-60 |
| HD-TV (1920, 1080) | 6-86 | 4-54 |
| Q-XGA (2048, 1536) | 7-102 | 5-77 |
| (1920, 1035) | 7-64 | 4-52 |
| (720, 480) | 3-34 | 2-24 |
| (1280, 960) | 4-64 | 3-48 |

Examples of the arrangement state of subpixels include an arrangement similar to a delta arrangement (triangle arrangement), an arrangement similar to a stripe arrangement, an arrangement similar to a diagonal arrangement (mosaic arrangement), and an arrangement similar to a rectangle arrangement. In general, an arrangement similar to a stripe arrangement is suitable for displaying data or a character string in a personal computer or the like. Meanwhile, an arrangement similar to a mosaic arrangement is suitable for displaying a natural image in a video camera recorder, a digital still camera, or the like.

In the method of driving an image display device according to the embodiments of the present disclosure, as the image display device, a direct-view-type or projection-type color display image display device, and a color display image display device (direct-view-type or projection-type) of a field sequence system can be used. The number of light-emitting elements forming the image display device may be determined on the basis of the specification necessary for the image display device. A configuration may be made in which a light valve is further provided on the basis of the specification necessary for the image display device.

The image display device is not limited to the color liquid crystal display, and an organic electroluminescence display device (organic EL display device), an inorganic electroluminescence display device (inorganic EL display device), a cold cathode field electron emission display device (FED), a surface conduction-type electron emission display device (SED), a plasma display device (PDP), a diffraction grating-light modulation device having a diffraction grating-optical modulator (GLV), a digital micromirror device (DMD), a CRT, and the like can be used. The color liquid crystal display is not limited to the transmissive liquid crystal display, and a reflective liquid crystal display or a semi-transmissive liquid crystal display may be used.

Example 1

Example 1 relates to a method of driving an image display device according to the first embodiment of the present disclosure.

Figure 2A:
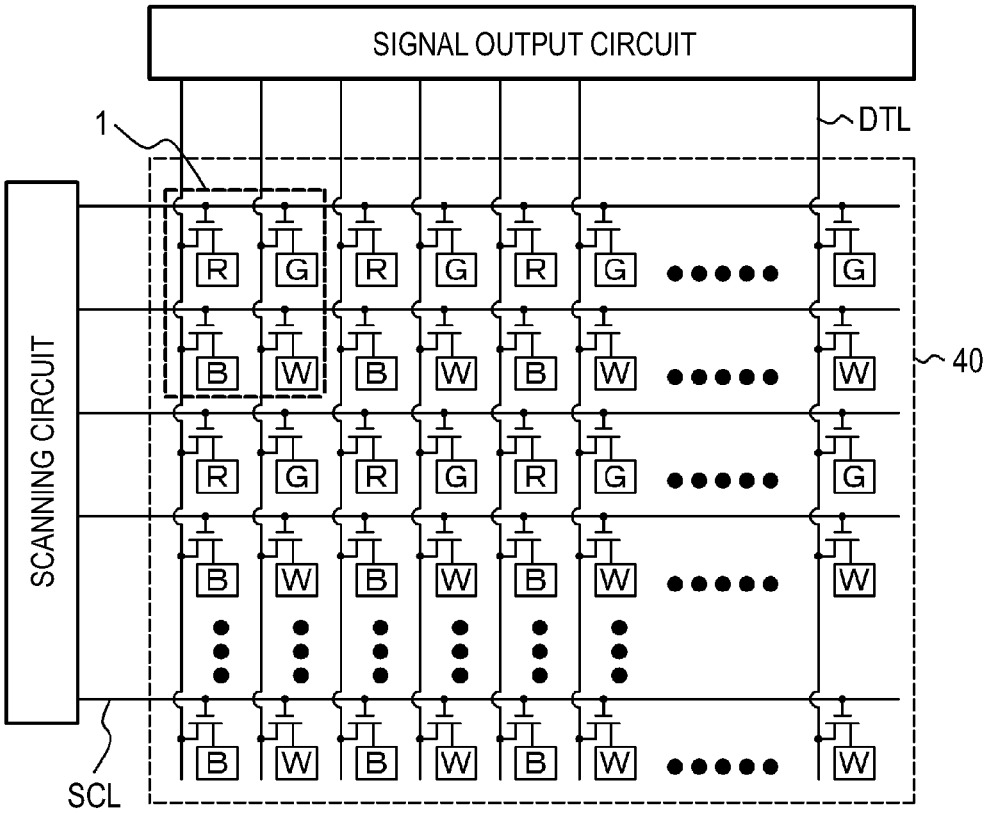
FIGS. 2A and 2B are conceptual diagrams of an image display panel and an image display panel driving circuit in the image display device of Example 1.
Figure 2B:
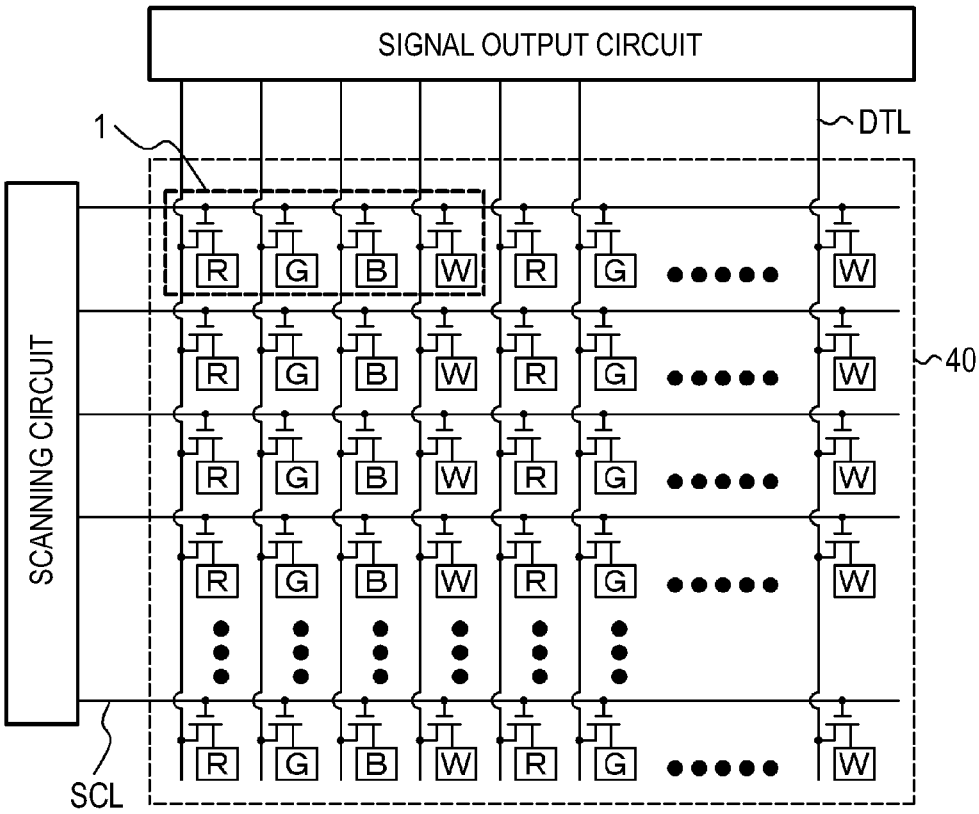
Figure 3:
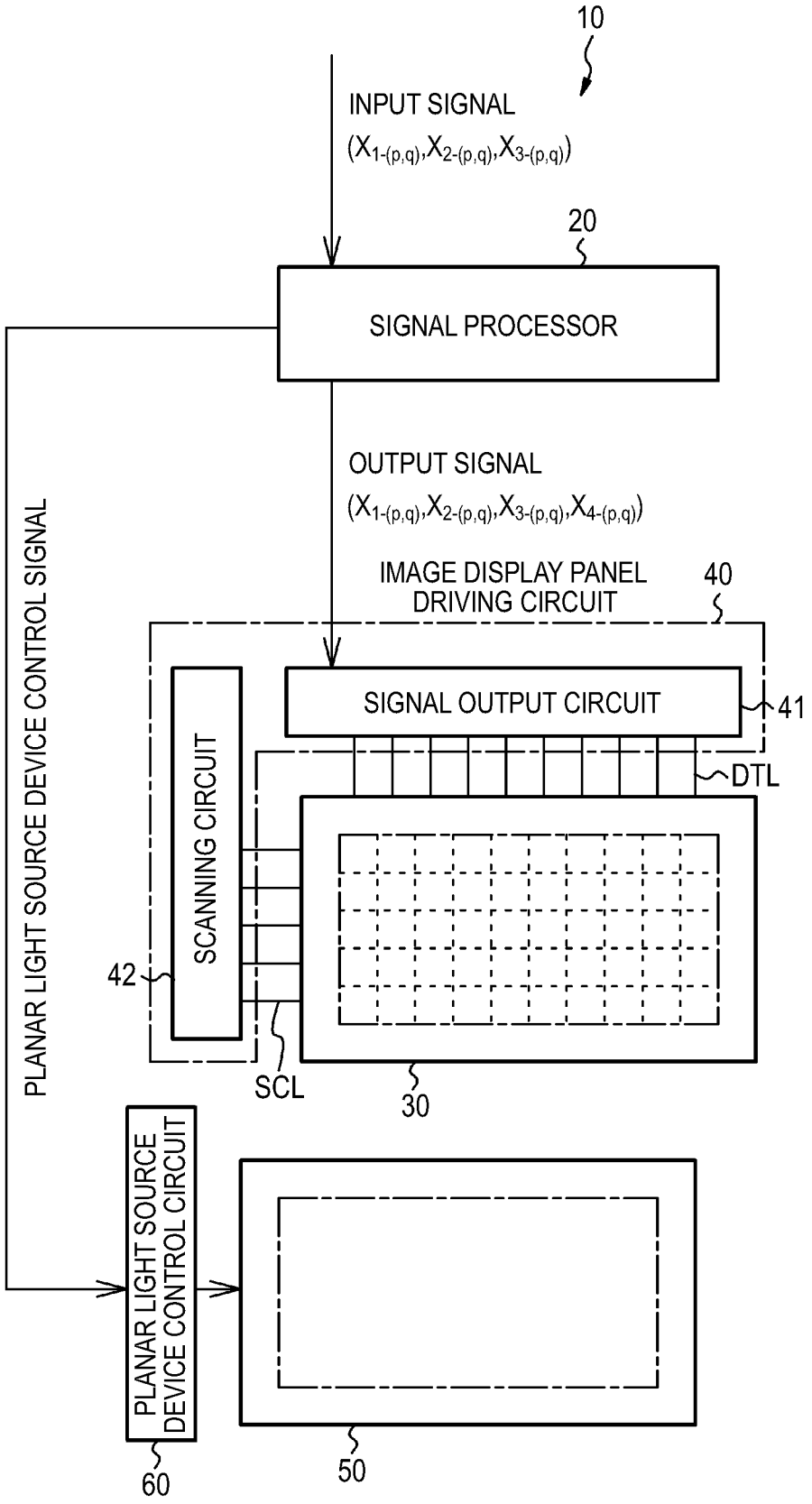
FIG. 3 is a conceptual diagram of the image display device of Example 1.

As shown in a conceptual diagram of FIG. 3, an image display device 10 of Example 1 includes an image display panel 30 and a signal processor 20. The image display device of Example 1 further includes a planar light source device 50 which illuminates the image display device (specifically, the image display panel 30) from the rear. As shown in conceptual diagrams of FIGS. 2A and 2B, the image display panel 30 has a configuration in which $P_0 \times Q_0$ ($P_0$ in the horizontal direction and $Q_0$ in the vertical direction) pixels each having a first subpixel (indicated by "R") displaying a first primary color (for example, red, and the same applies to various examples described below), a second subpixel (indicated by "G") displaying a second primary color (for example, green, and the same applies to various examples described below), a third subpixel (indicated by "B") displaying a third primary color (for example, blue, and the same applies to various examples described below), and a fourth subpixel (indicated by "W") displaying a fourth color (specifically white, and the same applies to various examples described below) are arranged in a two-dimensional matrix.

More specifically, the image display device of Example 1 is a transmissive color liquid crystal display, the image display panel 30 is a color liquid crystal display panel and further includes a first color filter disposed between a first subpixel R and an image observer to transmit a first primary color, a second color filter disposed between a second subpixel G and the image observer to transmit a second primary color, and a third color filter disposed between a third subpixel B and the image observer to transmit a third primary color. In a fourth subpixel W, no color filter is provided. In the fourth subpixel W, a transparent resin layer may be provided instead of a color filter. If no color filter is provided, it is possible to prevent a great step from occurring in the fourth subpixel W. The same can apply to various examples described below.

According to Example 1, in the example shown in FIG. 2A, the first subpixels R, second subpixels G, third subpixels B, and fourth subpixels W are arranged with an arrangement similar to a diagonal arrangement (mosaic arrangement). In the example shown in FIG. 2B, the first subpixels R, second subpixels G, third subpixels B, and fourth subpixels W are arranged with an arrangement similar to a stripe arrangement.

In Example 1, the signal processor 20 includes an image display panel driving circuit 40 which drives the image display panel (more specifically, color liquid crystal display panel), and a planar light source device control circuit 60 which drives the planar light source device 50. The image display panel driving circuit 40 includes a signal output circuit 41 and a scanning circuit 42. A switching element (for example, TFT) for controlling the operation (transmittance) of a subpixels in the image display panel 30 is controlled to be turned on/off by the scanning circuit 42. Video signals are held by the signal output circuit 41 and then sequentially output to the image display panel 30. The signal output circuit 41 and the image display panel 30 are electrically connected together by wiring DTL, and the scanning circuit 42 and the image display panel 30 are electrically connected together by wiring SCL. The same can apply to various examples described below.

In the signal processor 20 of Example 1, in regard to a (p,q)th pixel (where $1 \le p \le P_0$ and $1 \le q \le Q_0$), a first subpixel input signal having a signal value $x_{1-(p,q)}$, a second subpixel input signal having a signal value $x_{2-(p,q)}$, and a third subpixel input signal having a signal value $x_{3-(p,q)}$ are input thereto.

The signal processor 20 outputs a first subpixel output signal having a signal value $X_{1-(p,q)}$ for determining the display gradation of the first subpixel R, a second subpixel output signal having a signal value $X_{2-(p,q)}$ for determining the display gradation of the second subpixel G, a third subpixel output signal having a signal value $X_{3-(p,q)}$ for determining the display gradation of the third subpixel B, and a fourth subpixel output signal having a signal value $X_{4-(p,q)}$ for determining the display gradation of the fourth subpixel W.

In Example 1 or various examples described below, the maximum value $V_{max}(S)$ of luminosity with the saturation S in the HSV color space enlarged by adding the fourth color (white) as a variable is obtained in the signal processor 20 or stored in the signal processor 20. That is, with the addition of the fourth color (white), the dynamic range of luminosity in the HSV color space is widened.

In an i-th image display frame, in the signal processor 20 of Example 1, a first subpixel output signal (signal value $X_{1-(p,q)}$) is obtained on the basis of at least a first subpixel input signal (signal value $x_{1-(p,q)}$) and a corrected expansion coefficient $\alpha'_{i-0}$, and output to the first subpixel R, a second subpixel output signal (signal value $X_{2-(p,q)}$) is obtained on the basis of at least a second subpixel input signal (signal value $x_{2-(p,q)}$) and the corrected expansion coefficient $\alpha'_{i-0}$, and output to the second subpixel G, a third subpixel output signal (signal value $X_{3-(p,q)}$) is obtained on the basis of at least a third subpixel input signal (signal value $x_{3-(p,q)}$) and the corrected expansion coefficient $\alpha'_{i-0}$, and output to the third subpixel B, and a fourth subpixel output signal (signal value $X_{4-(p,q)}$) is obtained on the basis of a first subpixel input signal (signal value $x_{1-(p,q)}$ a second subpixel input signal (signal value $x_{2-(p,q)}$), and a third subpixel input signal (signal value $x_{3-(p,q)}$), and output to the fourth subpixel W.

Specifically, in Example 1, the first subpixel output signal is obtained on the basis of at least the first subpixel input signal, the corrected expansion coefficient $\alpha'_{i-0}$, and the fourth subpixel output signal, the second subpixel output signal is obtained on the basis of at least the second subpixel input signal, the corrected expansion coefficient $\alpha'_{i-0}$, and the fourth subpixel output signal, and the third subpixel output signal is obtained on the basis of at least the third subpixel input signal, the corrected expansion coefficient $\alpha'_{i-0}$, and the fourth subpixel output signal.

That is, when $\chi$ is set as a constant depending on the image display device, in the signal processor 20, the first subpixel output signal value $X_{1-(p,q)}$, the second subpixel output signal value $X_{2-(p,q)}$, and the third subpixel output signal value $X_{3-(p,q)}$ to the (p,q)th pixel (or a set of a first subpixel R, second subpixel G, and a third subpixel B) can be obtained from the following expressions.

$$X_{1-(p,q)}=\alpha'_{i-0}\cdot x_{1-(p,q)}-\chi\cdot X_{4-(p,q)} \quad (1\text{-A})$$

$$X_{2-(p,q)}=\alpha'_{i-0}\cdot x_{2-(p,q)}-\chi\cdot X_{4-(p,q)} \quad (1\text{-B})$$

$$X_{2-(p,q)}=\alpha'_{i-0}\cdot x_{2-(p,q)}-\chi\cdot X_{4-(p,q)} \quad (1\text{-C})$$

In the i-th image display frame, in the signal processor 20, (a) saturation $S_i$ and luminosity $V_i(S)$ in a plurality of pixels are obtained on the basis of subpixel input signal values in the plurality of pixels, (b) an expansion coefficient $\alpha_{i-0}$ is obtained on the basis of at least one of the values of $V_{max}(S)/V_i(S)$ obtained in the plurality of pixels, and (c) the corrected expansion coefficient $\alpha'_{i-0}$ is determined on the basis of a corrected expansion coefficient $\alpha'_{(i-j)-0}$ applied in advance in an (i−j)th image display frame (where j is a positive integer equal to or greater than 1, and in Example 1, j=1) and the expansion coefficient $\alpha_{i-0}$ obtained in the i-th image display frame.

Here, saturation S and luminosity V(S) are represented as follows.

$$S=(\text{Max}-\text{Min})/\text{Max}$$

$$V(S)=\text{Max}$$

The saturation S can have a value from 0 to 1, the luminosity V(S) can have a value from 0 to $(2^n-1)$, and n is the number of display gradation bits.

Max: a maximum value among three subpixels input signal values including a first subpixel input signal value, a second subpixel input signal value, and a third subpixel input signal value to the pixel Min: a minimum value among three subpixel input signal values including a first subpixel input signal value, a second subpixel input signal value, and a third subpixel input signal value to the pixel The same applies to the following description.

In Example 1, the signal value $X_{4-(p,q)}$ can be obtained on the basis of the product of $\text{Min}_{(p,q)}$ and the corrected expansion coefficient $\alpha'_{i-0}$. Specifically, the signal value $X_{4-(p,q)}$ can be obtained from Expression (1-1), and more specifically, can be obtained from the following expression.

$$X_{4-(p,q)}=\text{Min}_{(p,q)}\cdot\alpha'_{i-0}/\chi \quad (11)$$

Although in Expression (11), the product of $\text{Min}_{(p,q)}$ and the corrected expansion coefficient $\alpha'_{i-0}$ is divided by $\chi$, calculation is not limited thereto.

Hereinafter, these points will be described.

Figure 4A:
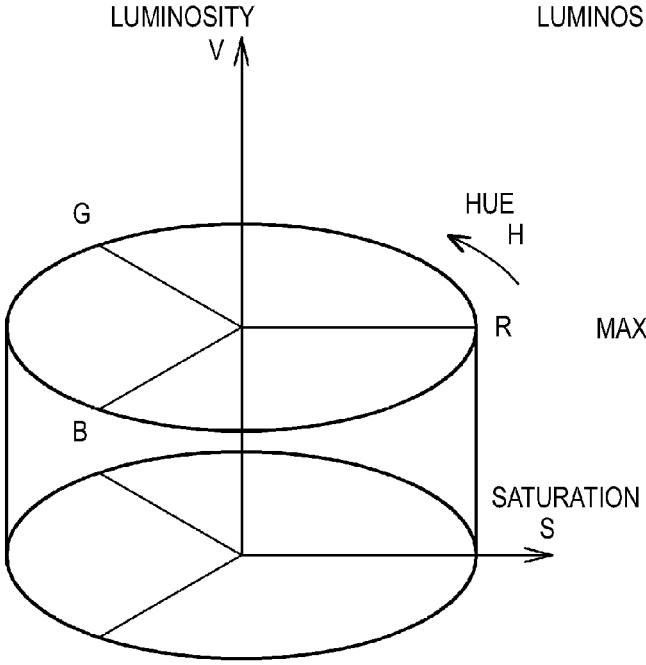
FIGS. 4A and 4B are respectively a conceptual diagram of a general columnar HSV color space and a diagram schematically showing the relationship between saturation S and luminosity V(S)
Figure 4B:
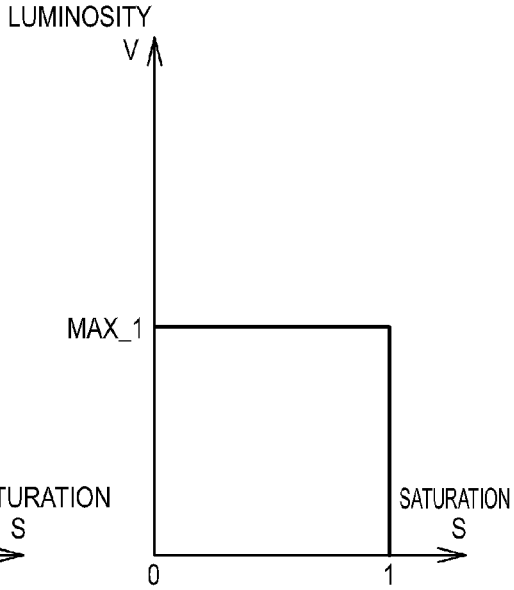

In general, in the (p,q)th pixel, the saturation $S_{(p,q)}$ and the luminosity (Brightness) $V(S)_{(p,q)}$ in the columnar HSV color space can be obtained from Expressions (12-1) and (12-2) on the basis of the first subpixel input signal (signal value $x_{1-(p,q)}$), the second subpixel input signal (signal value $x_{2-(p,q)}$), and the third subpixel input signal (signal value $x_{3-(p,q)}$). FIG. 4A is a conceptual diagram of a columnar HSV color space, and FIG. 4B schematically shows the relationship between the saturation S and the luminosity V(S). In FIG. 4B and FIGS. 4D, 5A, 5B described below, the value of luminosity $(2^n-1)$ is represented with "MAX_1", and the value of luminosity $(2^n-1)\times(\chi+1)$ is represented with "MAX_2".

$$S_{(p,q)}=(\text{Max}_{(p,q)}-\text{Min}_{(p,q)})/\text{Max}_{(p,q)} \quad (12\text{-}1)$$

$$V(S)_{(p,q)}=\text{Max}_{(p,q)} \quad (12\text{-}2)$$

Note that $\text{Max}_{(p,q)}$ is the maximum value among three subpixel input signal values of $(x_{1-(p,q)}, x_{2-(p,q)}, x_{3-(p,q)})$, and $\text{Min}_{(p,q)}$ is the minimum value among three subpixel input signal values of $(x_{1-(p,q)}, x_{2-(p,q)}, x_{3-(p,q)})$. In Example 1, n is set to n=8. That is, the number of display gradation bits is set to 8 bits (the value of the display gradation is specifically set to 0 to 255). The same applies to the following examples.

Figure 4C:
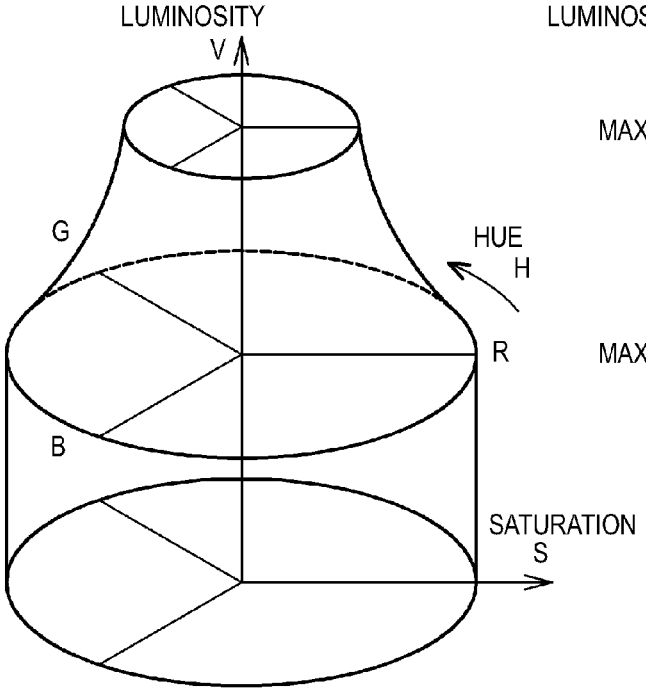
FIGS. 4C and 4D are respectively a conceptual diagram of an enlarged columnar HSV color space in Example 1 and a diagram schematically showing the relationship between saturation S and luminosity V(S).
Figure 4D:
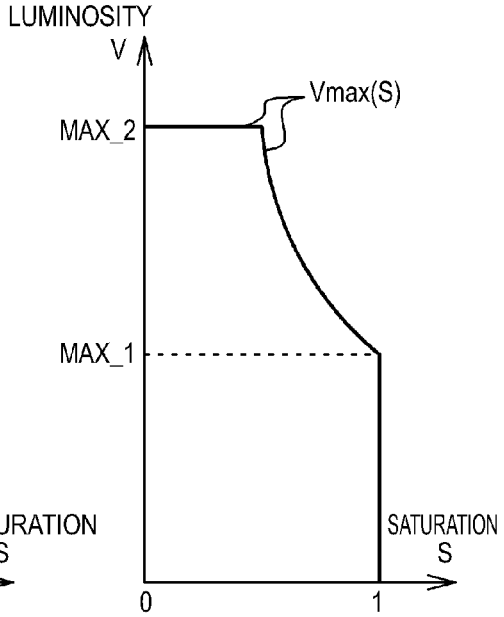

FIGS. 4C and 4D are a conceptual diagram of a columnar HSV color space enlarged by adding a fourth color (white) in Example 1 and schematically shows the relationship between saturation S and luminosity V(S). In the fourth subpixel W displaying white, no color filter is disposed. It is assumed that the luminance of a group of a first subpixel R, a second subpixel G, and a third subpixel B forming a pixel (Examples 1 to 3, and 9) or a pixel group (Examples 4 to 8, and 10) when a signal having a value corresponding to the maximum signal value of a first subpixel output signal is input to a first subpixel R, a signal having a value corresponding to the maximum signal value of a second subpixel output signal is input to a second subpixel G, and a signal having a value corresponding to the maximum signal value of a third subpixel output signal is input to a third subpixel B is $BN_{1-3}$, and the luminance of a fourth subpixel W when a signal having a value corresponding to the maximum signal value of a fourth subpixel output signal is input to a fourth subpixel W forming a pixel (Examples 1 to 3, and 9) or a pixel group (Examples 4 to 8, and 10) is $BN_4$. That is, white having the maximum luminance is displayed by the group of the first subpixel R, the second subpixel G, and the third subpixel B, and the luminance of concerned white is represented with $BN_{1-3}$. Accordingly, when $\chi$ is set as a constant depending on the image display device, the constant $\chi$ is represented by the following expression.

$$\chi=BN_4/BN_{1-3}$$

Specifically, the luminance $BN_4$ when it is assumed that an input signal having a display gradation value of 255 is input to the fourth subpixel W is, for example, 1.5 times greater than the luminance $BN_{1-3}$ of white when input signals having the following display gradation values are input to the group of the first subpixel R, the second subpixel G, and the third subpixel B.

$$x_{1-(p,q)}=255$$

$$x_{2-(p,q)}=255$$

$$x_{3-(p,q)}=255$$

That is, in Example 1, $$\chi=1.5.$$

When the signal value $X_{4-(p,q)}$ is given by Expression (11), $V_{max}(S)$ can be represented by the following expression.

When $S\leq S_0$:

$$V_{max}(S)=(\chi+1)\cdot(2^n-1) \quad (13\text{-}1)$$

When $S_0<S_0\leq 1$:

$$V_{max}(S)=(2^n-1)\cdot(1/S) \quad (13\text{-}2)$$

Here, $$S_0=1/(\chi+1)$$

The maximum value $V_{max}(S)$ of luminosity with the saturation S in the HSV color space enlarged by adding the fourth color obtained in the above-described manner as a variable is stored in the signal processor 20, for example, as a kind of look-up table or obtained in the signal processor 20 every time.

Hereinafter, how to obtain the output signal values $X_{1-(p,q)}$, $X_{2-(p,q)}$, $X_{3-(p,q)}$, and $X_{4-(p,q)}$ in the (p,q)th pixel for the i-th image display frame (expansion process) will be described with reference to FIG. 1 which is a diagram showing a flow for obtaining a corrected expansion coefficient in the image display device of Example 1. Since description will be provided for the i-th image display frame, the subscript "i" should be normally attached to various symbols; however, in order to avoid complexity, in some cases, the subscript "i" is omitted. The following process will be performed so as to maintain the ratio of the luminance of the first primary color displayed by (the first subpixel R+the fourth subpixel W), the luminance of the second primary color displayed by (the second subpixel G+the fourth subpixel W), and the luminance of the third primary color displayed by (the third subpixel B+the fourth subpixel W). The following process will be performs so as to keep (maintain) color tone. The following process will be performed so as to keep (maintain) gradation-luminance characteristic (gamma characteristic, γ characteristic).

When all the input signal values are "0" (or small) in one of pixels or pixel groups, it should suffice that the corrected expansion coefficient $\alpha'_{i-0}$ is obtained without including this pixel or pixel group. The same applies to the following examples.

[Step-100]

First, in the signal processor 20, the saturation $S_i$ and the luminosity $V_i(S)$ in a plurality of pixels are obtained on the basis of the subpixel input signal values in a plurality of pixels. Specifically, $S_{i-(p,q)}$ and $V(S)_{i-(p,q)}$ are obtained from Expressions (12-1) and (12-2) on the basis of the first subpixel input signal value the second subpixel input signal value $x_{2-(p,q)}$, and the third subpixel input signal value $x_{3-(p,q)}$ to the (p,q)th pixel. This process will be performed for all pixels.

[Step-110]

Next, in the signal processor 20, the expansion coefficient $\alpha_{i-0}$ is obtained on the basis of at least one of the values of $V_{max}(S)/V_i(S)$ obtained in a plurality of pixels.

Specifically, the smallest value (minimum value, $\alpha_{min}$) among the values of $V_{max}(S)/V_i(S)$ obtained in all pixels is obtained as the expansion coefficient $\alpha_{i-0}$. That is, the value of $\alpha_{i-(p,q)}=V_{max}(S)/V_{i-(p,q)}(S)$ is obtained in all pixels, and the minimum value of $\alpha_{i-(p,q)}$ is set as $\alpha_{i-min}$ (=expansion coefficient $\alpha_{i-0}$).

$$\alpha_{i-0}=[\text{the smallest value among the values of } V_{max}(S)/V_i(S)] \quad (14)$$

Figure 5A:
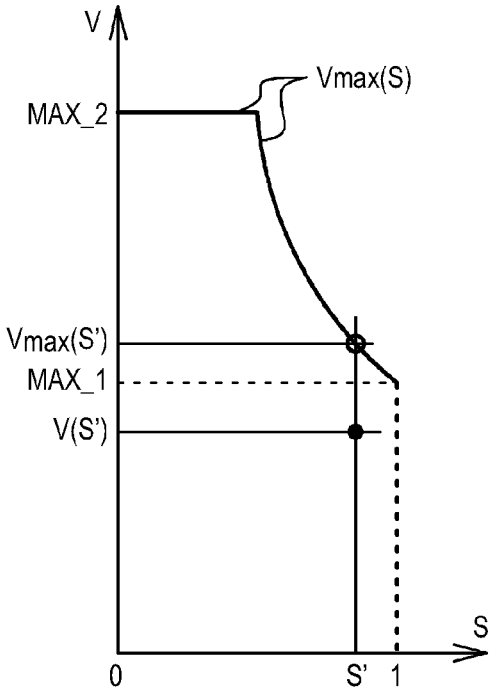
FIGS. 5A and 5B are diagrams schematically showing the relationship between saturation S and luminosity V(S) in a columnar HSV color space enlarged by adding a fourth color (white) in Example 1.
Figure 5B:
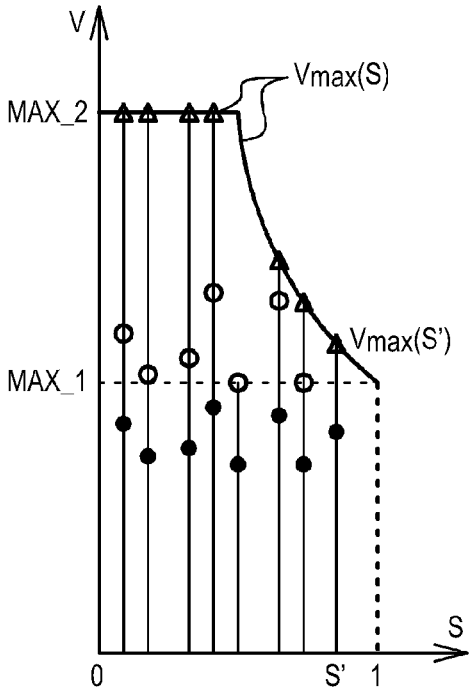

In FIGS. 5A and 5B which schematically show the relationship between the saturation S and the luminosity V(S) in the columnar HSV color space enlarged by adding the fourth color (white), the value of the saturation S which provides $\alpha_0$ is represented with "S'", the luminosity V(S) at the saturation S' is represented with "V(S')", and $V_{max}(S)$ is represented with "$V_{max}(S')$". In FIG. 5B, V(S) is indicated by a black round mark, $V(S)\times\alpha_0$ is indicated by a white round mark, and $V_{max}(S)$ at the saturation S is indicated by a white triangular mark.

[Step-120]

Next, the corrected expansion coefficient $\alpha'_{i-0}$ is determined on the basis of the corrected expansion coefficient $\alpha'_{(i-j)-0}$ applied in advance in the (i−j)th image display frame (where j=1) and the expansion coefficient $\alpha_{i-0}$ obtained in the i-th image display frame.

Specifically, the corrected expansion coefficient $\alpha'_{i-0}$ is determined on the basis of correction constants $\Delta_1$, $\Delta_2$, $\Delta_3$, and $\Delta_4$, the corrected expansion coefficient $\alpha'_{(i-j)-0}$ applied in advance in the (i−j)th image display frame, and the expansion coefficient $\alpha_{i-0}$ obtained in the i-th image display frame. Here, $\Delta_1>\Delta_2>0$ and $\Delta_4>\Delta_3>0$. It is assumed that a first predetermined value is $\epsilon_1$, a second predetermined value is $\epsilon_2$, a third predetermined value is $\epsilon_3$, a fourth predetermined value is $\epsilon_4$, $\epsilon_1<\epsilon_2<0$, and $\epsilon_4>\epsilon_3>0$. Specifically, since the number of display gradation bits is 8 bits, the values are set as follows.

first predetermined value $\epsilon_1=-(16/256)$ second predetermined value $\epsilon_2=-(8/256)$ third predetermined value $\epsilon_3=(8/256)$ fourth predetermined value $\epsilon_4=(16/256)$ $\Delta_1=\Delta_4$ $\Delta_2=\Delta_3$ However, the values are not limited thereto.

Specifically, the value of $(1/\delta_i)=(1/\alpha_{i-0})-(1/\alpha'_{(i-j)-0})$ is obtained.

When the value of $(1/\delta_i)$ is smaller than the first predetermined value $\epsilon_1$, that is, $$(1/\delta_i)<\epsilon_1$$

the corrected expansion coefficient $\alpha'_{i-0}$ is obtained from the following expression.

$$(1/\alpha'_{i-0})=(1/\alpha'_{(i-j)-0})-\Delta_1$$

Here, $$\Delta_1=|(1/\delta_i)|-\epsilon_2$$

The expression is not limited thereto. The above expression is modified to the following expression.

$$(1/\alpha'_{i-0})=(1/\alpha_{i-0})+\epsilon_2$$

Alternatively, the corrected expansion coefficient $\alpha'_{i-0}$ may be obtained from the following expression.

$$(1/\alpha'_{i-0})=(1/\alpha'_{(i-j)-0})-1$$

When $(1/\delta_i)$ is equal to or greater than the first predetermined value $\epsilon_1$ and smaller than the second predetermined value $\epsilon_2$, that is, $$\epsilon_i\leq(1/\delta_i)<\epsilon_2$$

the corrected expansion coefficient $\alpha'_{i-0}$ is obtained from the following expression.

$$(1/\alpha_{i-0})=(1/\alpha'_{(i-j)-0})-\Delta_2$$

Here, $$\Delta_2=|(1/\delta_i)|/2$$

The expression is not limited thereto. The above expression is modified to the following expression.

$$(1/\alpha'_{i-0})=\{(1/\alpha_{i-0})+(1/\alpha'_{(i-j)-0}\}/2$$

Alternatively, the corrected expansion coefficient $\alpha'_{i-0}$ may be obtained from the following expression.

$$(1/\alpha'_{i-0})=(1/\alpha'_{(i-j)-0})-1$$

When $(1/\delta_i)$ is equal to or greater than the second predetermined value $\epsilon_2$ and smaller than the third predetermined value $\epsilon_3$, that is, $$\epsilon_2 \leq (1/\delta_i) < \epsilon_3$$

the corrected expansion coefficient $\alpha'_{i-0}$ is obtained from the following expression.

$$(1/\alpha'_{i-0}) = (1/\alpha'_{(i-j)-0})$$

When $(1/\delta_i)$ is equal to or greater than the third predetermined value $\epsilon_3$ and smaller than the fourth predetermined value $\epsilon_4$, that is, $$\epsilon_3 \leq (1/\delta_i) < \epsilon_4$$

the corrected expansion coefficient $\alpha'_{i-0}$ is obtained from the following expression.

$$(1/\alpha'_{i-0}) = (1/\alpha'_{(i-j)-0}) + \Delta_3$$

The above expression is modified to the following expression.

$$(1/\alpha'_{i-0}) = \{(1/\alpha_{i-0}) + (1/\alpha'_{(i-j)-0})\}/2$$

When the value of $(1/\delta_i)$ is equal to or greater than the fourth predetermined value $\epsilon_4$, that is, $$\epsilon_4 \leq (1/\delta_i)$$

the corrected expansion coefficient $\alpha'_{i-0}$ is obtained from the following expression.

$$(1/\alpha_{i-0}) = (1/\alpha'_{(i-j)-0}) + \Delta_4$$

The above expression is modified to the following expression.

$$(1/\alpha'_{i-0}) = (1/\alpha_{i-0}) - \epsilon_2$$

The above-described way how to obtain the corrected expansion coefficient $\alpha'_{i-0}$ is for illustration and can be of course appropriately changed.

[Step-130]

Next, in the signal processor 20, the signal value $X_{4-(p,q)}$ in the (p,q)th pixel is obtained on the basis of at least the signal value $x_{1-(p,q)}$, the signal value $x_{2-(p,q)}$, and the signal value $x_{3-(p,q)}$. Specifically, in Example 1, the signal value $X_{4-(p,q)}$ is determined on the basis of $Min_{(p,q)}$, the corrected expansion coefficient $\alpha'_{i-0}$, and the constant $\chi$. More specifically, in Example 1, as described above, the signal value $X_{4-(p,q)}$ is obtained from the following expression.

$$X_{4-(p,q)} = Min_{(p,q)} \cdot \alpha'_{i-0} / \chi \quad (11)$$

$X_{4-(p,q)}$ is obtained in all of the $P_0 \times Q_0$ pixels.

[Step-140]

Thereafter, in the signal processor 20, the signal value $X_{1-(p,q)}$ in the (p,q)th pixel is obtained on the basis of the signal value $x_{1-(p,q)}$, the corrected expansion coefficient $\alpha'_{i-0}$, and the signal value $X_{4-(p,q)}$. The signal value $X_{2-(p,q)}$ in the (p,q)th pixel is obtained on the basis of the signal value $x_{2-(p,q)}$, the corrected expansion coefficient $\alpha'_{i-0}$, and the signal value $X_{4-(p,q)}$. The signal value $X_{3-(p,q)}$ in the (p,q)th pixel is obtained on the basis of the signal value $x_{3-(p,q)}$, the corrected expansion coefficient $\alpha'_{i-0}$, and the signal value $X_{4-(p,q)}$. Specifically, as described above, the signal value $X_{1-(p,q)}$, the signal value $X_{2-(p,q)}$ and the signal value $X_{3-(p,q)}$ in the (p,q)th pixel are obtained from the following expressions.

$$X_{1-(p,q)} = \alpha'_{i-0} \cdot x_{1-(p,q)} - \chi \cdot X_{4-(p,q)} \quad (1\text{-A})$$

$$X_{2-(p,q)} = \alpha'_{i-0} \cdot x_{2-(p,q)} - \chi X_{4-(p,q)} \quad (1\text{-B})$$

$$X_{3-(p,q)} = \alpha'_{i-0} \cdot x_{3-(p,q)} - \chi \cdot X_{4-(p,q)} \quad (1\text{-C})$$

Figure 6:
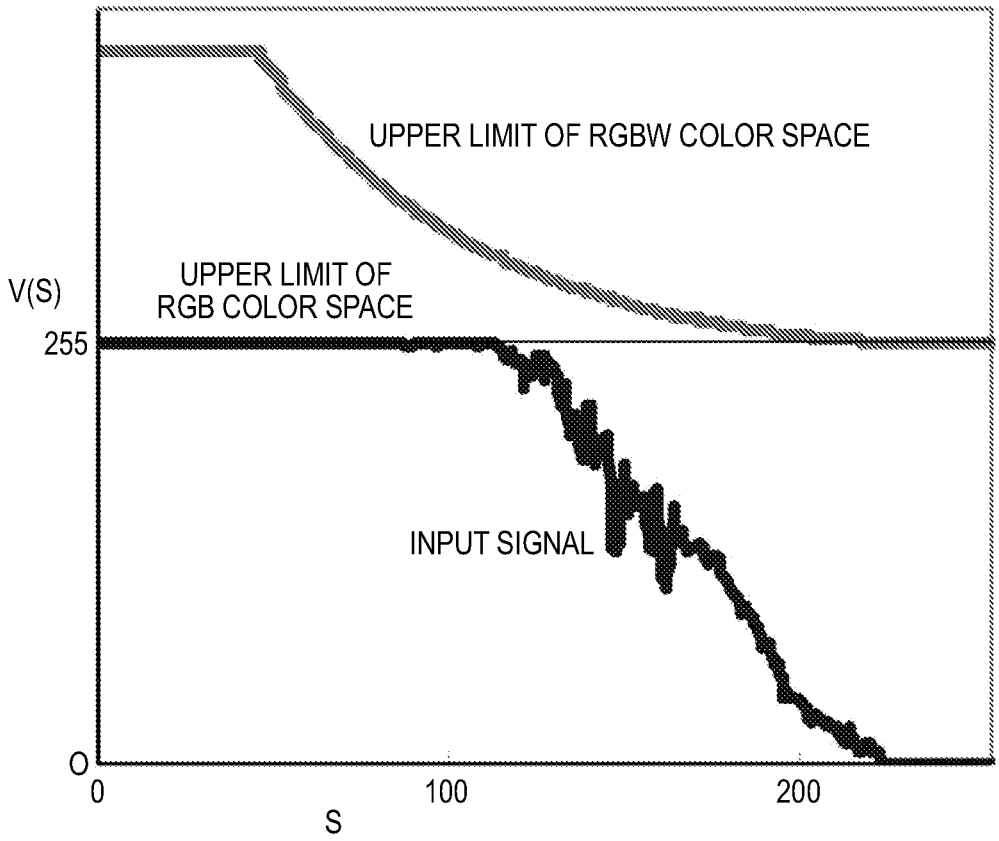
FIG. 6 is a diagram showing an existing HSV color space before a fourth color (white) is added in Example 1, an HSV color space enlarged by adding the fourth color (white), and the relationship between saturation S and luminosity V(S) of an input signal.
Figure 7:
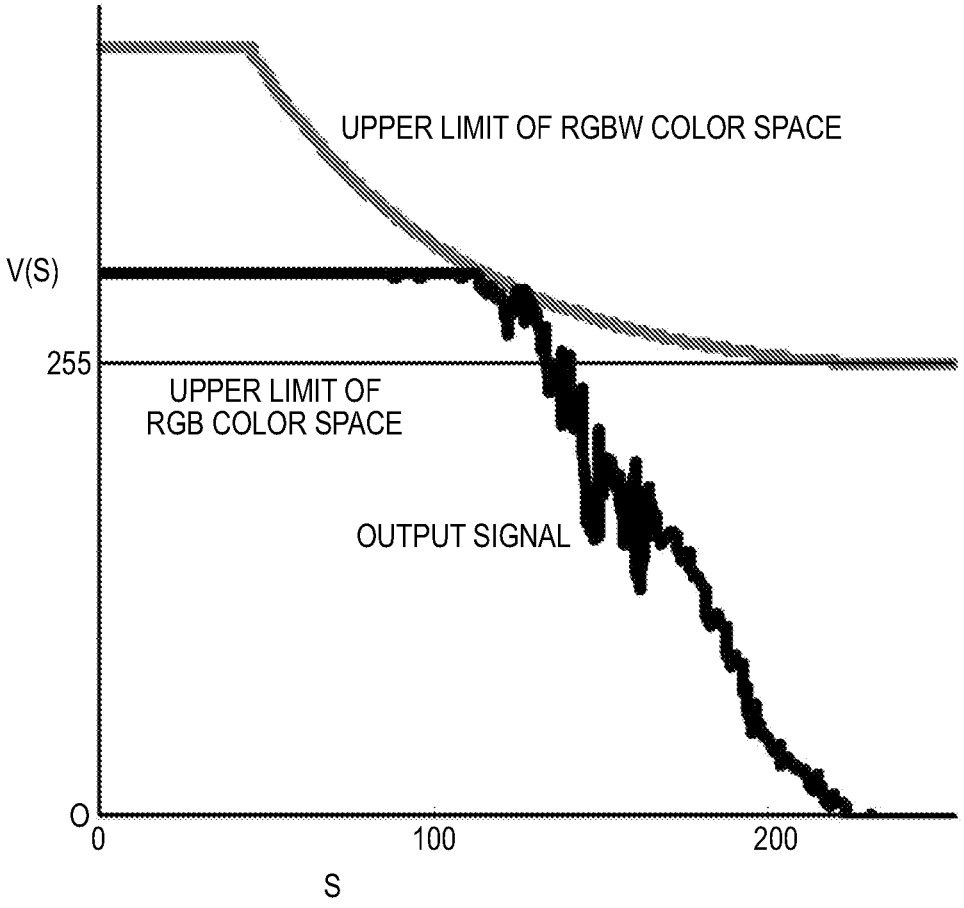
FIG. 7 is a diagram showing an existing HSV color space before a fourth color (white) is added in Example 1, an HSV color space enlarged by adding the fourth color (white), and the relationship between saturation S and luminosity V(S) of an output signal (subjected to an expansion process).

FIG. 6 shows an existing HSV color space before a fourth color (white) is added in Example 1, an HSV color space enlarged by adding a fourth color (white), and an example of the relationship between the saturation S and the luminosity V(S) of an input signal. FIG. 7 shows an existing HSV color space before a fourth color (white) is added in Example 1, an HSV color space enlarged by adding a fourth color (white), and an example of the relationship between the saturation S and the luminosity V(S) of an output signal (subjected to the expansion process). Note that the value of the saturation S of the horizontal axis in FIGS. 6 and 7 is originally a value between 0 to 1, but in FIGS. 6 and 7, the value is displayed 255 times.

The important point is, as shown in Expression (11), that the value of $Min_{(p,q)}$ is expanded by the corrected expansion coefficient $\alpha'_{i-0}$. In this way, the value of $Min_{(p,q)}$ is expanded by the corrected expansion coefficient $\alpha'_{i-0}$, and accordingly, not only the luminance of the white display subpixel (fourth subpixel W) but also the luminance of the red display subpixel, the green display subpixel, and the blue display subpixel (first subpixel R, second subpixel G, and third subpixel B) are increased as shown in Expressions (1-A), (1-B), and (1-C). For this reason, it is possible to reliably prevent the occurrence of a problem in that color dullness occurs. That is, if the value of $Min_{(p,q)}$ is expanded by the corrected expansion coefficient $\alpha'_{i-0}$, the luminance is expanded $\alpha'_{i-0}$ times over the entire image compared to a case where the value of $Min_{(p,q)}$ is not expanded. Accordingly, it should suffice that the luminance of the planar light source device 50 is $(1/\alpha'_{i-0})$ times, making it possible to attain low power consumption in the entire image display device.

When $\chi=1.5$ and $(2^n-1)=255$, output signal values $(X_{1-(p,q)}, X_{2-(p,q)}, X_{3-(p,q)}, X_{4-(p,q)})$ which are output when values shown in Table 2 are input as input signal values $(x_{1-(p,q)}, x_{2-(p,q)}, x_{3-(p,q)})$ are shown in Table 2. It is assumed that $\alpha'_{i-0} = \alpha'_{(i-j)-0} = 1.467$.

TABLE 2

| No. | $x_1$ | $x_2$ | $x_3$ | Max | Min | S | V | $V_{max}$ | $\alpha = V_{max}/V$ | $X_4$ | $X_1$ | $X_2$ | $X_3$ |
|---|---|---|---|---|---|---|---|---|---|---|---|---|---|
| 1 | 240 | 255 | 160 | 255 | 160 | 0.373 | 255 | 638 | 2.502 | 156 | 118 | 140 | 0 |
| 2 | 240 | 160 | 160 | 240 | 160 | 0.333 | 240 | 638 | 2.658 | 156 | 118 | 0 | 0 |
| 3 | 240 | 80 | 160 | 240 | 80 | 0.667 | 240 | 382 | 1.592 | 78 | 235 | 0 | 118 |
| 4 | 240 | 100 | 200 | 240 | 100 | 0.583 | 240 | 437 | 1.821 | 98 | 205 | 0 | 146 |
| 5 | 255 | 81 | 160 | 255 | 81 | 0.682 | 255 | 374 | 1.467 | 79 | 255 | 0 | 116 |

For example, with the input signal values of No. 1 shown in Table 2, upon taking the corrected expansion coefficient $\alpha'_{i-0}$ into consideration, the luminance values to be displayed on the basis of the input signal values $(x_{1-(p,q)}, x_{2-(p,q)}, x_{3-(p,q)})$= (240, 255, 160) are as follows when conforming to 8-bit display.

luminance value of first subpixel
$R=\alpha'_{i-0}\cdot x_{1-(p,q)}=1.467\times240=352$ luminance value of second subpixel
$G=\alpha'_{i-0}\cdot x_{2-(p,q)}=1.467\times255=374$ luminance value of third subpixel
$B=\alpha'_{i-0}\cdot x_{3-(p,q)}=1.467\times160=234$ The obtained value of the output signal value $X_{4-(p,q)}$ of the fourth subpixel W is 156 from Expression (11). Accordingly, the luminance value thereof is as follows.

luminance value of fourth subpixel $W=\chi\cdot X_{4-(p,q)}=1.5\times156=234$

Accordingly, the first subpixel output signal value $X_{1-(p,q)}$, the second subpixel output signal value $X_{2-(p,q)}$, and the third subpixel output signal value $X_{3-(p,q)}$ are as follows.

$X_{1-(p,q)}=352-234=118$ $X_{2-(p,q)}=374-234=140$ $X_{3-(p,q)}=234-234=0$

In this way, in a pixel to which the input signal values of No. 1 shown in Table 2 are input, an output signal value for the subpixel (in this case, third subpixel B) of the smallest input signal value is 0, and the display of the third subpixel B is substituted with the fourth subpixel W. The output signal values $X_{1-(p,q)}$, $X_{2-(p,q)}$, and $X_{3-(p,q)}$ of the first subpixel R, the second subpixel G, and the third subpixel B originally become values smaller than requested values.

In the method of driving an image display device of Example 1, the signal value $X_{1-(p,q)}$, the signal value $X_{2-(p,q)}$, the signal value $X_{3-(p,q)}$, and the signal value $X_{4-(p,q)}$ in the (p,q)th pixel are expanded $\alpha'_{i-0}$ times. For this reason, as described above, it should suffice that the luminance of the planar light source device 50 is $(1/\alpha'_{i-0})$ times. Therefore, it is possible to achieve reduction in power consumption in the planar light source device.

Although a configuration is made in which the brightness of the planar light source device is controlled using the corrected expansion coefficient $\alpha'_{i-0}$, the brightness of the planar light source device which is controlled using the corrected expansion coefficient $\alpha'_{i-0}$ may be the brightness of the planar light source device in an (i+k)th image display frame (where $0\leq k\leq5$), such that image flickering is less likely to occur. Specifically, with k=1, k=2, k=3, k=4, and k=5, the degree of image flickering is evaluated through the observation of the observer. As a result, the value of k when the degree of image flickering is smallest is 1 or 2, and when the value of k is 3 to 5, image flickering causes no practical problem.

Figure 8A:
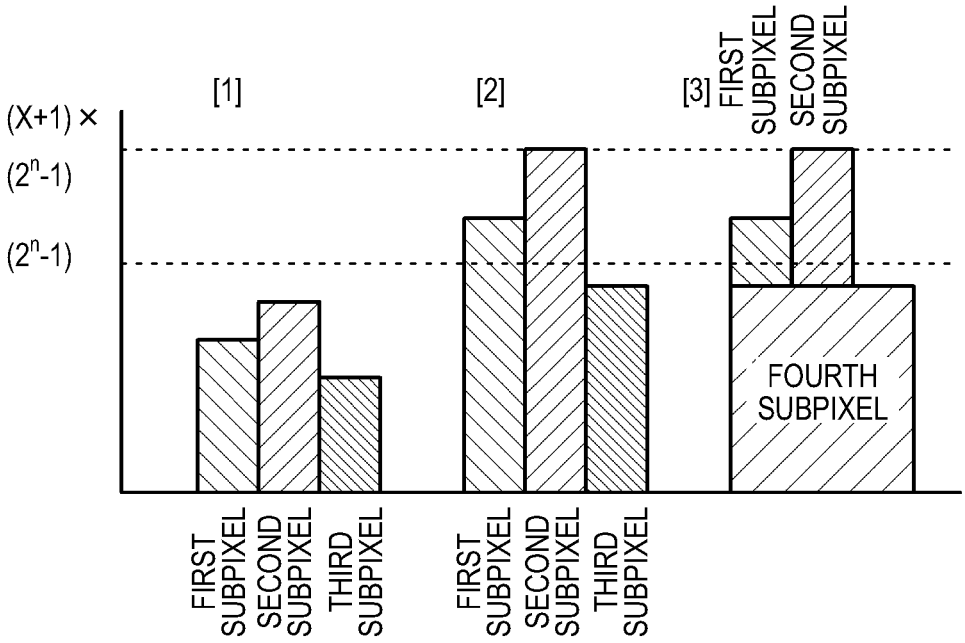
FIGS. 8A and 8B are diagrams schematically showing an input signal value and an output signal value and illustrating a difference between an expansion process in a method of driving an image display device of Example 1 and a processing method described in Japanese Patent No. 3805150.
Figure 8B:
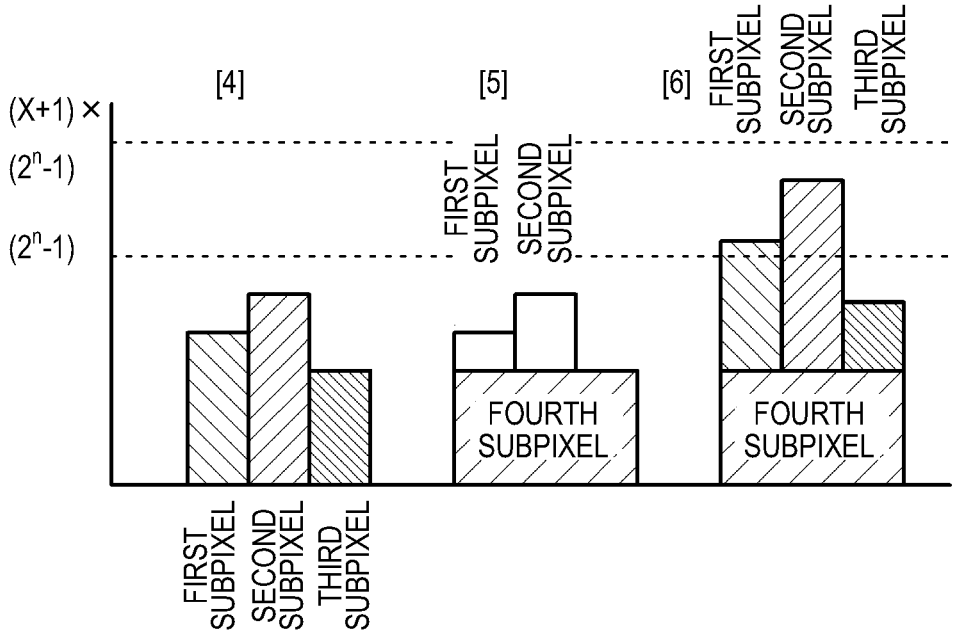

The difference between the expansion process in the method of driving an image display device of Example 1 and the processing method described in Japanese Patent No. 3805150 will be described with reference to FIGS. 8A and 8B. FIGS. 8A and 8B are respectively diagrams schematically showing input signal values and output signal values according to the method of driving an image display device of Example 1 and the processing method described in Japanese Patent No. 3805150. In the example shown in FIG. 8A, the input signal values of a set of the first subpixel R, the second subpixel G, and the third subpixel B are shown in with [1]. A state in which the expansion process is being performed (an operation to obtain the product of the input signal value and the expansion coefficient $\alpha_0$) is shown in [2]. The state after the expansion process has been performed (a state in which the output signal values $X_{1-(p,q)}$, $X_{2-(p,q)}$, $X_{3-(p,q)}$, and $X_{4-(p,q)}$ are obtained) is shown in [3]. The input signal values of a set of the first subpixel R, the second subpixel G, and the third subpixel B according to the processing method described in Japanese Patent No. 3805150 are shown in [4]. These input signal values are the same as those shown in [1] of FIG. 8A. The digital values Ri, Gi, and Bi of a red input subpixel, a green input subpixel, and a blue input subpixel and the digital value W for driving a luminance subpixel are shown in [5]. The result of each value of Ro, Go, Bo, and W is shown in [6]. From FIGS. 8A and 8B, according to the method of driving an image display device of Example 1, the maximum realizable luminance is obtained in the second subpixel G. According to the processing method described in Japanese Patent No. 3805150, it is found that the maximum realizable luminance is not reached in the second subpixel G. As described above, according to the method of driving an image display device of Example 1, it is possible to realize image display with higher luminance compared to the processing method described in Japanese Patent No. 3805150.

In Example 1, the driving method-A may be used instead of the method of determining the expansion coefficient $\alpha_{i-0}$ described above. That is, in the signal processor 20, the expansion coefficient $\alpha_{i-0}$ may be determined such that the ratio of pixels, in which the value of expanded luminosity obtained from the product of the luminosity $V_i(S)$ and the expansion coefficient $\alpha_{i-0}$ exceeds the maximum value $V_{max}(S)$, as to all pixels is equal to or smaller than a predetermined value ($\beta_{PD}$).

The values of the expansion coefficient $\alpha(S)$ obtained in a plurality of pixels (in Example 1, all of the $P_0\times Q_0$ pixels) are put in a row in an ascending order, and the expansion coefficient $\alpha(S)$ corresponding to the $(\beta_{PD}\times P_0\times Q_0)$th from the minimum value among the $P_0\times Q_0$ values of the expansion coefficient $\alpha(S)$ is set as the expansion coefficient $\alpha_{i-0}$. In this way, it is possible to determine the expansion coefficient $\alpha_{i-0}$ such that the ratio of pixels, in which the value of expanded luminosity obtained from the product of the luminosity $V_i(S)$ and the expansion coefficient $\alpha_{i-0}$ exceeds the maximum value $V_{max}(S)$ as to all pixels is equal to or smaller than a predetermined value ($\beta_{PD}$).

It should suffice that $\beta_{PD}$ is set to 0.003 to 0.05 (0.3% to 5%), and specifically, $\beta_{PD}$ is set to $\beta_{PD}$=0.01. That is, the expansion coefficient $\alpha_{i-0}$ is determined such that the ratio of pixels, in which the value of expanded luminosity obtained from the product of the luminosity $V_i(S)$ and the expansion coefficient $\alpha_{i-0}$ exceeds the maximum value $V_{max}(S)$, is equal to or greater than 0.3% and equal to or smaller than 5%, specifically, 1% as to all pixels. The value of $\beta_{PD}$ is determined by performing various tests.

When the minimum value of $V_{max}(S)/V_i(S)$ is set as the expansion coefficient $\alpha_{i-0}$, an output signal value as to an input signal value does not exceed $(2^8-1)$. However, if the expansion coefficient $\alpha_{i-0}$ is determined as described above instead of the minimum value of $V_{max}(S)/V_i(S)$ the expansion coefficient $\alpha_{i-0}$ is multiplied as to a pixel where the expansion coefficient (S) is smaller than the expansion coefficient $\alpha_{i-0}$, and the value of expanded luminosity exceeds the maximum value $V_{max}(S)$. As a result, so-called "gradation loss" occurs. Meanwhile, when the value of $\beta_{PD}$ is set to, for example, 0.003 to 0.05 as described above, it is possible to prevent the occurrence of a phenomenon where gradation loss is conspicuous and an unnatural image is generated. If the value $\beta_{PD}$ exceeds 0.05, in some cases, it was confirmed that gradation loss is conspicuous and an unnatural image is generated. Note that, when the output signal value exceeds $(2^n-1)$ as the upper limit value due to the expansion process, it should suffice that the output signal value is set to $(2^n-1)$ as the upper limit value.

On the other hand, the value of u(S) usually exceeds 1.0 and concentrates on 1.0 neighborhood. Accordingly, when the minimum value of $V_{max}(S)/V_i(S)$ is set as the expansion coefficient $\alpha_{i-0}$, the degree of expansion of the output signal value is small, and it is often difficult to attain low power consumption in the image display device. Incidentally, for example, if the value of $\beta_{PD}$ is set to 0.003 to 0.05, it is possible to increase the value of the expansion coefficient $\alpha_{i-0}$, and it should suffice that the luminance of the planar light source device 50 is $(1/\alpha'_{i-0})$ times. Therefore, it becomes possible to attain low power consumption in the entire image display device.

Note that, even when the value of $\beta_{PD}$ exceeds 0.05, if the expansion coefficient $\alpha_{i-0}$ is small, it was found that gradation loss is not conspicuous and an unnatural image is not generated. Specifically, even when the following value is alternatively used as the value $\alpha_{i-0}$, $$\alpha_{i-0} = (BN_4 / BN_{1-3}) + 1 \quad (15\text{-}1)$$

$$= \chi + 1 \quad (15\text{-}2)$$

that is, even when the driving method-B is used, it is found that there is a case where gradation loss is not conspicuous and an unnatural image is not generated, and it is also possible to attain low power consumption in the entire image display device.

When the following relationship is established, $$\alpha_{i-0}=\chi+1 \quad (15\text{-}2)$$

and when the ratio (β") of pixels, in which the value of expanded luminosity obtained from the product of the luminosity $V_i(S)$ and the expansion coefficient $\alpha_{i-0}$ exceeds the maximum value $V_{max}(S)$, as to all pixels is significantly greater than the predetermined value ($\beta_{PD}$) (for example, (β"=0.07), it is desirable to use a configuration in which the expansion coefficient is restored to $\alpha_{i-0}$ obtained in [Step-110].

Various tests showed that, when yellow is greatly mixed in the color of an image, if the expansion coefficient $\alpha_{i-0}$ exceeds 1.3, yellow dulls, and an unnatural color image is generated. For this reason, after various tests were performed, when a color defined with (R,G,B) is displayed in a pixel, and the ratio of pixels, in which the hue H and the saturation S in the HSV color space are within the ranges defined with the following expressions, as to all pixels exceeds the predetermined value $\beta_{PD}$ (for example, specifically, 2%) (that is, when yellow is greatly mixed in the color of an image), $$40 \le H \le 65 \quad (16\text{-}1)$$

$$0.5 \le S \le 1.0 \quad (16\text{-}2)$$

if the expansion coefficient $\alpha_{i-0}$ is set to be equal to or smaller than the predetermined value $\alpha'_{PD}$, specifically, equal to or smaller than 1.3 (driving method-C), a result was obtained in which yellow does not dull and an unnatural color image is not generated. It was also possible to achieve reduction in power consumption in the entire image display device.

With (R,G,B), when the value of R is the maximum, the hue H is represented by the following expression.

$$H=60(G-B)/(\text{Max}-\text{Min}) \quad (16\text{-}3)$$

When the value of G is the maximum, the hue H is represented by the following expression.

$$H=60(B-R)/(\text{Max}-\text{Min})+120 \quad (16\text{-}4)$$

When the value of B is the maximum, the hue H is represented by the following expression.

$$H=60(R-G)/(\text{Max}-\text{Min})+240 \quad (16\text{-}5)$$

Note that the determination on whether or not yellow is greatly mixed in the color of an image, instead of the following expressions, when a color defined with (R,G,B) is displayed in a pixel, and the ratio of pixels, in which (R,G,B) satisfy Expressions (17-1) to (17-6), as to all pixels exceeds the predetermined value $\beta'_{PD}$ (for example, specifically, 2%), the expansion coefficient $\alpha_{i-0}$ may be set to be equal to or smaller than the predetermined value $\alpha'_{PD}$ (for example, specifically, equal to or smaller than 1.3) (driving method-D).

$$40 \le H \le 65 \quad (16\text{-}1)$$

$$0.5 \le S \le 1.0 \quad (16\text{-}2)$$

With (R,G,B), when the value of R is the maximum value and the value of B is the minimum value, the values of R, G, and B satisfy the following expressions.

$$R \ge 0.78 \times (2^n-1) \quad (17\text{-}1)$$

$$G \ge (2R/3)+(B/3) \quad (17\text{-}2)$$

$$B \le 0.50R \quad (17\text{-}3)$$

Alternatively, with (R,G,B), when the value of G is the maximum value and the value of B is the minimum value, the values of R, G, and B satisfy the following expressions.

$$R \ge (4B/60)+(56G/60) \quad (17\text{-}4)$$

$$G \ge 0.78 \times (2^n-1) \quad (17\text{-}5)$$

$$B \le 0.50R \quad (17\text{-}6)$$

Here, n is the number of display gradation bits.

In this way, with the use of Expressions (17-1) to (17-6), it is possible to determine whether or not yellow is greatly mixed in the color of an image with a little calculation amount, to reduce the circuit scale of the signal processor 20, and to achieve reduction in calculation time. The coefficients and numerical values in Expressions (17-1) to (17-6) are not limited thereto. When the number of data bits of (R,G,B) is great, if a higher-order bit is used, it is possible to perform the determination with less calculation amount and to further reduce the circuit scale of the signal processor 20. Specifically, in the case of 16-bit data and, for example, R=52621, when higher-order 8 bits are used, R is set to R=205.

Alternatively, in order words, when the ratio of pixels displaying yellow as to all pixels exceeds the predetermined value $\beta'_{PD}$ (for example, specifically, 2%), the expansion coefficient $\alpha_{i-0}$ is set to be equal to or smaller than a predetermined value (for example, specifically, equal to or smaller than 1.3) (driving method-E).

Note that the method of driving an image display device in Example 1, the range of the value of $\beta_{PD}$ in the driving method-A, the definitions of Expressions (15-1) and (15-2) in the driving method-B, the definitions of Expressions (16-1) to (16-5) in the driving method-C, the definitions of Expressions (17-1) to (17-6) in the driving method-D, and the definitions in the driving method-E can apply to the following examples. Accordingly, in the following examples, description thereof will not be repeated, description relating to subpixels forming a pixel will be provided, and the relationship between an input signal and an output signal to a subpixel, and the like will be described.

Example 2

Example 2 is a modification of Example 1. Although an existing direct-type planar light source device may be used as the planar light source device, in Example 2, a planar light source device 150 of a division driving system (partial driving system) described below is used. Note that the expansion process itself should be the same as the expansion process described in Example 1.

Figure 9:
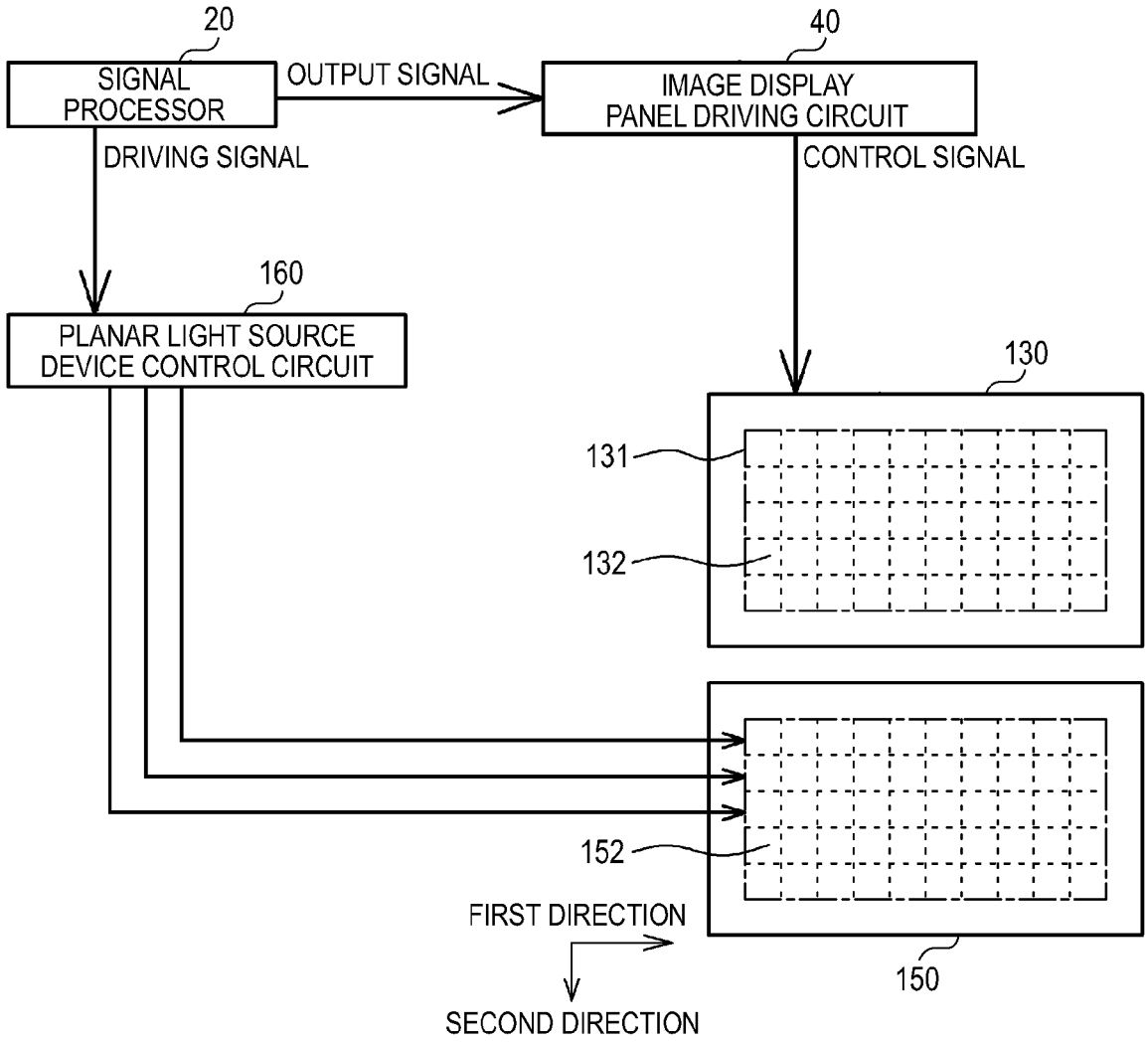
FIG. 9 is a conceptual diagram of an image display panel and a planar light source device of an image display device of Example 2.
Figure 10:
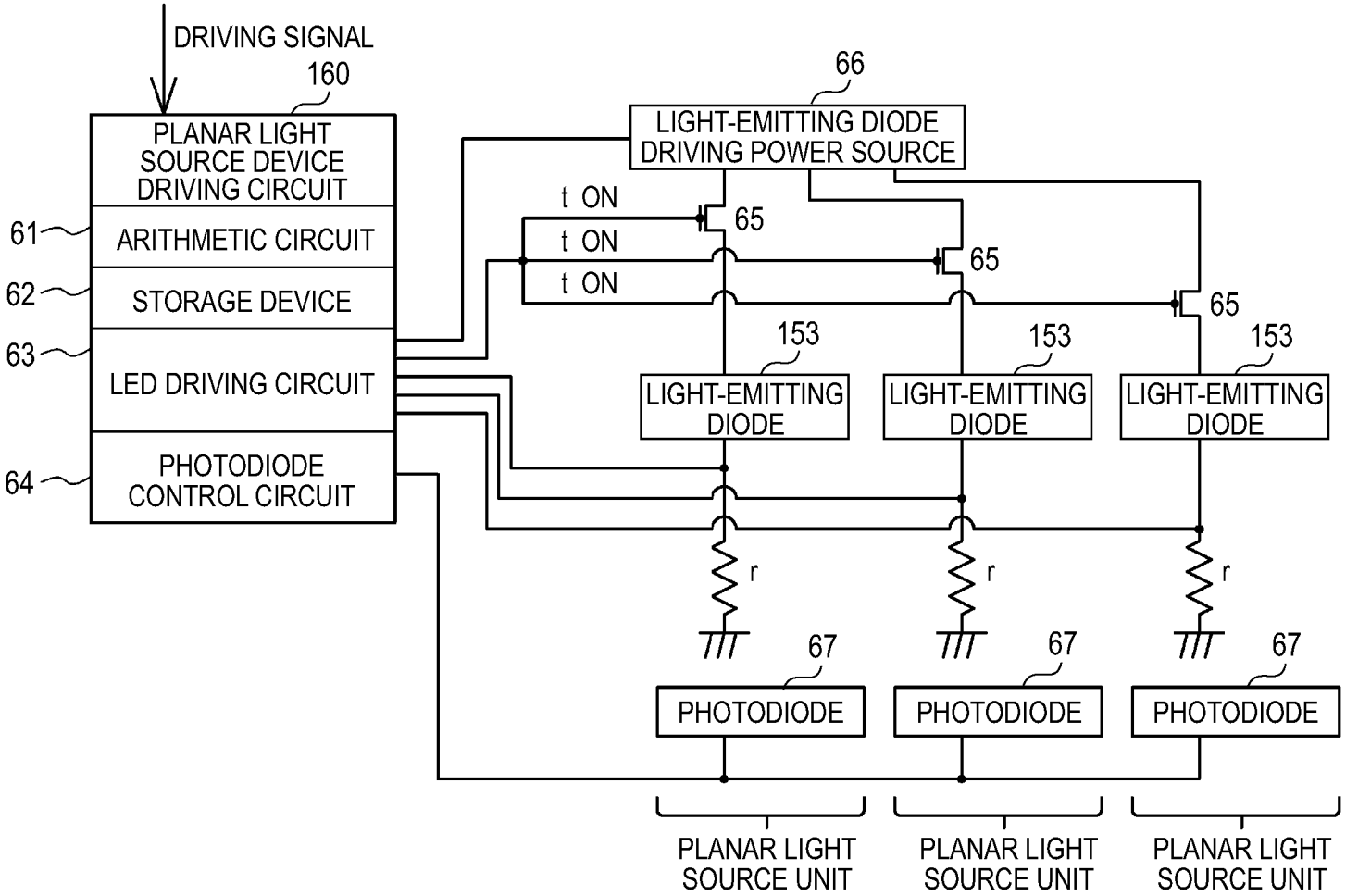
FIG. 10 is a circuit diagram of a planar light source device control circuit in the planar light source device of the image display device of Example 2.
Figure 11:
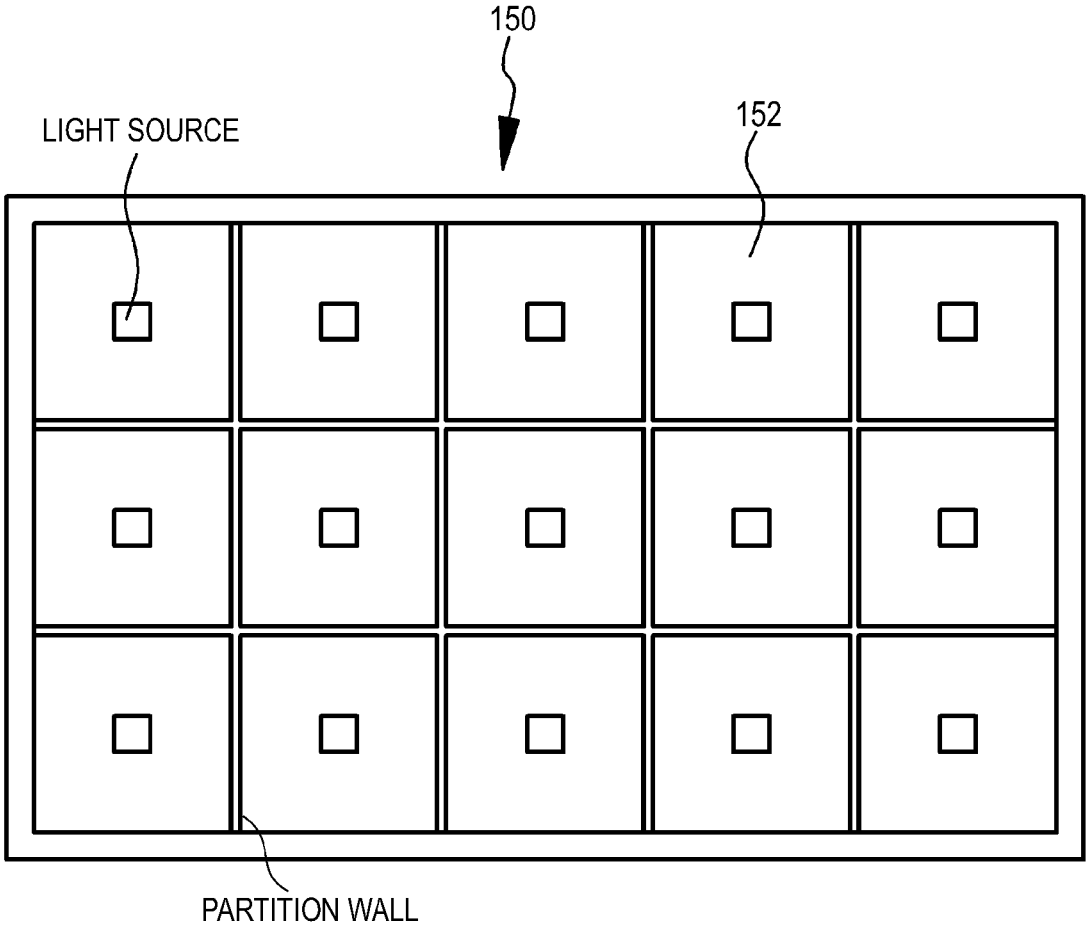
FIG. 11 is a diagram schematically showing the layout and arrangement state of planar light source units and the like in the planar light source device of the image display device of Example 2.

FIG. 9 is a conceptual diagram of an image display panel and a planar light source device in an image display device of Example 2. FIG. 10 is a circuit diagram of a planar light source device control circuit in a planar light source device of the image display device. FIG. 11 schematically shows the layout and arrangement state of planar light source units and the like in the planar light source device of the image display device.

Assuming that a display region 131 of an image display panel 130 forming a color liquid crystal display is divided into S×T virtual display region units 132, the planar light source device 150 of a division driving system has S×T planar light source units 152 corresponding to the S×T display region units. The emission states of the S×T planar light source units 152 are controlled individually.

As shown in the conceptual diagram of FIG. 9, the image display panel (color liquid crystal display panel) 130 includes a display region 131 where P×Q pixels in total of P pixels in the first direction and Q pixels in the second direction are arranged in a two-dimensional matrix. It is assumed that the display region 131 is divided into S×T virtual display region units 132. Each display region unit 132 has a plurality of pixels. Specifically, for example, the HD-TV standard is satisfied as resolution for image display, and when the number P×Q of pixels arranged in the two-dimensional matrix is represented with (P,Q), the resolution for image display is, for example, (1920,1080). The display region 131 (in FIG. 9, indicated by a one-dot-chain line) which has the pixels arranged in the two-dimensional matrix is divided into S×T virtual display region units 132 (a boundary therebetween is indicated by a dotted line). The value of (S,T) is, for example, (19,12). For simplification of the drawings, the number of display region unit 132 (or the planar light source units 152 described below) in FIG. 9 differs from this value. Each display region unit 132 has a plurality of pixels, and the number of pixels forming one display region unit 132 is, for example, about 10,000. In general, the image display panel 130 is line-sequentially driven. More specifically, the image display panel 130 has scanning electrodes (extending in the first direction) and data electrodes (extending in the second direction) which intersect in a matrix, inputs a scanning signal to a scanning electrode from the scanning circuit to select and scan the scanning electrode, and displays an image on the basis of a data signal (output signal) input from the signal output circuit to a data electrode, thereby forming one screen.

The direct-type planar light source device (backlight) 150 has S×T planar light source units 152 corresponding to S×T virtual display region units 132. Each planar light source unit 152 illuminates the display region unit 132 corresponding to the planar light source unit 152 from the rear. Light sources in the planar light source units 152 are controlled individually. Although the planar light source device 150 is positioned below the image display panel 130, in FIG. 9, the image display panel 130 and the planar light source device 150 are displayed separately.

Although the display region 131 which has the pixels arranged in the two-dimensional matrix is divided into the S×T display region units 132, if this state is expressed with "row" and "column", it can be said that the display region 131 is divided into T-rows×S-column display region units 132. Although the display region unit 132 has a plurality of pixels ($M_0 \times N_0$), if this state is expressed with "row" and "column", it can be said that the display region 132 has a $N_0$-row×$M_0$-column pixels.

FIG. 11 shows the layout and arrangement state of the planar light source units 152 and the like in the planar light source device 150. A light source has a light-emitting diode 153 which is driven based on a pulse width modulation (PWM) control system. An increase/decrease in the luminance of the planar light source unit 152 is performed by increase/decrease control of the duty ratio according to pulse width modulation control of the light-emitting diode 153 forming the planar light source unit 152. Illumination light emitted from the light-emitting diode 153 is emitted from the planar light source unit 152 through a light diffusion plate, passes through an optical function sheet group (not shown), such as a light diffusion sheet, a prism sheet, and a polarization conversion sheet, and illuminates the image display panel 130 from the rear. One optical sensor (photodiode 67) is disposed in one planar light source unit 152. With the photodiode 67, the luminance and chromaticity of the light-emitting diode 153 are measured.

As shown in FIGS. 9 and 10, a planar light source device driving circuit 160 which drives the planar light source unit 152 on the basis of a planar light source device control signal (driving signal) from the signal processor 20 performs on/off control of the light-emitting diode 153 forming the planar light source unit 152 using the pulse width modulation control system. The planar light source device driving circuit 160 includes an arithmetic circuit 61, a storage device (memory) 62, an LED driving circuit 63, a photodiode control circuit 64, a switching element 65 made of an FET, and a light-emitting diode driving power source (constant current source) 66. These circuits and the like forming the planar light source device control circuit 160 may be known circuits and the like.

A feedback mechanism is formed such that the emission state of the light-emitting diode 153 in a certain image display frame is measured by the photodiode 67, the output of the photodiode 67 is input to the photodiode control circuit 64 and set as data (signal) regarding, for example, the luminance and chromaticity of the light-emitting diode 153 in the photodiode control circuit 64 and the arithmetic circuit 61, concerned data is sent to the LED driving circuit 63, and the emission state of the light-emitting diode 153 in the next image display frame is controlled.

A resistive element r for current detection is inserted downstream of the light-emitting diode 153 in series with the light-emitting diode 153, current flowing in the resistive element r is converted to voltage, and the operation of the light-emitting diode driving power source 66 is controlled under the control of the LED driving circuit 63 such that voltage drop in the resistive element r has a predetermined value. Although FIG. 10 shows a single light-emitting diode driving power source (constant current source) 66, actually, a light-emitting diode driving power source 66 is disposed to drive each light-emitting diode 153. Note that FIG. 10 shows three sets of planar light source units 152. Although in FIG. 10, a configuration in which one light-emitting diode 153 is provided in one planar light source unit 152 is made, the number of light-emitting diodes 153 forming one planar light source unit 152 is not limited to one.

As described above, each pixel has four types of subpixels of a first subpixel R, a second subpixel G, a third subpixel B, and a fourth subpixel W as one set. Here, control (gradation control) of the luminance of each subpixel is 8-bit control and will be performed in $2^8$ steps of 0 to 255. The value PS of a pulse width modulation output signal for controlling the emission time of each of the light-emitting diodes 153 forming each planar light source unit 152 has a value of $2^8$ steps of 0 to 255. However, these values are not limited thereto, and for example, the gradation control may be 10-bit control and may be performed in $2^{10}$ steps of 0 to 1023. In this case, an expression with an 8-bit numerical value should be, for example, four times.

Here, the transmittance (also referred to aperture ratio) Lt of a subpixel, the luminance (display luminance) y of a display region portion corresponding to the subpixel, and the luminance (light source luminance) Y of a planar light source unit 152 are defined as follows.

$Y_1$ . . . the highest luminance of light source luminance, for example, and may be hereinafter referred to as a light source luminance first prescribed value.

$Lt_1$ . . . the maximum value of transmittance (aperture ratio) of a subpixel in a display region unit 132, for example, and may be hereinafter referred to as transmittance first prescribed value.

$Lt_2$ . . . the transmittance (aperture ratio) of a subpixel when it is assumed that a control signal corresponding to an intra-display region unit signal maximum value $X_{max-(s,t)}$ which is the maximum value among the values of the output signals from the signal processor 20 to be input to the image display panel driving circuit 40 for driving all subpixels forming the display region unit 132 is supplied to a subpixel and is hereinafter referred to as a transmittance second prescribed value. Note that $0 \leq Lt_2 \leq Lt_1$ should be satisfied.

$y_2$ . . . display luminance which is obtained when it is assumed that light source luminance is a light source luminance first prescribed value $Y_1$, and the transmittance (aperture ratio) of a subpixel is a transmittance second prescribed value $Lt_2$, and may be hereinafter referred to as a display luminance second prescribed value.

$Y_2$ . . . the light source luminance of the planar light source unit 152 for setting the luminance of a subpixel to the display luminance second prescribed value ($y_2$) when it is assumed that a control signal corresponding to the intra-display region unit signal maximum value $X_{max-(s,t)}$ is supplied to a subpixel, and the transmittance (aperture ratio) of a subpixel at this time is corrected to the transmittance first prescribed value $Lt_1$. Meanwhile, the light source luminance $Y_2$ may be subjected to correction taking into consideration an influence of the light source luminance of each planar light source unit 152 to the light source luminance of another planar light source unit 152.

Figure 12A:
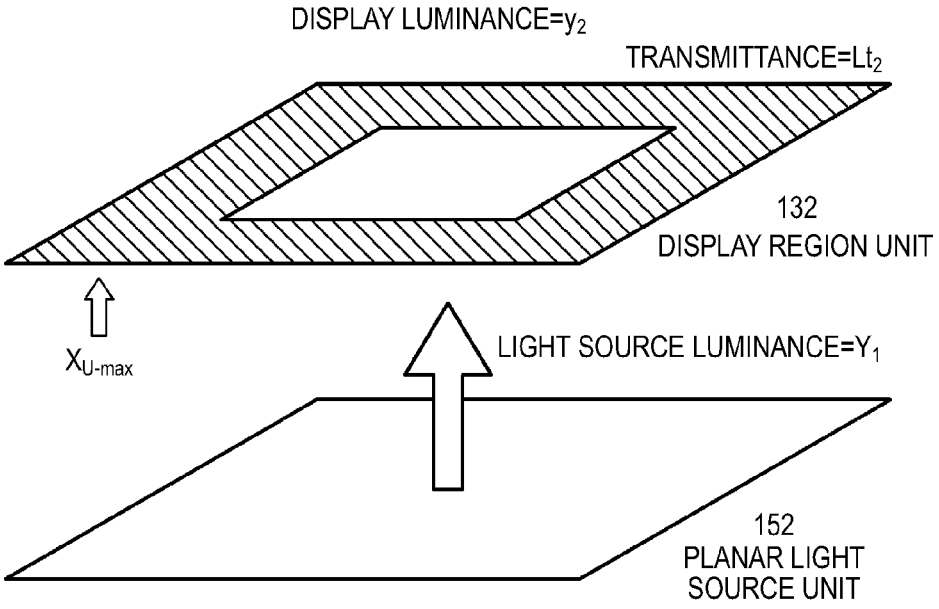
FIGS. 12A and 12B are conceptual diagrams illustrating states of increasing and decreasing light source luminance $Y_2$ of a planar light source unit under the control of a planar light source device driving circuit such that a display luminance second prescribed value $y_2$ when it is assumed that a control signal corresponding to an intra-display region unit signal maximum value $X_{max-(s,t)}$ is supplied to a subpixel is obtained by the planar light source unit.
Figure 12B:
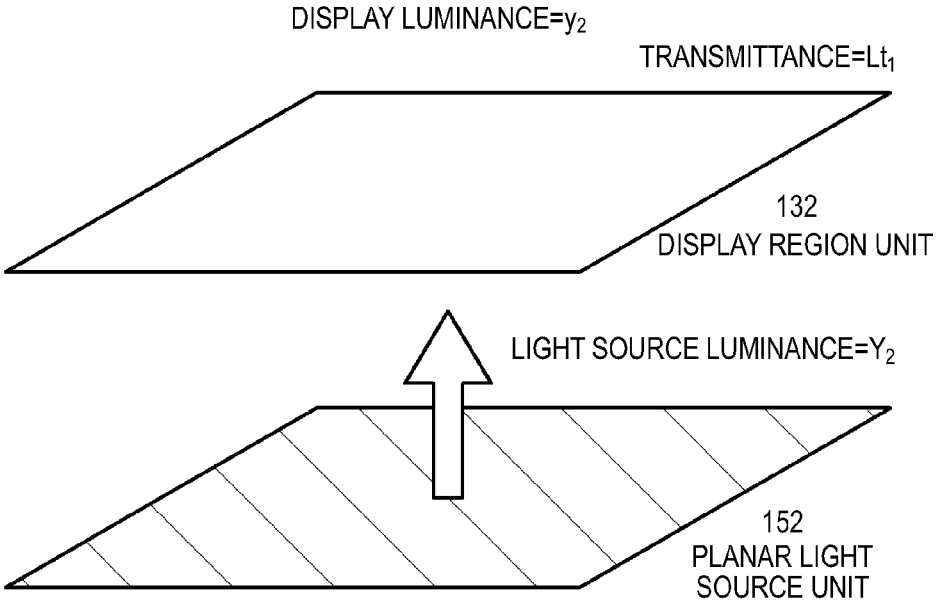

Although the luminance of a light-emitting element forming a planar light source unit 152 corresponding to a display region unit 132 is controlled by the planar light source device control circuit 160 such that the luminance (the display luminance second prescribed value $y_2$ with the transmittance first prescribed value $Lt_1$) of a subpixel when it is assumed that a control signal corresponding to the intra-display region unit signal maximum value $X_{max-(s,t)}$ is supplied to a subpixel is obtained at the time of partial driving (division driving) of the planar light source device, specifically, for example, it should suffice that the light source luminance $Y_2$ is controlled (for example, is decreased) such that the display luminance $y_2$ is obtained when the transmittance (aperture ratio) of a subpixel is set as, for example, the transmittance first prescribed value $Lt_1$. That is, for example, it should suffice that the light source luminance $Y_2$ of the planar light source unit 152 is controlled in each image display frame such that Expression (A) is satisfied. Note that the relationship $Y_2 \leq Y_1$ is established. A conceptual diagram of this control is shown in FIGS. 12A and 12B.

$$Y_2 \cdot Lt_1 = Y_1 \cdot Lt_2 \tag{A}$$

In order to control each of the subpixels, output signals $X_{1-(p,q)}$, $X_{2-(p,q)}$, $X_{3-(p,q)}$, and $X_{4-(p,q)}$ for controlling the transmittance Lt of the respective subpixels are sent from the signal processor 20 to the image display panel driving circuit 40. In the image display panel driving circuit 40, control signals are generated from the output signals, and these control signals are supplied (output) to the subpixels. A switching element forming each subpixel is driven on the basis of the corresponding control signal, and a desired voltage is applied to a transparent first electrode and a transparent second electrode (not shown) forming a liquid crystal cell, and accordingly, the transmittance (aperture ratio) Lt of each subpixel is controlled. Here, the greater a control signal, the higher the transmittance (aperture ratio) Lt of a subpixel, and the higher the value of the luminance (display luminance y) of a display region portion corresponding to the subpixel. That is, an image (usually, a kind of dotted shape) which is formed by light passing through a subpixel is bright.

Control of the display luminance y and the light source luminance $Y_2$ is performed in each image display frame of image display of the image display panel 130, for each display region unit, and for each planar light source unit. The operation of the image display panel 130 and the operation of the planar light source device 150 are synchronized in one image display frame. Note that the number (image per second) of pieces of image information to be transmitted to the driving circuit for one second as an electrical signal is a frame frequency (frame rate), and the reciprocal of the frame frequency is frame time (unit: second).

In Example 1, an expansion process for expanding an input signal to obtain an output signal has been performed for all pixels on the basis of one corrected expansion coefficient $\alpha'_{i-0}$. Meanwhile, in Example 2, a corrected expansion coefficient $\alpha'_{i-0-(s,t)}$ is obtained in each of the S×T display region units 132, and an expansion process based on the corrected expansion coefficient $\alpha'_{i-0-(s,t)}$ is performed in each of the display region units 132.

In the (s,t)th planar light source unit 152 corresponding to the (s,t)th display region unit 132 where the obtained corrected expansion coefficient is $\alpha'_{i-0-(s,t)}$, the luminance of a light source is set to $(1/\alpha'_{i-0-(s,t)})$.

Alternatively, the luminance of a light source forming a planar light source unit 152 corresponding to a display region unit 132 is controlled by the planar light source device control circuit 160 such that the luminance (the display luminance second prescribed value $y_2$ with the transmittance first prescribed value $Lt_1$) of a subpixel when it is assumed that a control signal corresponding to the intra-display region unit signal maximum value $X_{max-(s,t)}$ which is the maximum value among the output signal values $X_{1-(s,t)}$, $X_{2-(s,t)}$, $X_{3-(s,t)}$, and $X_{4-(s,t)}$ from the signal processor 20 to be input to drive all subpixels forming each display region unit 132 is supplied to a subpixel is obtained. Specifically, it should suffice that the light source luminance $Y_2$ is controlled (for example, is decreased) such that the display luminance $y_2$ is obtained when the transmittance (aperture ratio) of a subpixel is the transmittance first prescribed value $Lt_1$. That is, specifically, it should suffice that the light source luminance $Y_2$ of the planar light source unit 152 is controlled in each image display frame such that Expression (A) is satisfied.

On the other hand, in the planar light source device 150, for example, when the luminance control of the planar light source unit 152 of (s,t)=(1,1) is assumed, there may be a case where it is necessary to take into consideration the influence from other S×T planar light source units 152. Since the influence on the planar light source unit 152 from another planar light source unit 152 is recognized in advance by the emission profile of each planar light source unit 152, a difference can be calculated by back calculation, and as a result, correction can be performed. A basic form of arithmetic operation will be described below.

The luminance (light source luminance $Y_2$) which is necessary for the S×T planar light source units 152 based on the request of Expression (A) will be represented with a matrix $[L_{P\times Q}]$. The luminance of a certain planar light source unit obtained when only the certain planar light source unit is driven and other planar light source units are not driven is obtained in advance for the S×T planar light source units 152. The concerned luminance is represented with a matrix $[L'_{P\times Q}]$. A correction coefficient is represented with a matrix $[\alpha_{P\times Q}]$. When this happens, the relationship between the matrixes can be represented by Expression (B-1). The correction coefficient matrix $[\alpha_{P\times Q}]$ may be obtained in advance.

$$[L_{P\times Q}]=[L'_{P\times Q}]\cdot[\alpha_{P\times Q}] \quad \text{(B-1)}$$

Accordingly the matrix $[L_{P\times Q}]$ should be obtained from Expression (B-1). The matrix $[L'_{P\times Q}]$ can be obtained from the calculation of an inverse matrix. That is, the following expression should be calculated.

$$[L'_{P\times Q}]=[L_{P\times Q}]\cdot[\alpha_{P\times Q}]-1 \quad \text{(B-2)}$$

It should suffice that the light source (light-emitting diode 153) in each planar light source unit 152 is controlled such that the luminance represented with the matrix $[L'_{P\times Q}]$ is obtained. Specifically, it should suffice that concerned operation and process are performed using information (data table) stored in the storage device (memory) 62 of the planar light source device control circuit 160. Note that, with the control of the light-emitting diode 153, since the value of the matrix $[L'_{P\times Q}]$ does not have a negative value, it is needless to say that a calculation result should be included in a positive region. Accordingly, the solution of Expression (B-2) is not an exact solution and may be an approximate solution.

In this way, as described above, the matrix $[L'_{P\times Q}]$ of the luminance when it is assumed that a planar light source unit has been driven alone is obtained on the basis of the matrix $[L_{P\times Q}]$ based on the value of Expression (A) obtained in the planar light source device control circuit 160 and the matrix $[\alpha_{P\times Q}]$ of the correction coefficient, and is converted to the corresponding integer (the value of a pulse width modulation output signal) within a range of 0 to 255 on the basis of the conversion table stored in the storage device 62. In this way, in the arithmetic circuit 61 forming the planar light source device control circuit 160, the value of a pulse width modulation output signal for controlling the emission time of the light-emitting diode 153 in the planar light source unit 152 can be obtained. It should suffice that the on-time $t_{ON}$ and the off-time $t_{OFF}$ of the light-emitting diode 153 forming the planar light source unit 152 are determined on the basis of the value of the pulse width modulation output signal in the planar light source device control circuit 160. Note that $t_{ON}+t_{OFF}$=constant value $t_{Const}$. A duty ratio in driving based on the pulse width modulation of a light-emitting diode can be represented as follows.

$$t_{ON}/(t_{ON}+t_{OFF})=t_{ON}/t_{Const}$$

A signal corresponding to the on-time $t_{ON}$ of the light-emitting diode 153 forming the planar light source unit 152 is sent to the LED driving circuit 63. The switching element 65 is in an on state for the on-time $t_{ON}$ on the basis of the value of the signal corresponding to the on-time $t_{ON}$ from the LED driving circuit 63. Then, the LED driving current from the light-emitting diode driving power source 66 flows into the light-emitting diode 153. As a result, each light-emitting diode 153 emits light for the on-time $t_{ON}$ in one image display frame. In this way, each display region unit 132 is illuminated with predetermined luminance.

Note that the planar light source device 150 of the division driving system (partial driving system) described in Example 2 may be used in other examples.

Example 3

Figure 13:
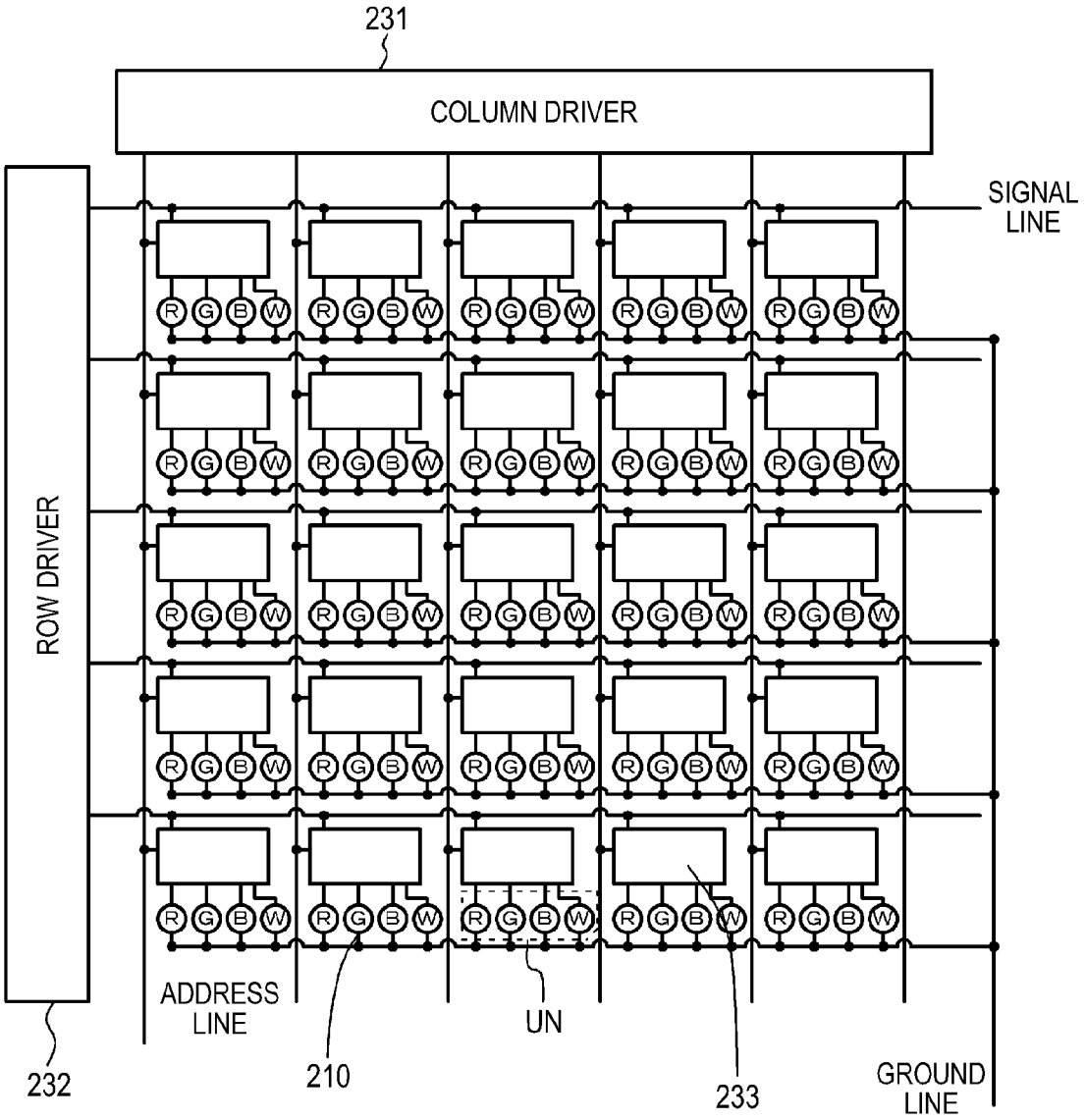
FIG. 13 is an equivalent circuit diagram of an image display device of Example 3.
Figure 14:
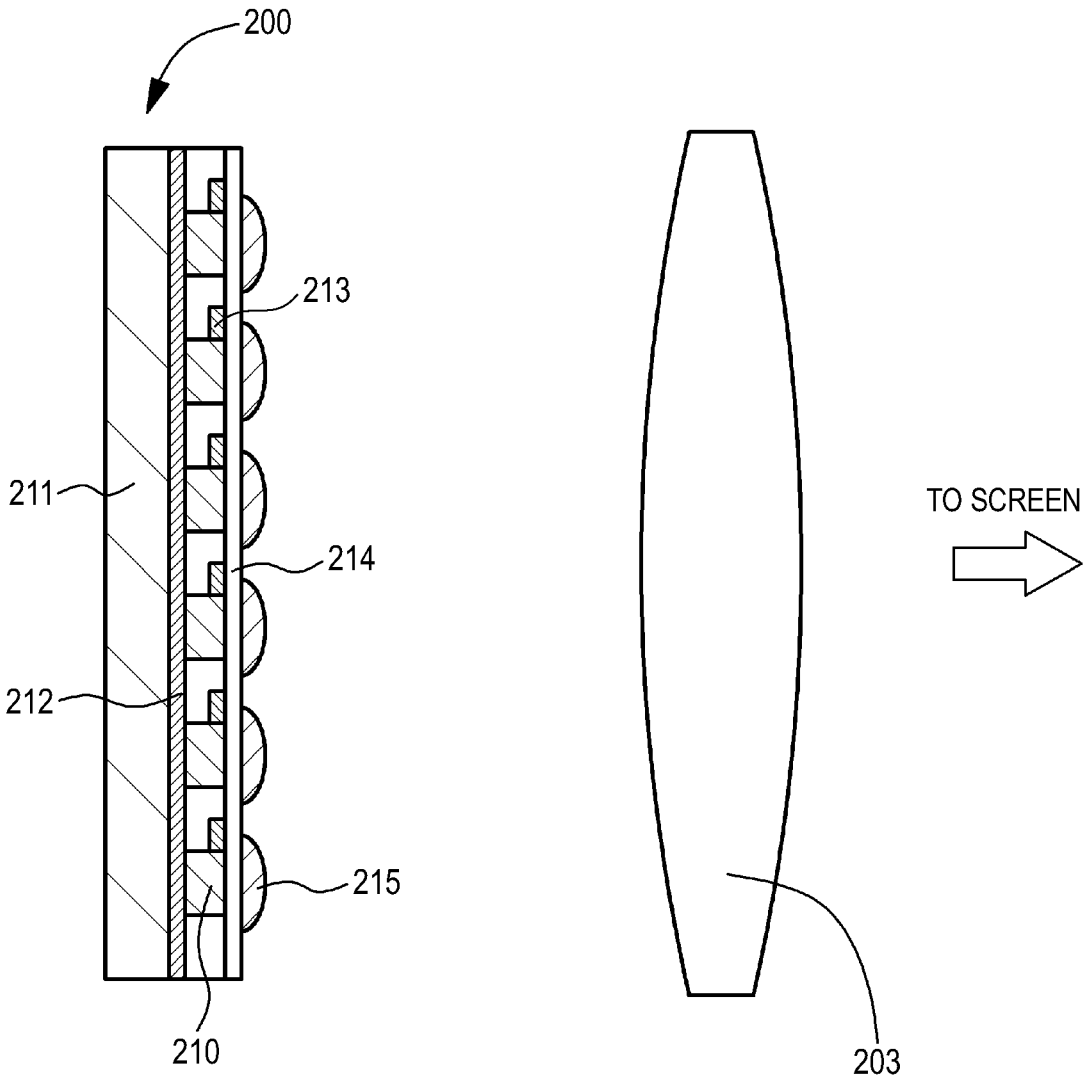
FIG. 14 is a conceptual diagram of an image display panel in an image display device of Example 3.

Example 3 is also a modification of Example 1. FIG. 13 is an equivalent circuit diagram of an image display device of Example 3. FIG. 14 is a conceptual diagram of an image display panel forming the image display device. In Example 3, an image display device described below is used. That is, the image display device of Example 3 includes an image display panel in which light-emitting element units UN for displaying a color image are arranged in a two-dimensional matrix, each of which has a first light-emitting element (corresponding to a first subpixel R) emitting blue, a second light-emitting element (corresponding to a second subpixel G) emitting green, a third light-emitting element (corresponding to a third subpixel B) emitting red, and a fourth light-emitting element (corresponding to a fourth subpixel W) emitting white. As the image display panel forming the image display device of Example 3, for example, an image display panel having a configuration and a structure described below can be used. It should suffice that the number of light-emitting element units UN is determined on the basis of the specification necessary for the image display device.

That is, the image display panel forming the image display device of Example 3 is a passive matrix-type or active matrix-type image display panel of direct-view color display which controls the emission/non-emission state of each of a first light-emitting element, a second light-emitting element, a third light-emitting element, and a fourth light-emitting element to directly visually recognize the emission state of each light-emitting element. Alternatively, the image display panel is a passive matrix-type or active matrix-type image display panel of projection-type color display which controls the emission/non-emission state of each of a first light-emitting element, a second light-emitting element, a third light-emitting element, and a fourth light-emitting element and projects an image to the screen to display the image.

For example, FIG. 13 is a circuit diagram including a light-emitting element panel forming the active matrix-type image display panel of direct-view color display. In FIG. 13, one electrode (p-side electrode or n-side electrode) of each light-emitting element 210 (in FIG. 13, a light-emitting element (first subpixel) emitting red is indicated with "R", a light-emitting element (second subpixel) emitting green is indicated with "G", a light-emitting element (third subpixel B) emitting blue is indicated with "B", and a light-emitting element (fourth subpixel) emitting white is indicated with "W") is connected to a driver 233, and the driver 233 is connected to a column driver 231 and a row driver 232. The other electrode (n-side electrode or p-side electrode) of each light-emitting element 210 is connected to a ground wire.

Control of the emission/non-emission state of each light-emitting element 210 is performed, for example, by selection of the driver 233 using the row driver 232, and a luminance signal for driving each light-emitting element 210 is supplied from the column driver 231 to the driver 233. Selection of a light-emitting element R (first light-emitting element, first subpixel R) emitting red, a light-emitting element G (second light-emitting element, second subpixel G) emitting green, a light-emitting element B (third light-emitting element, third subpixel B) emitting blue, and a light-emitting element W (fourth light-emitting element, fourth subpixel W) emitting white is performed by the driver 233. The emission/non-emission state of each of the light-emitting element R emitting red, the light-emitting element G emitting green, the light-emitting element B emitting blue, and the light-emitting element W emitting white may be controlled in a time-sharing manner. Alternatively, these elements may emit light simultaneously. Note that the emission/non-emission state of each light-emitting element is directly viewed in a direct-view image display device, or is projected on the screen through a projection lens in a projection-type image display device.

FIG. 14 is a conceptual diagram of an image display panel forming this image display device. The emission/non-emission state of each light-emitting element is directly viewed in a direct-view image display device, or is projected on the screen through a projection lens 203 in a projection-type image display device.

Alternatively, the image display panel forming the image display device of Example 3 may be a direct-view or projection-type image display panel for color display which includes a light transmission control device (light valve, and specifically, for example, a liquid crystal display including a high-temperature polysilicon-type thin film transistor. The same applies to the following examples.) for controlling transmission/non-transmission of light emitted from light-emitting element units arranged in a two-dimensional matrix, controls the emission/non-emission state of each of the first light-emitting element, the second light-emitting element, the third light-emitting element, and the fourth light-emitting element in a light-emitting element unit in a time-sharing manner, and further controls transmission/non-transmission of light emitted from the first light-emitting element, the second light-emitting element, the third light-emitting element, and the fourth light-emitting element using the light transmission control device to display an image.

In Example 3, it should suffice that an output signal which controls the emission state of each of the first light-emitting element (first subpixel R), the second light-emitting element (second subpixel G), the third light-emitting element (third subpixel B), and the fourth light-emitting element (fourth subpixel W) is obtained through the expansion process described in Example 1. If the image display device is driven on the basis of the values $X_{1-(p,q)}$, $X_{2-(p,q)}$, $X_{3-(p,q)}$, and $X_{4-(p,q)}$ of the output signals obtained through the expansion process, it is possible to increase the luminance $\alpha_{i-0}$ times as the entire image display device. Accordingly, if the emission luminance of the first light-emitting element (first subpixel R), the second light-emitting element (second subpixel G), the third light-emitting element (third subpixel B), and the fourth light-emitting element (fourth subpixel W) is $(1/\alpha'_{i-0})$ times on the basis of the values $X_{1-(p,q)}$, $X_{2-(p,q)}$, $X_{3-(p,q)}$, and $X_{4-(p,q)}$ of the output signals, it is possible to achieve reduction in power consumption as the entire image display device without being accompanied by deterioration in image quality.

Example 4

Example 4 relates to a method of driving an image display device according to the second embodiment of the present disclosure.

Figure 15:
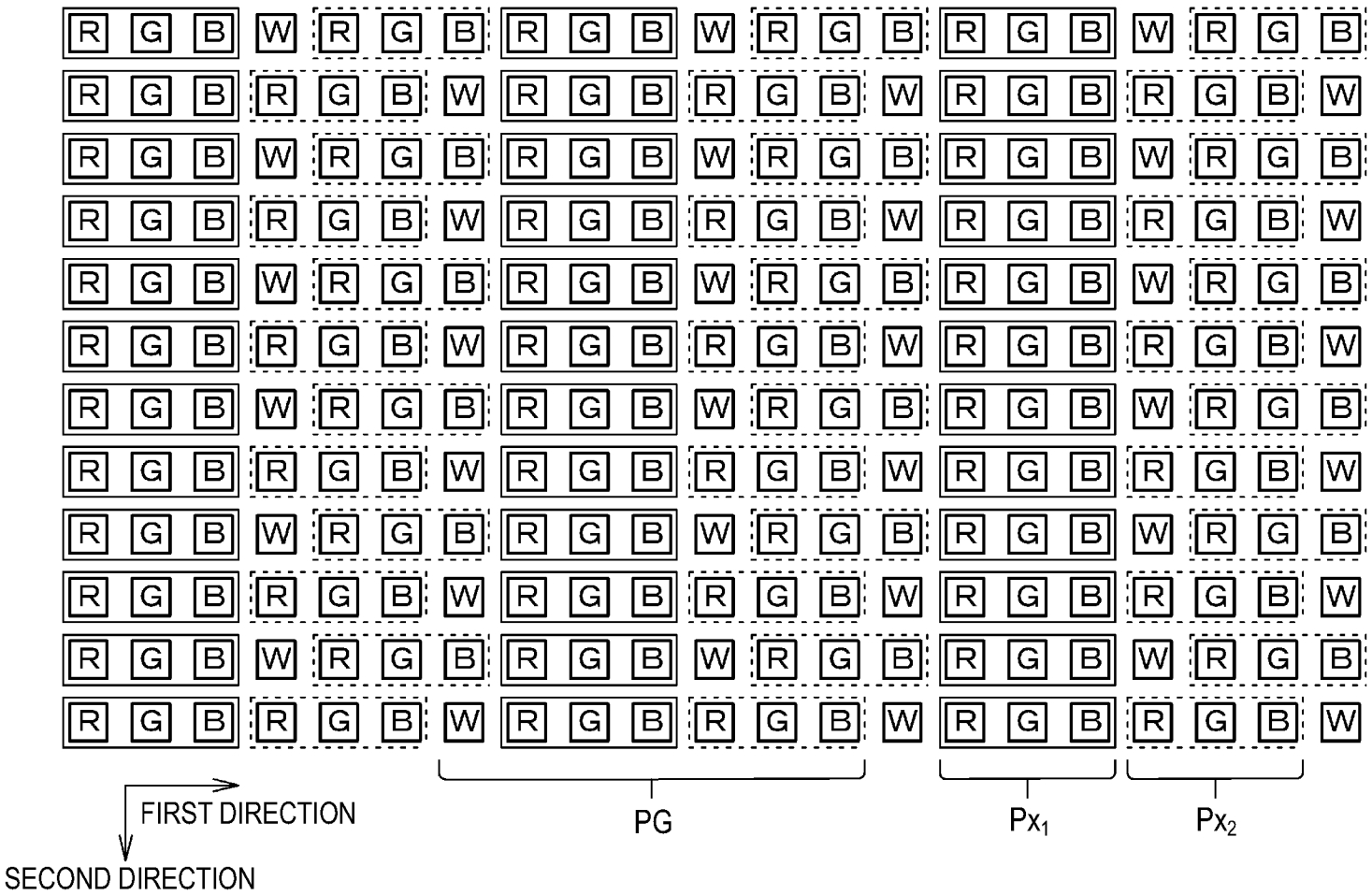
FIG. 15 is a diagram schematically showing the layout of pixels and pixel groups in an image display panel of Example 4.
Figure 16:
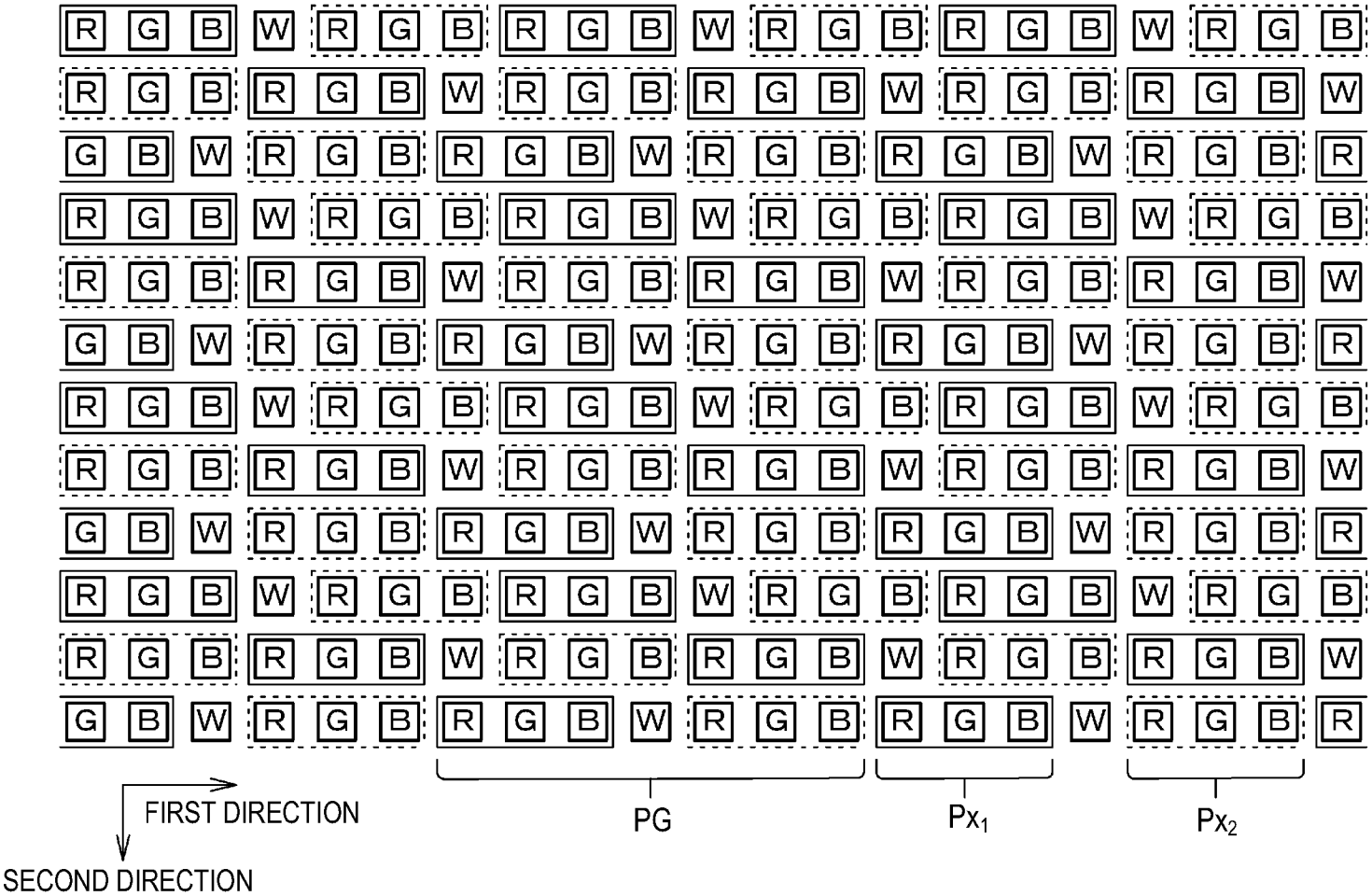
FIG. 16 is a diagram schematically showing the layout of pixels and pixel groups in an image display panel of Example 5.
Figure 18:
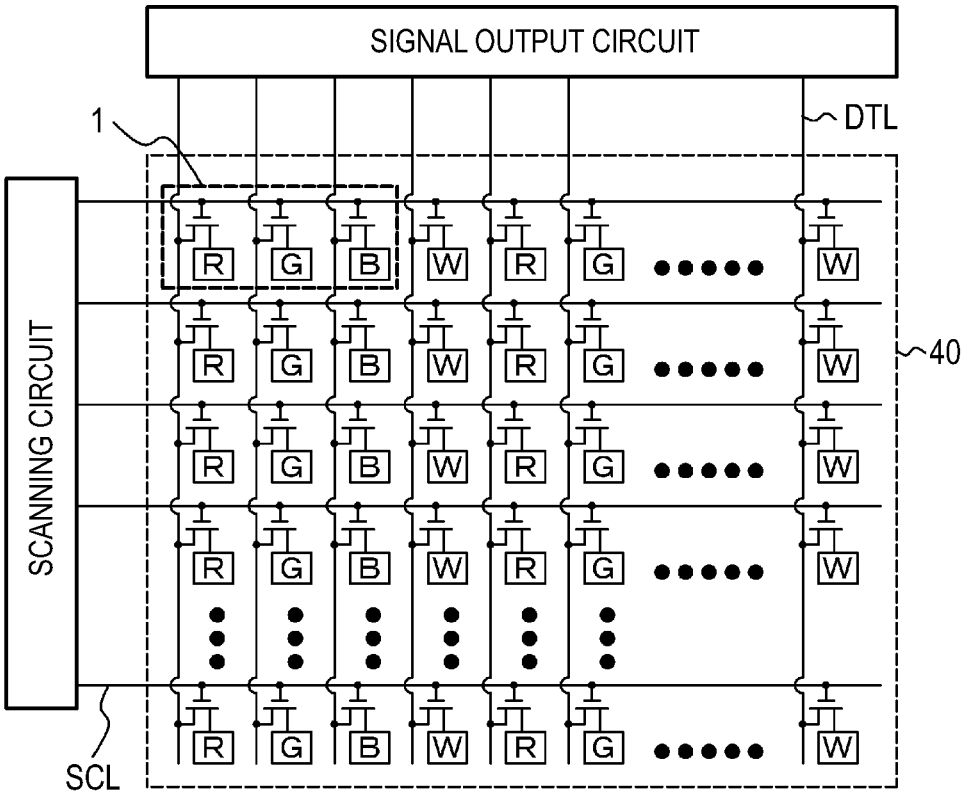
FIG. 18 is a conceptual diagram of an image display panel and an image display panel driving circuit in the image display device of Example 4.

As schematically shown in the layout of pixels in FIG. 15, in an image display panel 30 of Example 4, pixels Px each having a first subpixel R displaying a first primary color (for example, red), a second subpixel G displaying a second primary color (for example, green), and a third subpixel B displaying a third primary color (for example, blue) are arranged in a two-dimensional matrix in the first direction and the second direction. At least a first pixel $Px_1$ and a second pixel $Px_2$ arranged in the first direction form a pixel group PG. Note that, in Example 4, specifically, the pixel group PG has the first pixel $Px_1$ and the second pixel $Px_2$, and when the number of pixels forming the pixel group PG is $p_0$, $p_0=2$. In each pixel group PG, a fourth subpixel W displaying a fourth color (in Example 4, specifically, white) is disposed between the first pixel $Px_1$ and the second pixel $Px_2$. Note that, although for convenience, FIG. 18 shows a conceptual diagram of the layout of pixels, the layout shown in FIG. 18 is the layout of pixels in Example 6 described below.

Here, if a positive number P is the number of pixel groups PG in the first direction, and a positive number Q is the number of pixel groups PG in the second direction, more specifically, P×Q pixels Px [($p_0$×P) pixels in the horizontal direction which is the first direction and Q pixels in the vertical direction which is the second direction] are arranged in a two-dimensional matrix. In Example 4, as described above, $p_0=2$ in each pixel group PG.

In Example 4, when the first direction is the row direction, and the second direction is the column direction, a first pixel $Px_1$ in a q'-th column (where $1 \le q' \le Q-1$) and a first pixel $Px_1$ in a (q'+1)th column are adjacent to each other, and a fourth subpixel W in the q'-th column and a fourth subpixel W in the (q'+1)th column are not adjacent to each other. That is, the second pixel $Px_2$ and the fourth subpixel W are arranged alternately in the second direction. Note that, in FIG. 15, a first subpixel R, a second subpixel G, and a third subpixel B forming the first pixel $Px_1$ are surrounded by a solid line, and a first subpixel R, a second subpixel G, and a third subpixel B forming the second pixel $Px_2$ is surrounded by a dotted line. The same applies to FIGS. 16, 17, 20, 21, and 22 described below. Since the second pixel $Px_2$ and the fourth subpixel W are arranged alternately in the second direction, it is possible to reliably prevent a streaked pattern from being observed in an image due to the presence of the fourth subpixel W while depending on the pixel pitch.

In Example 4, in regard to a first pixel $Px_{(p,q)-1}$ forming a (p,q)th pixel group $PG_{(p,q)}$ (where $1 \le p \le P$ and $1 \le q \le Q$), a first subpixel input signal having a signal value $x_{1-(p,q)-1}$, a second subpixel input signal having a signal value $x_{2-(p,q)-1}$, and a third subpixel input signal having a signal value $x_{3-(p,q)-1}$ are input to the signal processor 20, and in regard to a second pixel $Px_{(p,q)-2}$ forming the (p,q)th pixel group $PG_{(p,q)}$, a first subpixel input signal having a signal value $x_{1-(p,q)-2}$, a second subpixel input signal having a signal value $x_{2-(p,q)-2}$, and a third subpixel input signal having a signal value $x_{3-(p,q)-2}$ are input to the signal processor 20.

In Example 4, the signal processor 20 outputs, in regard to the first pixel $Px_{(p,q)-1}$ forming the (p,q)th pixel group $PG_{(p,q)}$, a first subpixel output signal having a signal value $X_{1-(p,q)-1}$ for determining the display gradation of the first subpixel R, a second subpixel output signal having a signal value $X_{2-(p,q)-1}$ for determining the display gradation of the second subpixel G, and a third subpixel output signal having a signal value $X_{3-(p,q)-1}$ for determining the display gradation of the third subpixel B, outputs, in regard to the second pixel $Px_{(p,q)-2}$ forming the (p,q)th pixel group $PG_{(p,q)}$, a first subpixel output signal having a signal value $X_{1-(p,q)-2}$ for determining the display gradation of the first subpixel R, a second subpixel output signal having a signal value $X_{2-(p,q)-2}$ for determining the display gradation of the second subpixel G, and a third subpixel output signal having a signal value $X_{3-(p,q)-2}$ for determining the display gradation of the third subpixel B, and outputs, in regard to the fourth subpixel W forming the (p,q)th pixel group $PG_{(p,q)}$, a fourth subpixel output signal having a signal value $X_{4-(p,q)}$ for determining the display gradation of the fourth subpixel W.

In Example 4, in the signal processor 20, in regard to the first pixel $Px_{(p,q)-1}$, the first subpixel output signal (signal value $X_{1-(p,q)-1}$) is obtained on the basis of at least the first subpixel input signal (signal value $x_{1-(p,q)-1}$) and the corrected expansion coefficient $\alpha'_{i-0}$, and output to the first subpixel R, the second subpixel output signal (signal value $X_{2-(p,q)-1}$) is obtained on the basis of at least the second subpixel input signal (signal value $x_{2-(p,q)-1}$) and the corrected expansion coefficient $\alpha'_{i-0}$, and output to the second subpixel G, and the third subpixel output signal (signal value $X_{3-(p,q)-1}$) is obtained on the basis of at least the third subpixel input signal (signal value $x_{3-(p,q)-1}$) and the corrected expansion coefficient $\alpha'_{i-0}$, and output to the third subpixel B, and in regard to the second pixel $Px_{(p,q)-2}$, the first subpixel output signal (signal value $X_{1-(p,q)-2}$) is obtained on the basis of at least the first subpixel input signal (signal value $x_{1-(p,q)-2}$) and the corrected expansion coefficient $\alpha'_{i-0}$, and output to the first subpixel R, the second subpixel output signal (signal value $X_{2-(p,q)-2}$) is obtained on the basis of at least the second subpixel input signal (signal value $x_{2-(p,q)-2}$) and the corrected expansion coefficient $\alpha'_{i-0}$, and output to the second subpixel G, and the third subpixel output signal (signal value $X_{3-(p,q)-2}$) is obtained on the basis of at least the third subpixel input signal (signal value $x_{3-(p,q)-2}$) and the corrected expansion coefficient $\alpha'_{i-0}$, and output to the third subpixel B.

In regard to the fourth subpixel W, the fourth subpixel output signal (signal value $X_{4-(p,q)}$) is obtained on the basis of the fourth subpixel control first signal (signal value $SG_{1-(p,q)}$) obtained from the first subpixel input signal (signal value $x_{1-(p,q)-1}$) the second subpixel input signal (signal value $x_{2-(p,q)-1}$), and the third subpixel input signal (signal value $x_{3-(p,q)-1}$) to the first pixel $Px_{(p,q)-1}$ and the fourth subpixel control second signal (signal value $SG_{2-(p,q)}$) obtained from the first subpixel input signal (signal value $x_{1-(p,q)-2}$), the second subpixel input signal (signal value $x_{2-(p,q)-2}$), and the third subpixel input signal (signal value $x_{3-(p,q)-2}$) to the second pixel $Px_{(p,q)-2}$, and output to the fourth subpixel W.

In Example 4, specifically, the fourth subpixel control first signal value $SG_{1-(p,q)}$ is determined on the basis of $Min_{(p,q)-1}$ and the corrected expansion coefficient $\alpha'_{i-0}$, and the fourth subpixel control second signal value $SG_{2-(p,q)}$ is determined on the basis of $Min_{(p,q)-2}$ and the corrected expansion coefficient $\alpha'_{i-0}$. More specifically, Expressions (41-1) and (41-2) based on Expressions (2-1-1) and (2-1-2) are used as the fourth subpixel control first signal value $SG_{1-(p,q)}$ and the fourth subpixel control second signal value $SG_{2-(p,q)}$.

$$SG_{1-(p,q)}=Min_{(p,q)-1}\cdot\alpha'_{i-0} \tag{41-1}$$

$$SG_{2-(p,q)}=Min_{(p,q)-2}\cdot\alpha'_{i-0} \tag{41-2}$$

In regard to the first pixel $Px_{(p,q)-1}$, while the first subpixel output signal is obtained on the basis of at least the first subpixel input signal and the corrected expansion coefficient $\alpha'_{i-0}$, the first subpixel output signal value $X_{1-(p,q)-1}$ is obtained on the basis of the first subpixel input signal value $x_{1-(p,q)-1}$, the corrected expansion coefficient $\alpha'_{i-0}$, the fourth subpixel control first signal value $SG_{1-(p,q)}$, and the constant $\chi$, that is, $$[x_{1-(p,q)-1},\alpha'_{i-0},SG_{1-(p,q)},\chi]$$

while the second subpixel output signal is obtained on the basis of at least the second subpixel input signal and the corrected expansion coefficient $\alpha'_{i-0}$, the second subpixel output signal value $X_{2-(p,q)-1}$ is obtained on the basis of the second subpixel input signal value $x_{2-(p,q)-1}$, the corrected expansion coefficient $\alpha'_{i-0}$, the fourth subpixel control first signal value $SG_{1-(p,q)}$, and the constant $\chi$, that is, $$[x_{2-(p,q)-1},\alpha'_{i-0},SG_{1-(p,q)},\chi]$$

while the third subpixel output signal is obtained on the basis of at least the third subpixel input signal and the corrected expansion coefficient $\alpha'_{i-0}$, the third subpixel output signal value $X_{3-(p,q)-1}$ is obtained on the basis of the third subpixel input signal value $x_{3-(p,q)-1}$, the corrected expansion coefficient $\alpha'_{i-0}$, the fourth subpixel control first signal value $SG_{1-(p,q)}$, and the constant $\chi$, that is, $$[x_{3-(p,q)-1},\alpha'_{i-0},SG_{1-(p,q)},\chi]$$

In regard to the second pixel $Px_{(p,q)-2}$, while the first subpixel output signal is obtained on the basis of at least the first subpixel input signal and the corrected expansion coefficient $\alpha'_{i-0}$, the first subpixel output signal value $X_{1-(p,q)-2}$ is obtained on the basis of the first subpixel input signal value $x_{1-(p,q)-2}$, the corrected expansion coefficient $\alpha'_{i-0}$, the fourth subpixel control second signal value $SG_{2-(p,q)}$, and the constant $\chi$, that is, $$[x_{1-(p,q)-2},\alpha'_{i-0},SG_{2-(p,q)},\chi]$$

while the second subpixel output signal is obtained on the basis of at least the second subpixel input signal and the corrected expansion coefficient $\alpha'_{i-0}$, the second subpixel output signal value $X_{2-(p,q)-2}$ is obtained on the basis of the second subpixel input signal value $x_{2-(p,q)-2}$, the corrected expansion coefficient $\alpha'_{i-0}$, the fourth subpixel control second signal value $SG_{2-(p,q)}$, and the constant $\chi$, that is, $$[x_{2-(p,q)-2},\alpha'_{i-0},SG_{2-(p,q)},\chi]$$

while the third subpixel output signal is obtained on the basis of at least the third subpixel input signal and the corrected expansion coefficient $\alpha'_{i-0}$, the third subpixel output signal value $X_{3-(p,q)-2}$ is obtained on the basis of the third subpixel input signal value $x_{3-(p,q)-2}$, the corrected expansion coefficient $\alpha'_{i-0}$, the fourth subpixel control second signal value $SG_{2-(p,q)}$, and the constant $\chi$, that is, $$[x_{3-(p,q)-2},\alpha'_{i-0},SG_{2-(p,q)},\chi]$$

In the signal processor 20, as described above, the output signal values $X_{1-(p,q)-1}$, $X_{2-(p,q)-1}$, $X_{3-(p,q)-1}$, $X_{1-(p,q)-2}$, $X_{2-(p,q)-2}$, and $X_{3-(p,q)-2}$ can be obtained on the basis of the corrected expansion coefficient $\alpha'_{i-0}$ and the constant $\chi$, and more specifically, can be obtained from the following expressions.

$$X_{1-(p,q)-1}=\alpha'_{i-0}\cdot x_{1-(p,q)-1}-\chi\cdot SG_{1-(p,q)} \quad (2\text{-A})$$

$$X_{2-(p,q)-1}=\alpha'_{i-0}\cdot x_{2-(p,q)-1}-\chi\cdot SG_{1-(p,q)} \quad (2\text{-B})$$

$$X_{3-(p,q)-1}=\alpha'_{i-0}\cdot x_{3-(p,q)-1}-\chi\cdot SG_{1-(p,q)} \quad (2\text{-C})$$

$$X_{1-(p,q)-2}=\alpha'_{i-0}\cdot x_{1-(p,q)-2}-\chi\cdot SG_{2-(p,q)} \quad (2\text{-D})$$

$$X_{2-(p,q)-2}=\alpha'_{i-0}\cdot x_{2-(p,q)-2}-\chi\cdot SG_{2-(p,q)} \quad (2\text{-E})$$

$$X_{3-(p,q)-2}=\alpha'_{i-0}\cdot x_{3-(p,q)-2}-\chi\cdot SG_{2-(p,q)} \quad (2\text{-F})$$

The signal value $X_{4-(p,q)}$ is obtained by Arithmetic Mean Expressions (42-1) and (42-2) based on Expression (2-11).

$$X_{4-(p,q)} = (SG_{1-(p,q)} + SG_{2-(p,q)})/(2\chi) \quad (42\text{-}1)$$

$$= (\mathrm{Min}_{(p,q)-1}\cdot\alpha'_{i-0} + \mathrm{Min}_{(p,q)-2}\cdot\alpha'_{i-0})/(2\chi) \quad (42\text{-}2)$$

Note that, on right sides of Expressions (42-1) and (42-2), division using $\chi$ is performed, but the expressions are not limited thereto.

The corrected expansion coefficient $\alpha'_{i-0}$ is determined in each image display frame. The luminance of the planar light source device 50 is decreased on the basis of the corrected expansion coefficient $\alpha'_{i-0}$. Specifically, it should suffice that the luminance of the planar light source device 50 is $(1/\alpha'_{i-0})$ times.

In Example 4, as in Example 1, the maximum value $V_{max}(S)$ of luminosity with the saturation S in the HSV color space enlarged by adding the fourth color (white) as a variable is stored in the signal processor 20. That is, with the addition of the fourth color (white), the dynamic range of luminosity in the HSV color space is widened.

Hereinafter, how to obtain the output signal values $X_{1-(p,q)-1}$, $X_{2-(p,q)-1}$, $X_{3-(p,q)-1}$, $X_{1-(p,q)-2}$, $X_{2-(p,q)-2}$, $X_{3-(p,q)-2}$, and $X_{4-(p,q)}$ in the (p,q)th pixel group $PG_{(p,q)}$ (expansion process) will be described. Note that the following process will be performed so as to maintain the ratio of the luminance of the first primary color displayed by (the first subpixel R+the fourth subpixel W), the luminance of the second primary color displayed by (the second subpixel G+the fourth subpixel W), and the luminance of the third primary color displayed by (the third subpixel B+the fourth subpixel W) over the first pixel and the second pixel, that is, in each pixel group. The following process will be performs so as to keep (maintain) color tone. The following process will be also performed so as to keep (maintain) gradation-luminance characteristic (gamma characteristic, $\gamma$ characteristic).

[Step-400]

First, in the signal processor 20, the saturation $S_i$ and the luminosity $V_i(S)$ in a plurality of pixel groups $PG_{(p,q)}$ are obtained on the basis of subpixel input signal values in a plurality of pixels. Specifically, $S_{(p,q)-1}$, $S_{(p,q)-2}$, $V(S)_{(p,q)-1}$, and $V(S)_{(p,q)-2}$ are obtained from Expressions (43-1) to (43-4) on the basis of the first subpixel input signal values $x_{1-(p,q)-1}$ and $x_{1-(p,q)-2}$, the second subpixel input signal values $x_{2-(p,q)-1}$ and $x_{2-(p,q)-2}$, and the third subpixel input signal values $x_{3-(p,q)-1}$ and $x_{3-(p,q)-2}$ to the (p,q)th pixel group $PG_{(p,q)}$. This process will be performed for all of the pixel groups $PG_{(p,q)}$.

$$S_{(p,q)-1}=(\mathrm{Max}_{(p,q)-1}-\mathrm{Min}_{(p,q)-1})/\mathrm{Max}_{(p,q)-1} \quad (43\text{-}1)$$

$$V(S)_{(p,q)-1}=\mathrm{Max}_{(p,q)-1} \quad (43\text{-}2)$$

$$S_{(p,q)-2}=(\mathrm{Max}_{(p,q)-2}-\mathrm{Min}_{(p,q)-2})/\mathrm{Max}_{(p,q)-2} \quad (43\text{-}3)$$

$$V(S)_{(p,q)-2}=\mathrm{Max}_{(p,q)-2} \quad (43\text{-}4)$$

[Step-410]

Next, in the signal processor 20, the corrected expansion coefficient $\alpha'_{i-0}$ is determined from the values of $V_{max}(S)/V_i(S)$ obtained in a plurality of pixel groups $PG_{(p,q)}$ in the same manner as in Example 1. Alternatively, the corrected expansion coefficient $\alpha'_{i-0}$ is determined from the predetermined value $\beta_{PD}$ [driving method-A], the corrected expansion coefficient $\alpha'_{i-0}$ is determined on the basis of the definitions of Expression (15-2), Expressions (16-1) to (16-5), or Expressions (17-1) to (17-6) [driving method-B, driving method-C, driving method-D], or the corrected expansion coefficient $\alpha'_{i-0}$ is determined on the basis of the definitions in the driving method-E.

[Step-420]

Thereafter, in the signal processor 20, the signal value $X_{4-(p,q)}$ in the (p,q)th pixel group $PG_{(p,q)}$ is obtained on the basis of at least the input signal values $x_{1-(p,q)-1}$, $x_{2-(p,q)-1}$, $x_{3-(p,q)-1}$, $x_{1-(p,q)-2}$, $x_{2-(p,q)-2}$, and $x_{3-(p,q)-2}$. Specifically, in Example 4, the signal value $X_{4-(p,q)}$ is determined on the basis of $\mathrm{Min}_{(p,q)-1}$, $\mathrm{Min}_{(p,q)-2}$, the corrected expansion coefficient $\alpha'_{i-0}$, and the constant $\chi$. Specifically, in Example 4, the signal value $X_{4-(p,q)}$ is obtained from the following expression.

$$X_{4-(p,q)}=(\mathrm{Min}_{(p,q)-1}\cdot\alpha'_{i-0}+\mathrm{Min}_{(p,q)-2}\cdot\alpha'_{i-0})(2\chi) \quad (42\text{-}2)$$

Note that $X_{4-(p,q)}$ is obtained for all of the P×Q pixel groups $PG_{(p,q)}$.

[Step-430]

Next, in the signal processor 20, the signal value $X_{1-(p,q)-1}$ in the (p,q)th pixel group $PG_{(p,q)}$ is obtained on the basis of the signal value $x_{1-(p,q)-1}$, the corrected expansion coefficient $\alpha'_{i-0}$, and the fourth subpixel control first signal $SG_{1-(p,q)}$, the signal value $X_{2-(p,q)-1}$ is obtained on the basis of the signal value $x_{2-(p,q)-1}$, the corrected expansion coefficient $\alpha'_{i-0}$, and the fourth subpixel control first signal $SG_{1-(p,q)}$, and the signal value $X_{3-(p,q)-1}$ is obtained on the basis of the signal value $x_{3-(p,q)-1}$, the corrected expansion coefficient $\alpha'_{i-0}$, and the fourth subpixel control first signal $SG_{1-(p,q)}$. Similarly, the signal value $X_{1-(p,q)-2}$ is obtained on the basis of the signal value $x_{1-(p,q)-2}$ the corrected expansion coefficient $\alpha'_{i-0}$, and the fourth subpixel control second signal $SG_{2-(p,q)}$, the signal value $X_{2-(p,q)-2}$ is obtained on the basis of the signal value $x_{2-(p,q)-2}$ the corrected expansion coefficient $\alpha'_{i-0}$, and the fourth subpixel control second signal $SG_{2-(p,q)}$, and the signal value $X_{3-(p,q)-2}$ is obtained on the basis of the signal value $x_{3-(p,q)-2}$, the corrected expansion coefficient $\alpha'_{i-0}$, and the fourth subpixel control second signal $SG_{2-(p,q)}$. Note that [Step-420] and [Step-430] may be performed simultaneously or [Step-420] may be performed after [Step-430] has been performed.

Specifically, the output signal values $X_{1-(p,q)-1}$, $X_{2-(p,q)-1}$, $X_{3-(p,q)-1}$, $X_{1-(p,q)-2}$, $X_{2-(p,q)-2}$, and $X_{3-(p,q)-2}$ in the (p,q)th pixel group $PG_{(p,q)}$ are obtained from Expressions (2-A) to (2-F).

The important point is, as shown in Expressions (41-1), (41-2), and (42-2), that the values of $\mathrm{Min}_{(p,q)-1}$ and $\mathrm{Min}_{(p,q)-2}$ are expanded by the corrected expansion coefficient $\alpha'_{i-0}$. In this way, the values of $\mathrm{Min}_{(p,q)-1}$ and $\mathrm{Min}_{(p,q)-2}$ are expanded by the corrected expansion coefficient $\alpha'_{i-0}$, and accordingly, not only the luminance of the white display subpixel (fourth subpixel W) but also the luminance of the red display subpixel, the green display subpixel, and the blue display subpixel (first subpixel R, second subpixel G, and third subpixel B) are increased as shown in Expressions (2-A) to (2-F). For this reason, it is possible to reliably prevent the occurrence of a problem in that color dullness occurs. That is, if the values of $\mathrm{Min}_{(p,q)-1}$ and $\mathrm{Min}_{(p,q)-2}$ are expanded by the corrected expansion coefficient $\alpha'_{i-0}$, the luminance is expanded $\alpha'_{i-0}$ times over the entire image compared to a case where the values of $Min_{(p,q)-1}$ and $Min_{(p,q)-2}$ are not expanded. Accordingly, it should suffice that the luminance of the planar light source device 50 is $(1/\alpha'_{i-0})$ times.

Figure 19:
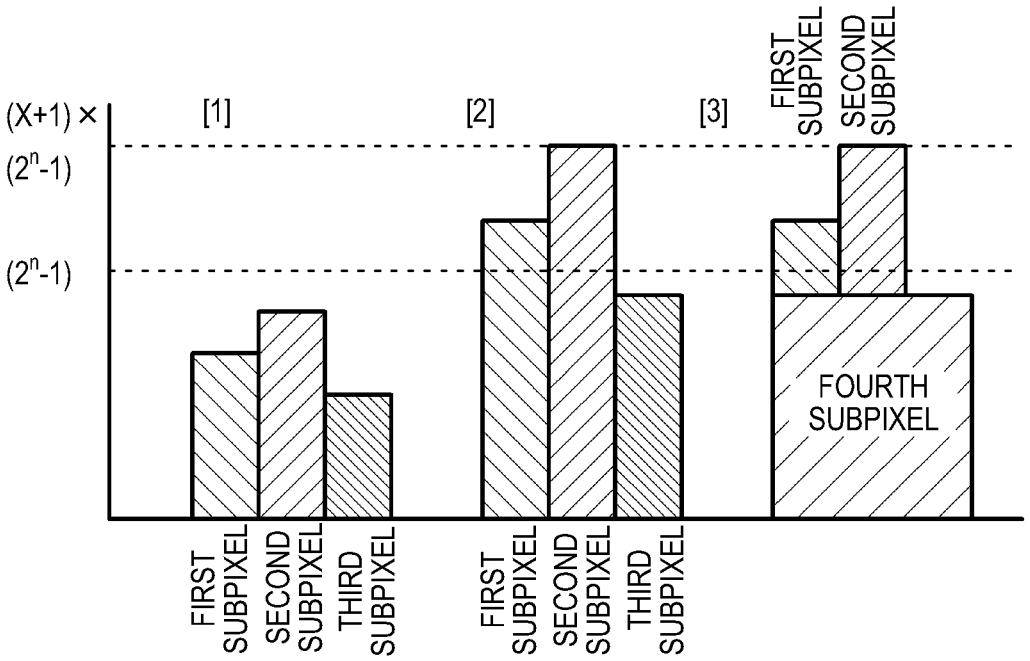
FIG. 19 is a diagram schematically showing an input signal value and an output signal value in an expansion process in a method of driving an image display device of Example 4.

The expansion process in the method of driving an image display device of Example 4 will be described with reference to FIG. 19. FIG. 19 is a diagram schematically showing input signal values and output signal values. In FIG. 19, the input signal values of a set of a first subpixel R, a second subpixel G, and a third subpixel B are shown in [1]. A state in which the expansion process is being performed (an operation to obtain the product of the input signal value and the corrected expansion coefficient $\alpha'_{i-0}$) is shown in [2]. A state after the expansion process has been performed (a state in which the output signal values $X_{1-(p,q)-1}$, $X_{2-(p,q)-1}$, $X_{3-(p,q)-1}$, and $X_{4-(p,q)}$ are obtained) is shown in [3]. In the example shown in FIG. 19, the maximum realizable luminance is obtained in the second subpixel G.

In the method of driving an image display device of Example 4, in the signal processor 20, the fourth subpixel output signal is obtained on the basis of the fourth subpixel control first signal value $SG_{1-(p,q)}$ and the fourth subpixel control second signal value $SG_{2-(p,q)}$ obtained from the first subpixel input signal, the second subpixel input signal, and the third subpixel input signal to the first pixel $Px_1$ and the second pixel $Px_2$ of each pixel group PG and output. That is, since the fourth subpixel output signal is obtained on the basis of the input signals of adjacent first and second pixels pixel $Px_1$ and $Px_2$, the optimization of the output signal to the fourth subpixel W is achieved. Since one fourth subpixel W is disposed for a pixel group PG having at least the first pixel $Px_1$ and the second pixel $Px_2$, it is possible to suppress a decrease in the area of the opening region for the subpixels. As a result, it is possible to reliably achieve an increase in luminance, making it possible to achieve improvement in display quality and to reduce power consumption in the planar light source device.

For example, if the length of a pixel in the first direction is $L_1$, according to the technique described in Japanese Patent No. 3167026 or Japanese Patent No. 3805150, since one pixel should be divided into four subpixels, the length of one subpixel in the first direction is $(L_1/4=0.25L_1)$. Meanwhile, in Example 4, the length of one subpixel in the first direction is $(2L_1/7=0.286L_1)$. Accordingly, the length of one subpixel in the first direction increases 14% compared to the technique described in Japanese Patent No. 3167026 or Japanese Patent No. 3805150.

Note that, in Example 4, the signal values $X_{1-(p,q)-1}$, $X_{2-(p,q)-1}$, $X_{3-(p,q)-1}$, $X_{1-(p,q)-2}$, $X_{2-(p,q)-2}$, and $X_{3-(p,q)-2}$ can be obtained from the following expressions.

$$[x_{1-(p,q)-1}, x_{1-(p,q)-2}, \alpha'_{i-0}, SG_{1-(p,q)}, \chi]$$

$$[x_{2-(p,q)-1}, x_{2-(p,q)-2}, \alpha'_{i-0}, SG_{1-(p,q)}, \chi]$$

$$[x_{3-(p,q)-1}, x_{3-(p,q)-2}, \alpha'_{i-0}, SG_{1-(p,q)}, \chi]$$

$$[x_{1-(p,q)-1}, x_{1-(p,q)-2}, \alpha'_{i-0}, SG_{2-(p,q)}, \chi]$$

$$[x_{2-(p,q)-1}, x_{2-(p,q)-2}, \alpha'_{i-0}, SG_{2-(p,q)}, \chi]$$

$$[x_{3-(p,q)-1}, x_{3-(p,q)-2}, \alpha'_{i-0}, SG_{2-(p,q)}, \chi]$$

Example 5

Example 5 is a modification of Example 4. In Example 5, the arrangement state of a first pixel, a second pixel, and a fourth subpixel W is changed. That is, in Example 5, as schematically shown in the layout of pixels in FIG. 16, when the first direction is the row direction, and the second direction is the column direction, a configuration can be made in which a first pixel $Px_1$ in a q'-th column (where $1 \le q' \le Q-1$) and a second pixel $Px_2$ in (q'+1)th column are adjacent to each other, and a fourth subpixel W in the q'-th column and a fourth subpixel W in the (q'+1)th column are not adjacent to each other.

Except for this point, the method of driving an image display device of Example 5 can be the same as the method of driving an image display device of Example 4, thus detailed description will not be repeated.

Example 6

Figure 17:
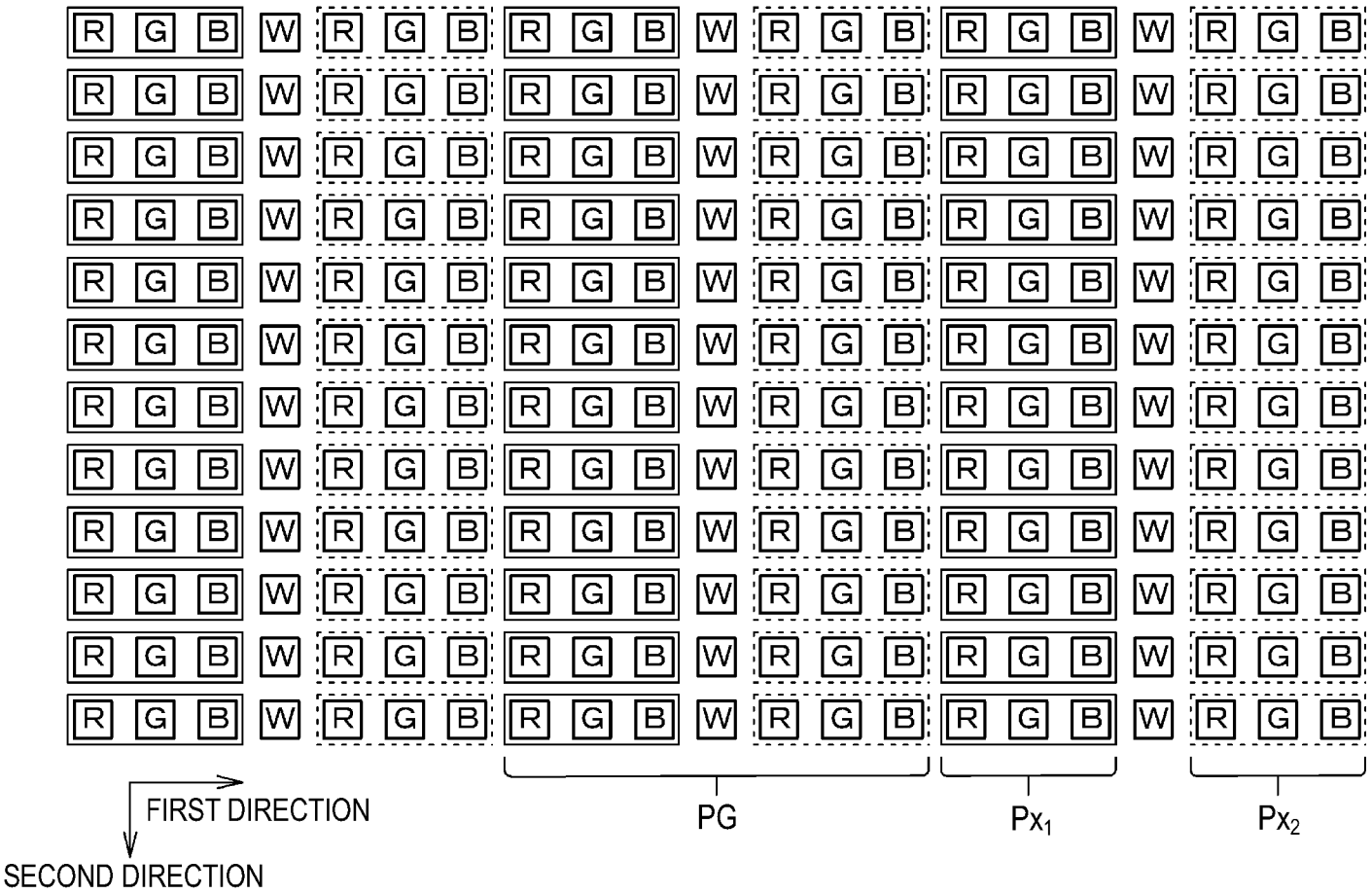
FIG. 17 is a diagram schematically showing the layout of pixels and pixel groups in an image display panel of Example 6.

Example 6 is also a modification of Example 4. In Example 6, the arrangement state of a first pixel, a second pixel, and a fourth subpixel W is changed. That is, in Example 6, as schematically shown in the layout of pixels in FIG. 17, when the first direction is the row direction, and the second direction is the column direction, a first pixel $Px_1$ in a q'-th column (where $1 \le q' \le Q-1$) and a first pixel $Px_1$ in a (q'+1)th column are adjacent to each other, and a fourth subpixel W in the q'-th column and a fourth subpixel W in the (q'+1)th column are adjacent to each other. In the example of FIGS. 15 and 17, the first subpixel R, the second subpixel G, the third subpixel B, and the fourth subpixel W are arranged in an arrangement similar to a stripe arrangement.

Except for this point, the method of driving an image display device of Example 6 can be the same as the method of driving an image display device of Example 4, thus detailed description will not be repeated.

Example 7

Figure 20:
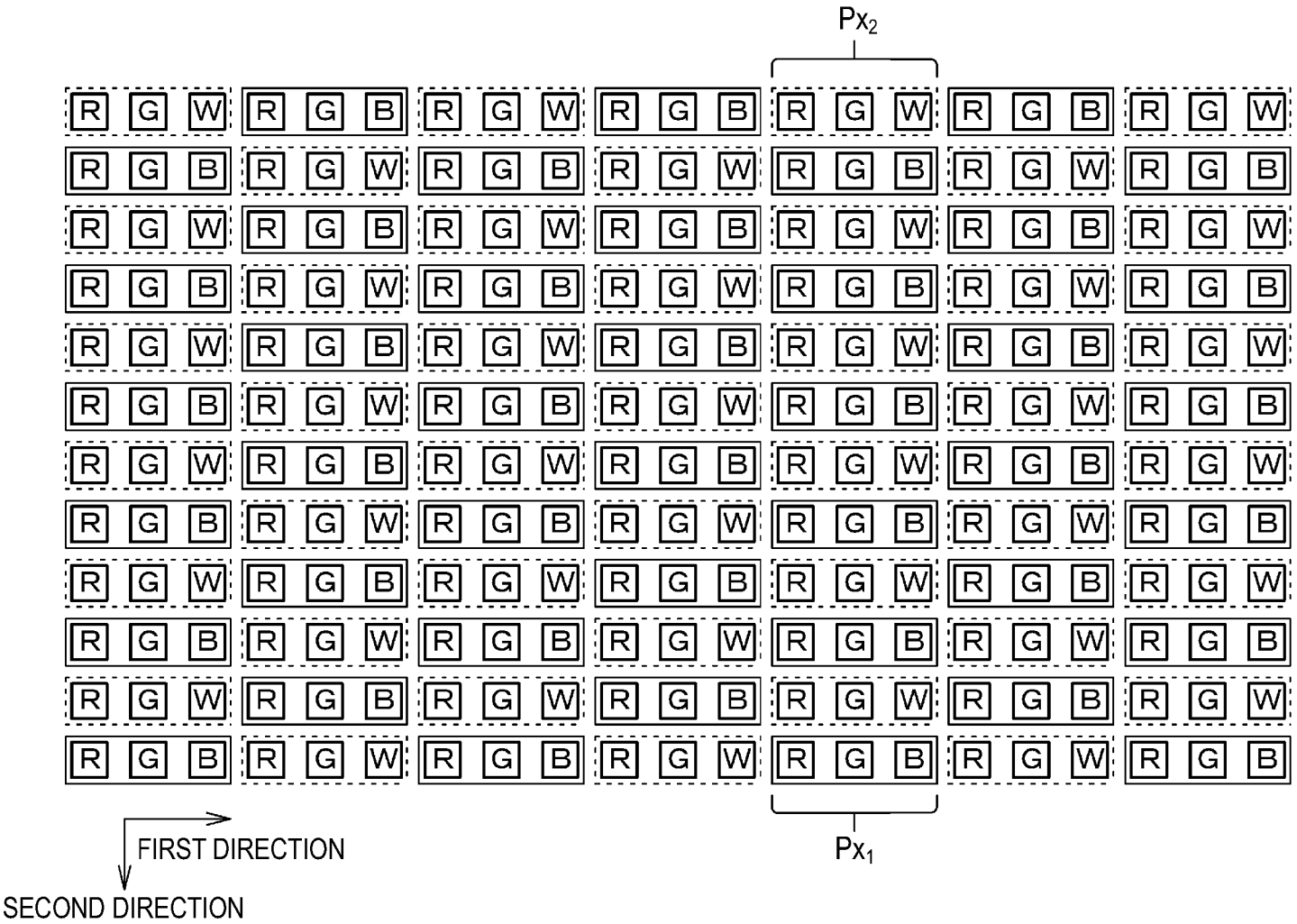
FIG. 20 is a diagram schematically showing the layout of pixels and pixel groups in an image display panel of Example 7, 8, or 10.
Figure 21:
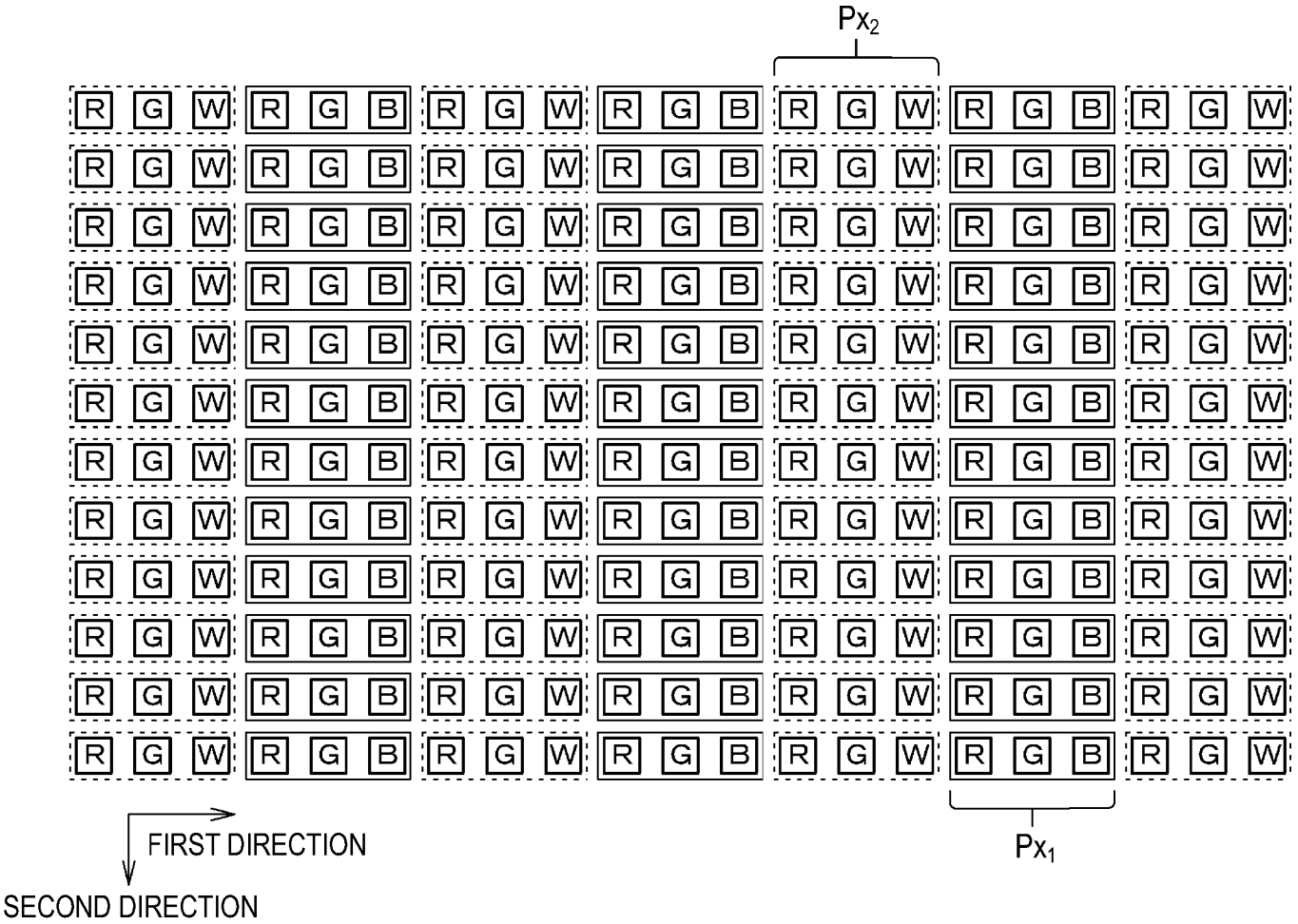
FIG. 21 is a diagram schematically showing another example of the layout of pixels and pixel groups in the image display panel of Example 7, 8, or 10.

Example 7 relates to a method of driving an image display device according to the third embodiment of the present disclosure. FIGS. 20 and 21 schematically show the layout of pixels and pixel groups in an image display panel of Example 7.

In Example 7, an image display panel is provided in which P×Q pixel groups PG in total of P pixel groups in the first direction and Q pixel groups in the second direction are arranged in a two-dimensional matrix. Each pixel group PG has a first pixel and a second pixel in the first direction. A first pixel $Px_1$ has a first subpixel R displaying a first primary color (for example, red), a second subpixel G displaying a second primary color (for example, green), and a third subpixel B displaying a third primary color (for example, blue). A second pixel $Px_2$ has a first subpixel R displaying a first primary color (for example, red), a second subpixel G displaying a second primary color (for example, green), and a fourth subpixel W displaying a fourth color (for example, white). More specifically, a first pixel $Px_1$ has a first subpixel R displaying a first primary color, a second subpixel G displaying a second primary color, and a third subpixel B displaying a third primary color sequentially arranged in the first direction. A second pixel $Px_2$ has a first subpixel R displaying a first primary color, a second subpixel G displaying a second primary color, and a fourth subpixel W displaying a fourth color sequentially arranged in the first direction. The third subpixel B forming the first pixel $Px_1$ and the first subpixel R forming the second pixel $Px_2$ are adjacent to each other. The fourth subpixel W forming the second pixel $Px_2$ and the first subpixel R forming a first pixel $Px_1$ in a pixel group adjacent to this pixel group are adjacent to each other. Note that the shape of a subpixel is a rectangle, and the subpixel is disposed such that the long side of the rectangle is parallel to the second direction and the short side of the rectangle is parallel to the first direction.

Note that, in Example 7, a third subpixel B is a subpixel displaying blue. This is because the visibility of blue is about 1/6 compared to the visibility of green, and even when the number of subpixels displaying blue in a pixel group is half, no great problem occurs. The same applies to Examples 8 and 10 described below.

The image display device of Example 7 can be the same as the image display device described in Examples 1 to 3. That is, the image display device 10 of Example 7 also includes, for example, an image display panel and a signal processor 20. The image display device of the Example 7 also includes, for example, a planar light source device 50 which illuminates the image display device (specifically, image display panel) from the rear. The signal processor 20 and the planar light source device 50 of Example 7 can be the same as the signal processor 20 and the planar light source device 50 described in Example 1. The same applies to various examples described below.

In Example 7, in regard to the first pixel $Px_{(p,q)-1}$, a first subpixel input signal having a signal value $x_{1-(p,q)-1}$, a second subpixel input signal having a signal value $x_{2-(p,q)-1}$, and a third subpixel input signal having a signal value $x_{3-(p,q)-1}$ are input to the signal processor 20, and in regard to the second pixel $Px_{(p,q)-2}$, a first subpixel input signal having a signal value $x_{1-(p,q)-2}$, a second subpixel input signal having a signal value $x_{2-(p,q)-2}$, and a third subpixel input signal having a signal value $x_{3-(p,q)-2}$ are input to the signal processor 20.

The signal processor 20 outputs, in regard to the first pixel $Px_{(p,q)-1}$, a first subpixel output signal having a signal value $X_{1-(p,q)-1}$ for determining the display gradation of the first subpixel R, a second subpixel output signal having a signal value $X_{2-(p,q)-1}$ for determining the display gradation of the second subpixel G, and a third subpixel output signal having a signal value $X_{3-(p,q)-1}$ for determining the display gradation of the third subpixel B, outputs, in regard to the second pixel $Px_{(p,q)-2}$, a first subpixel output signal having a signal value $X_{1-(p,q)-2}$ for determining the display gradation of the first subpixel R, and a second subpixel output signal having a signal value $X_{2-(p,q)-2}$ for determining the display gradation of the second subpixel G, and outputs, in regard to the fourth subpixel W, a fourth subpixel output signal having a signal value $X_{4-(p,q)-2}$ for determining the display gradation of the fourth subpixel W.

In the signal processor 20, a third subpixel output signal (signal value $X_{3-(p,q)-1}$) to a (p,q)th [where p=1, 2, . . . , and P, and q=1, 2, . . . , and Q] first pixel when counting in the first direction is obtained on the basis of at least a third subpixel input signal (signal value $X_{3-(p,q)-1}$) to the (p,q)th first pixel and a third subpixel input signal (signal value $x_{3-(p,q)-2}$) to a (p,q)th second pixel, and output to the third subpixel B of the (p,q)th first pixel. A fourth subpixel output signal (signal value $X_{4-(p,q)-2}$) to the (p,q)th second pixel is obtained on the basis of the fourth subpixel control second signal (signal value $SG_{2-(p,q)}$) obtained from a first subpixel input signal (signal value $x_{1-(p,q)-2}$), a second subpixel input signal (signal value $x_{2-(p,q)-2}$), and a third subpixel input signal (signal value $x_{3-(p,q)-2}$) to the (p,q)th second pixel and a fourth subpixel control first signal (signal value $SG_{1-(p,q)}$) obtained from a first subpixel input signal, a second subpixel input signal, and a third subpixel input signal to an adjacent pixel adjacent to the (p,q)th second pixel in the first direction, and output to the fourth subpixel W of the (p,q)th second pixel.

Here, while an adjacent pixel is adjacent to the (p,q)th second pixel in the first direction, in Example 7, specifically, an adjacent pixel is the (p,q)th first pixel. Accordingly, the fourth subpixel control first signal (signal value $SG_{1-(p,q)}$) is obtained on the basis of the first subpixel input signal (signal value $x_{1-(p,q)-1}$), the second subpixel input signal (signal value $x_{2-(p,q)-1}$), and the third subpixel input signal (signal value $x_{3-(p,q)-1}$).

Note that, in regard to the arrangement of first pixels and second pixels, P×Q pixel groups PG in total of P pixel groups in the first direction and Q pixel groups in the second direction are arranged in a two-dimensional matrix, and as shown in FIG. 20, a configuration in which a first pixel $Px_1$ and a second pixel $Px_2$ are disposed to be adjacent to each other in the second direction may be used. Alternatively, as shown in FIG. 21, a configuration in which a first pixel $Px_1$ and a first pixel $Px_1$ are disposed to be adjacent to each other in the second direction, and a second pixel $Px_2$ and a second pixel $Px_2$ are disposed to be adjacent to each other in the second direction may be used.

In Example 7, specifically, the fourth subpixel control first signal $SG_{1-(p,q)}$ is determined on the basis of $Min_{(p,q)-1}$ and the corrected expansion coefficient $\alpha'_{i-0}$, and the fourth subpixel control second signal $SG_{2-(p,q)}$ is determined on the basis of $Min_{(p,q)-2}$ and the corrected expansion coefficient $\alpha'_{i-0}$. More specifically, as in Example 4, Expressions (41-1) and (41-2) are used as the fourth subpixel control first signal $SG_{1-(p,q)}$ and the fourth subpixel control second signal $SG_{2-(p,q)}$.

$$SG_{1-(p,q)}=Min_{(p,q)-1}\cdot\alpha'_{i-0} \tag{41-1}$$

$$SG_{2-(p,q)}=Min_{(p,q)-2}\cdot\alpha'_{i-0} \tag{41-2}$$

In regard to a second pixel $Px_{(p,q)-2}$, while the first subpixel output signal is obtained on the basis of at least the first subpixel input signal and the corrected expansion coefficient $\alpha'_{i-0}$, the first subpixel output signal value $X_{1-(p,q)-2}$ is obtained on the basis of the first subpixel input signal value $X_{1-(p,q)-2}$, the corrected expansion coefficient $\alpha'_{i-0}$, the fourth subpixel control second signal value $SG_{2-(p,q)}$, and the constant $\chi$, that is, $$[x_{1-(p,q)-2},\alpha'_{i-0},SG_{2-(p,q)},\chi]$$

while the second subpixel output signal is obtained on the basis of at least the second subpixel input signal and the corrected expansion coefficient $\alpha'_{i-0}$, the second subpixel output signal value $X_{2-(p,q)-2}$ is obtained on the basis of the second subpixel input signal value $x_{2-(p,q)-2}$, the corrected expansion coefficient $\alpha'_{i-0}$, the fourth subpixel control second signal value $SG_{2-(p,q)}$, and the constant $\chi$, that is, $$[x_{2-(p,q)-2},\alpha'_{i-0},SG_{2-(p,q)},\chi]$$

In regard to a first pixel $Px_{(p,q)-1}$, while the first subpixel output signal is obtained on the basis of at least the first subpixel input signal and the corrected expansion coefficient $\alpha'_{i-0}$, the first subpixel output signal value $X_{1-(p,q)-1}$ is obtained on the basis of the first subpixel input signal value $x_{1-(p,q)-1}$, the corrected expansion coefficient $\alpha'_{i-0}$, the fourth subpixel control first signal value $SG_{1-(p,q)}$, and the constant $\chi$, that is, $$[x_{1-(p,q)-1},\alpha'_{i-0},SG_{1-(p,q)},\chi]$$

while the second subpixel output signal is obtained on the basis of at least the second subpixel input signal and the corrected expansion coefficient $\alpha'_{i-0}$, the second subpixel output signal value $X_{2-(p,q)-1}$ is obtained on the basis of the second subpixel input signal value $x_{2-(p,q)-1}$, the corrected expansion coefficient $\alpha'_{i-0}$, the fourth subpixel control first signal value $SG_{1-(p,q)}$, and the constant $\chi$, that is, $$[x_{2-(p,q)-1}, \alpha'_{i-0}, SG_{1-(p,q)}, \chi]$$

while the third subpixel output signal is obtained on the basis of at least the third subpixel input signal and the corrected expansion coefficient $\alpha'_{i-0}$, the third subpixel output signal value $X_{3-(p,q)-1}$ is obtained on the basis of the third subpixel input signal value $x_{3-(p,q)-1}$, $x_{3-(p,q)-2}$, the corrected expansion coefficient $\alpha'_{i-0}$, the fourth subpixel control first signal value $SG_{1-(p,q)}$, the fourth subpixel control second signal value $SG_{2-(p,q)}$, and the constant $\chi$, that is, $$[x_{3-(p,q)-1}, x_{3-(p,q)-2}, \alpha'_{i-0}, SG_{1-(p,q)}, SG_{2-(p,q)}, X_{4-(p,q)-2}, \chi]$$

Specifically, in the signal processor 20, the output signal values $X_{1-(p,q)-2}$, $X_{2-(p,q)-2}$, $X_{1-(p,q)-1}$, $X_{2-(p,q)-1}$, and $X_{3-(p,q)-1}$ can be obtained on the basis of the corrected expansion coefficient $\alpha'_{i-0}$ and the constant $\chi$, and more specifically, can be obtained from Expressions (3-A) to (3-D), (3-a'), (3-d), and (3-e).

$$X_{1-(p,q)-2}=\alpha'_{i-0}\cdot x_{1-(p,q)-2}-\chi\cdot SG_{2-(p,q)} \quad (3\text{-A})$$

$$X_{2-(p,q)-2}=\alpha'_{i-0}\cdot x_{2-(p,q)-2}-\chi\cdot SG_{2-(p,q)} \quad (3\text{-B})$$

$$X_{1-(p,q)-1}=\alpha'_{i-0}\cdot x_{1-(p,q)-1}-\chi\cdot SG_{1-(p,q)} \quad (3\text{-C})$$

$$X_{2-(p,q)-1}=\alpha'_{i-0}\cdot x_{2-(p,q)-1}-\chi\cdot SG_{1-(p,q)} \quad (3\text{-D})$$

$$X_{3-(p,q)-1}=(X'_{3-(p,q)-1}+X'_{3-(p,q)-2})/2 \quad (3\text{-a}')$$

Here, $$X'_{3-(p,q)-1}=\alpha'_{i-0}\cdot x_{3-(p,q)-1}-\chi\cdot SG_{1-(p,q)} \quad (3\text{-d})$$

$$X'_{3-(p,q)-2}=\alpha'_{i-0}\cdot x_{3-(p,q)-2}-\chi\cdot SG_{2-(p,q)} \quad (3\text{-e})$$

The signal value $X_{4-(p,q)-2}$ is obtained from Arithmetic Mean Expression, that is, as in Example 4, from Expressions (71-1) and (71-2) similar to Expressions (42-1) and (42-2).

$$X_{4-(p,q)-2}=(SG_{1-(p,q)}+SG_{2-(p,q)})/(2\chi) \quad (71\text{-1})$$

$$=(\mathrm{Min}_{(p,q)-1}\cdot\alpha'_{i-0}+\mathrm{Min}_{(p,q)-2}\cdot\alpha'_{i-0})/(2\chi) \quad (71\text{-2})$$

The corrected expansion coefficient $\alpha'_{i-0}$ is determined in each image display frame.

In Example 7, the maximum value $V_{max}(S)$ of luminosity with the saturation S in the HSV color space enlarged by adding the fourth color (white) as a variable is stored in the signal processor 20. That is, with the addition of the fourth color (white), the dynamic range of luminosity in the HSV color space is widened.

Hereinafter, how to obtain the output signal values $X_{1-(p,q)-2}$, $X_{2-(p,q)-2}$, $X_{4-(p,q)-2}$, $X_{1-(p,q)-1}$, $X_{2-(p,q)-1}$, and $X_{3-(p,q)-1}$ in the (p,q)th pixel group $PG_{(p,q)}$ (expansion process) will be described. Note that, as in Example 4, the following process is performed so as to maintain the luminance ratio as much as possible over the first pixel and the second pixel, that is, in each pixel group. The following process will be performs so as to keep (maintain) color tone. The following process will be performed so as to keep (maintain) gradation-luminance characteristic (gamma characteristic, γ characteristic).

[Step-700]

First, in the same manner as in [Step-400] of Example 4, in the signal processor 20, the saturation $S_i$ and the luminosity $V_i(S)$ in a plurality of pixel group $PG_{(p,q)}$ are obtained on the basis of the subpixel input signal values in plurality of pixels. Specifically, $S_{(p,q)-1}$, $S_{(p,q)-2}$, $V(S)_{(p,q)-1}$, and $V(S)_{(p,q)-2}$ are obtained from Expressions (43-1) to (43-4) on the basis of the first subpixel input signal values $x_{1-(p,q)-1}$ and $x_{1-(p,q)-2}$, the second subpixel input signal values $x_{2-(p,q)-1}$ and $x_{2-(p,q)-2}$, and the third subpixel input signal values $x_{3-(p,q)-1}$ and $x_{3-(p,q)-2}$ to the (p,q)th pixel group $PG_{(p,q)}$. This process will be performed for all of the pixel groups $PG_{(p,q)}$.

[Step-710]

Next, in the signal processor 20, the corrected expansion coefficient $\alpha'_{i-0}$ is determined from the values of $V_{max}(S)/V_i(S)$ obtained in a plurality of pixel groups $PG_{(p,q)}$ in the same manner as in Example 1. Alternatively, the corrected expansion coefficient $\alpha'_{i-0}$ is determined from the predetermined value $\beta_{PD}$ [driving method-A], corrected expansion coefficient $\alpha'_{i-0}$ is determined on the basis of the definitions of Expression (15-2), Expressions (16-1) to (16-5), or Expressions (17-1) to (17-6) [driving method-B, driving method-C, driving method-D], or the corrected expansion coefficient $\alpha'_{i-0}$ is determined on the basis of the definitions in the driving method-E.

[Step-720]

Thereafter, in the signal processor 20, the fourth subpixel control first signal $SG_{1-(p,q)}$ and the fourth subpixel control second signal $SG_{2-(p,q)}$ in each pixel group $PG_{(p,q)}$ are obtained from Expressions (41-1) and (41-2). This process will be performed for all of the pixel groups $PG_{(p,q)}$. The fourth subpixel output signal value $X_{4-(p,q)-2}$ is obtained from Expression (71-2). $X_{1-(p,q)-2}$, $X_{2-(p,q)-2}$, $X_{1-(p,q)-1}$, $X_{2-(p,q)-1}$, and $X_{3-(p,q)-1}$ are obtained from Expressions (3-A) to (3-D), (3-a'), (3-d), and (3-e). This operation will be performed for all of the P×Q pixel groups $PG_{(p,q)}$. Output signal having the thus-obtained output signal values are supplied to the subpixels.

Note that, in each pixel group, the ratio of the output signal values in the first pixel and the second pixel:

$$X_{1-(p,q)-1}:X_{2-(p,q)-1}:X_{3-(p,q)-1}$$

$$X_{1-(p,q)-2}:X_{2-(p,q)-2}$$

is slightly different from the ratio of the input signal values:

$$x_{1-(p,q)-1}:x_{2-(p,q)-1}:x_{3-(p,q)-1}$$

$$x_{1-(p,q)-2}:x_{2-(p,q)-2}.$$

For this reason, while, when viewing each pixel alone, a slight difference occurs regarding the color tone of each pixel relative to an input signal, when viewing pixels as a pixel group, no problem occurs regarding the color tone of each pixel group. The same applies to the following description.

In Example 7, the important point is, as shown in Expressions (41-1), (41-2), and (71-2), that the values of $\mathrm{Min}_{(p,q)-1}$ and $\mathrm{Min}_{(p,q)-2}$ are expanded by the corrected expansion coefficient $\alpha'_{i-0}$. In this way, the values of $\mathrm{Min}_{(p,q)-1}$ and $\mathrm{Min}_{(p,q)-2}$ are expanded by the corrected expansion coefficient $\alpha'_{i-0}$, and accordingly, not only the luminance of the white display subpixel (fourth subpixel W) but also the luminance of the red display subpixel, the green display subpixel, and the blue display subpixel (first subpixel R, second subpixel G, and third subpixel B) are increased as shown in Expressions (3-A) to (3-D), and (3-a'). For this reason, it is possible to reliably prevent the occurrence of a problem in that color dullness occurs. That is, if the values of $Min_{(p,q)-1}$ and $Min_{(p,q)-2}$ are expanded by the corrected expansion coefficient $\alpha'_{i-0}$, since the luminance is $\alpha'_{i-0}$ times as the entire image compared to a case where the values of $Min_{(p,q)-1}$ and $Min_{(p,q)-2}$ are not expanded, it should suffice that the luminance of the planar light source device 50 is $(1/\alpha'_{i-0})$ times.

In the method of driving an image display device of Example 7, in the signal processor 20, the fourth subpixel output signal is obtained on the basis of the fourth subpixel control first signal $SG_{1-(p,q)}$ and the fourth subpixel control second signal $SG_{2-(p,q)}$ obtained from the first subpixel input signal, the second subpixel input signal, and the third subpixel input signal to the first pixel $Px_1$ and the second pixel $Px_2$ of each pixel group PG and output. That is, since the fourth subpixel output signal is obtained on the basis of the input signals to adjacent first pixel $Px_1$ and second pixel $Px_2$, the optimization of the output signal to the fourth subpixel W is achieved. Since one third subpixel B and one fourth subpixel W are arranged for each pixel group PG having at least the first pixel $Px_1$ and the second pixel $Px_2$, it is possible to further suppress a decrease in the area of the opening region for the subpixels. As a result, it is possible to reliably achieve an increase in luminance. It is also possible to achieve improvement in display quality.

On the other hand, when the different $Min_{(p,q)-1}$ of the first pixel $Px_{(p,q)-1}$ and the $Min_{(p,q)-2}$ of the second pixel $Px_{(p,q)-2}$ is great, if Expression (71-2) is used, the luminance of the fourth subpixel W may not increase up to a desired level. In this case, it is desirable to obtain the signal value $X_{4-(p,q)-2}$ using Expression (2-12), (2-13), or (2-14) instead of Expression (71-2). What kind of expression is used to obtain $X_{4-(p,q)-2}$ may be appropriately determined by experimentally manufacturing an image display device and performing image evaluation by an image observer, for example.

The relationship between input signals and output signals in a pixel group according to Example 7 described above and Example 8 described below is shown in Table 3.

TABLE 3

| | Pixel Group | | | | | | | |
|---|---|---|---|---|---|---|---|---|
| | (p,q) | | (p + 1,q) | | (p + 2,q) | | (p + 3,q) | |
| | Pixel | | | | | | | |
| | First Pixel | Second Pixel | First Pixel | Second Pixel | First Pixel | Second Pixel | First Pixel | Second Pixel |
| | Example 7 | | | | | | | |
| Input Signal | $X_{1-(p,q)-1}$ | $X_{1-(p,q)-2}$ | $X_{1-(p+1,q)-1}$ | $X_{1-(p+1,q)-2}$ | $X_{1-(p+2,q)-1}$ | $X_{1-(p+2,q)-2}$ | $X_{1-(p+3,q)-1}$ | $X_{1-(p+3,q)-2}$ |
| | $X_{2-(p,q)-1}$ | $X_{2-(p,q)-2}$ | $X_{2-(p+1,q)-1}$ | $X_{2-(p+1,q)-2}$ | $X_{2-(p+2,q)-1}$ | $X_{2-(p+2,q)-2}$ | $X_{2-(p+3,q)-1}$ | $X_{2-(p+3,q)-2}$ |
| | $X_{3-(p,q)-1}$ | $X_{3-(p,q)-2}$ | $X_{3-(p+1,q)-1}$ | $X_{3-(p+1,q)-2}$ | $X_{3-(p+2,q)-1}$ | $X_{3-(p+2,q)-2}$ | $X_{3-(p+3,q)-1}$ | $X_{3-(p+3,q)-2}$ |
| Output Signal | $X_{1-(p,q)-1}$ | $X_{1-(p,q)-2}$ | $X_{1-(p+1,q)-1}$ | $X_{1-(p+1,q)-2}$ | $X_{1-(p+2,q)-1}$ | $X_{1-(p+2,q)-2}$ | $X_{1-(p+3,q)-1}$ | $X_{1-(p+3,q)-2}$ |
| | $X_{2-(p,q)-1}$ | $X_{2-(p,q)-2}$ | $X_{2-(p+1,q)-1}$ | $X_{2-(p+1,q)-2}$ | $X_{2-(p+2,q)-1}$ | $X_{2-(p+2,q)-2}$ | $X_{2-(p+3,q)-1}$ | $X_{2-(p+3,q)-2}$ |
| | $X_{3-(p,q)-1}$: $(x_{3-(p,q)-1} + x_{3-(p,q)-2})/2$ | | $X_{3-(p+1,q)-1}$: $(x_{3-(p+1,q)-1} + x_{3-(p+1,q)-2})/2$ | | $X_{3-(p+2,q)-1}$: $(x_{3-(p+2,q)-1} + x_{3-(p+2,q)-2})/2$ | | $X_{3-(p+3,q)-1}$: $(x_{3-(p+3,q)-1} + x_{3-(p+3,q)-2})/2$ | |
| | | $X_{4-(p,q)-2}$: $(SG_{1-(p,q)} + SG_{2-(p,q)})/2$ | | $X_{4-(p+1,q)-2}$: $(SG_{1-(p+1,q)} + SG_{2-(p+1,q)})/2$ | | $X_{4-(p+2,q)-2}$: $(SG_{1-(p+2,q)} + SG_{2-(p+2,q)})/2$ | | $X_{4-(p+3,q)-2}$: $(SG_{1-(p+3,q)} + SG_{2-(p+3,q)})/2$ |
| | Example 8 | | | | | | | |
| Input Signal | $X_{1-(p,q)-1}$ | $X_{1-(p,q)-2}$ | $X_{1-(p+1,q)-1}$ | $X_{1-(p+1,q)-2}$ | $X_{1-(p+2,q)-1}$ | $X_{1-(p+2,q)-2}$ | $X_{1-(p+3,q)-1}$ | $X_{1-(p+3,q)-2}$ |
| | $X_{2-(p,q)-1}$ | $X_{2-(p,q)-2}$ | $X_{2-(p+1,q)-1}$ | $X_{2-(p+1,q)-2}$ | $X_{2-(p+2,q)-1}$ | $X_{2-(p+2,q)-2}$ | $X_{2-(p+3,q)-1}$ | $X_{2-(p+3,q)-2}$ |
| | $X_{3-(p,q)-1}$ | $X_{3-(p,q)-2}$ | $X_{3-(p+1,q)-1}$ | $X_{3-(p+1,q)-2}$ | $X_{3-(p+2,q)-1}$ | $X_{3-(p+2,q)-2}$ | $X_{3-(p+3,q)-1}$ | $X_{3-(p+3,q)-2}$ |
| Output Signal | $X_{1-(p,q)-1}$ | $X_{1-(p,q)-2}$ | $X_{1-(p+1,q)-1}$ | $X_{1-(p+1,q)-2}$ | $X_{1-(p+2,q)-1}$ | $X_{1-(p+2,q)-2}$ | $X_{1-(p+3,q)-1}$ | $X_{1-(p+3,q)-2}$ |
| | $X_{2-(p,q)-1}$ | $X_{2-(p,q)-2}$ | $X_{2-(p+1,q)-1}$ | $X_{2-(p+1,q)-2}$ | $X_{2-(p+2,q)-1}$ | $X_{2-(p+2,q)-2}$ | $X_{2-(p+3,q)-1}$ | $X_{2-(p+3,q)-2}$ |
| | $X_{3-(p,q)-1}$: $(x_{3-(p,q)-1} + x_{3-(p,q)-2})/2$ | | $X_{3-(p+1,q)-1}$: $(x_{3-(p+1,q)-1} + x_{3-(p+1,q)-2})/2$ | | $X_{3-(p+2,q)-1}$: $(x_{3-(p+2,q)-1} + x_{3-(p+2,q)-2})/2$ | | $X_{3-(p+3,q)-1}$: $(x_{3-(p+3,q)-1} + x_{3-(p+3,q)-2})/2$ | |
| | | $X_{4-(p,q)-2}$: $(SG_{2-(p,q)} + SG_{1-(p+1,q)})/2$ | | $X_{4-(p+1,q)-2}$: $(SG_{2-(p+1,q)} + SG_{1-(p+2,q)})/2$ | | $X_{4-(p+2,q)-2}$: $(SG_{2-(p+2,q)} + SG_{1-(p+3,q)})/2$ | | $X_{4-(p+3,q)-2}$: $(SG_{2-(p+3,q)} + SG_{1-(p+4,q)})/2$ |

Example 8

Example 8 is a modification of Example 7. In Example 7, an adjacent pixel is adjacent to the (p,q)th second pixel in the first direction. Meanwhile, in Example 8, let an adjacent pixel be the (p+1,q)th first pixel. The layout of pixels in Example 8 is the same as in Example 7, and is the same as that schematically shown in FIG. 20 or 21.

In the example shown in FIG. 20, a first pixel and a second pixel are disposed to be adjacent to each other in the second direction. In this case, a first subpixel R forming a first pixel and a first subpixel R forming a second pixel may be disposed to be adjacent to each other in the second direction or may not be disposed to be adjacent to each other. Similarly, a second subpixel G forming a first pixel and a second subpixel G forming a second pixel may be disposed to be adjacent to each other in the second direction or may not be disposed to be adjacent to each other. Similarly, a third subpixel B forming a first pixel and a fourth subpixel W forming a second pixel may be disposed to be adjacent to each other in the second direction, or may not be disposed to be adjacent to each other. Meanwhile, in the example shown in FIG. 21, a first pixel and a first pixel are disposed to be adjacent to each other in the second direction, and a second pixel and a second pixel are disposed to be adjacent to each other in the second direction. In this case, a first subpixel R forming a first pixel and a first subpixel R forming a second pixel may be disposed to be adjacent to each other in the second direction, or may not be disposed to be adjacent to each other. Similarly, a second subpixel G forming a first pixel and a second subpixel G forming a second pixel may be disposed to be adjacent to each other in the second direction, or may not be disposed to be adjacent to each other. Similarly, a third subpixel B forming a first pixel and a fourth subpixel W forming a second pixel may be disposed to be adjacent to each other in the second direction, or may not be disposed to be adjacent to each other. The same can apply to Example 7 or Example 10 described below.

In the signal processor 20, as in Example 7, (1) a first subpixel output signal to a first pixel $Px_1$ is obtained on the basis of at least a first subpixel input signal to the first pixel $Px_1$ and the corrected expansion coefficient $\alpha'_{i-0}$, and output to the first subpixel R of the first pixel $Px_1$, (2) a second subpixel output signal to the first pixel $Px_1$ is obtained on the basis of at least a second subpixel input signal to the first pixel $Px_1$ and the corrected expansion coefficient $\alpha'_{i-0}$, and output to the second subpixel G of the first pixel $Px_1$, (3) a first subpixel output signal to a second pixel $Px_2$ is obtained on the basis of at least a first subpixel input signal to the second pixel $Px_2$ and the corrected expansion coefficient $\alpha'_{i-0}$, and output to the first subpixel R of the second pixel $Px_2$, and (4) a second subpixel output signal to the second pixel $Px_2$ is obtained on the basis of at least a second subpixel input signal to the second pixel $Px_2$ and the corrected expansion coefficient $\alpha'_{i-0}$, and output to the second subpixel G of the second pixel $Px_2$.

In the Example 8, as in Example 7, in regard to a first pixel $Px_{(p,q)-1}$ forming a (p,q)th pixel group $PG_{(p,q)}$ (where $1 \le p \le P$ and $1 \le q \le Q$), a first subpixel input signal having a signal value $x_{1-(p,q)-1}$, a second subpixel input signal having a signal value $x_{2-(p,q)-1}$, and a third subpixel input signal having a signal value $x_{3-(p,q)-1}$ are input to the signal processor 20, and in regard to a second pixel $Px_{(p,q)-2}$ forming the (p,q)th pixel group $PG_{(p,q)}$, a first subpixel input signal having a signal value $x_{1-(p,q)-2}$, a second subpixel input signal having a signal value $x_{2-(p,q)-2}$, and a third subpixel input signal having a signal value $x_{3-(p,q)-2}$ are input to the signal processor 20.

As in Example 7, the signal processor 20 outputs, in regard to the first pixel $Px_{(p,q)-1}$ forming the (p,q)th pixel group $PG_{(p,q)}$, a first subpixel output signal having a signal value $X_{1-(p,q)-1}$ for determining the display gradation of the first subpixel R, a second subpixel output signal having a signal value $X_{2-(p,q)-1}$ for determining the display gradation of the second subpixel G, and a third subpixel output signal having a signal value $X_{3-(p,q)-1}$ for determining the display gradation of the third subpixel B, and outputs, in regard to the second pixel $Px_{(p,q)-2}$ forming the (p,q)th pixel group $PG_{(p,q)}$, a first subpixel output signal having a signal value $X_{1-(p,q)-2}$ for determining the display gradation of the first subpixel R, a second subpixel output signal having a signal value $X_{2-(p,q)-2}$ for determining the display gradation of the second subpixel G, and a fourth subpixel output signal having a signal value $X_{4-(p,q)-2}$ for determining the display gradation of the fourth subpixel W.

In Example 8, as in Example 7, the third subpixel output signal value $X_{3-(p,q)-1}$ to the (p,q)th first pixel $Px_{(p,q)-1}$ is obtained on the basis of at least the third subpixel input signal value $x_{3-(p,q)-1}$ to the (p,q)th first pixel $Px_{(p,q)-1}$ and the third subpixel input signal value $X_{3-(p,q)-2}$ to the (p,q)th second pixel $Px_{(p,q)-2}$, and output to the third subpixel B. Meanwhile, unlike Example 7, the fourth subpixel output signal value $X_{4-(p,q)-2}$ to the (p,q)th second pixel $Px_2$ is obtained on the basis of the fourth subpixel control second signal value $SG_{2-(p,q)}$ obtained from the first subpixel input signal value $x_{1-(p,q)}$-2, the second subpixel input signal value $x_{2-(p,q)-2}$, and the third subpixel input signal value $x_{3-(p,q)-2}$ to the (p,q)th second pixel $Px_{(p,q)-2}$ and the fourth subpixel control first signal value $SG_{1-(p,q)}$ obtained from a first subpixel input signal value $x_{1-(p',q)}$, a second subpixel input signal value $x_{2-(p',q)}$, and a third subpixel input signal value $x_{3-(p',q)}$ to a (p+1,q)th first pixel $Px_{(p+1,q)-1}$, and output to the fourth subpixel W.

In Example 8, the output signal values $X_{4-(p,q)-2}$, $X_{1-(p,q)-2}$, $X_{2-(p,q)-2}$, $X_{1-(p,q)-1}$, $X_{2-(p,q)-1}$, and $X_{3-(p,q)-1}$ are obtained from Expressions (71-2), (3-A), (3-B), (3-E), (3-F), (3-a'), (3-f), (3-g), (41'-1), (41'-2), and (41'-3).

$$X_{1-(p,q)-2}=\alpha'_{i-0}\cdot x_{1-(p,q)-2}-\chi\cdot SG_{2-(p,q)} \quad (3\text{-A})$$

$$X_{2-(p,q)-2}=\alpha'_{i-0}\cdot x_{2-(p,q)-2}-\chi\cdot SG_{2-(p,q)} \quad (3\text{-B})$$

$$X_{1-(p,q)-1}=\alpha'_{i-0}\cdot x_{1-(p,q)-1}-\chi\cdot SG_{3-(p,q)} \quad (3\text{-E})$$

$$X_{2-(p,q)-1}=\alpha'_{i-0}\cdot x_{2-(p,q)-1}-\chi\cdot SG_{3-(p,q)} \quad (3\text{-F})$$

$$X_{3-(p,q)-1}=(X'_{3-(p,q)-1}+X'_{3-(p,q)-2})/2 \quad (3\text{-a'})$$

Here, $$X'_{3-(p,q)-1}=\alpha'_{i-0}\cdot x_{3-(p,q)-1}-\chi\cdot SG_{3-(p,q)} \quad (3\text{-f})$$

$$X'_{3-(p,q)-2}=\alpha'_{i-0}\cdot x_{3-(p,q)-2}-\chi\cdot SG_{2-(p,q)} \quad (3\text{-g})$$

$$SG_{2-(p,q)}=\mathrm{Min}_{(p,q)-2}\cdot\alpha'_{i-0} \quad (41'\text{-2})$$

$$SG_{1-(p,q)}=\mathrm{Min}_{(p',q)}\cdot\alpha'_{i-0} \quad (41'-1)$$

$$SG_{3-(p,q)}=\mathrm{Min}_{(p,q)-1}\cdot\alpha'_{i-0} \quad (41'-3)$$

Hereinafter, how to obtain the output signal values $X_{1-(p,q)-2}$, $X_{2-(p,q)-2}$, $X_{4-(p,q)-2}$, $X_{1-(p,q)-1}$, $X_{2-(p,q)-1}$, and $X_{3-(p,q)-1}$ in the (p,q)th pixel group $PG_{(p,q)}$ (expansion process) will be described. Note that the following process will be performed so as to keep (maintain) gradation-luminance characteristic (gamma characteristic, γ characteristic). The following process is performed so as to maintain the luminance ratio as much as possible over the first pixel and the second pixel, that is, in each pixel group, and will be performed so as to keep (maintain) color tone as much as possible.

[Step-800]

First, in the signal processor 20, the saturation $S_i$ and the luminosity $V_i(S)$ in a plurality of pixel groups are obtained on the basis of the subpixel input signal values in a plurality of pixels. Specifically, $S_{(p,q)-1}$, $S_{(p,q)-2}$, $V(S)_{(p,q)-1}$, and $V(S)_{(p,q)-2}$ are obtained from Expressions (43-1), (43-2), (43-3), and (43-4) on the basis of a first subpixel input signal (signal value $x_{1-(p,q)-1}$), a second subpixel input signal (signal value $x_{2-(p,q)-1}$), and a third subpixel input signal (signal value $x_{3-(p,q)-1}$) to the (p,q)th first pixel $Px_{(p,q)-1}$ and a first subpixel input signal (signal value $x_{1-(p,q)-2}$), a second subpixel input signal (signal value $x_{2-(p,q)-2}$), and a third subpixel input signal (signal value $x_{3-(p,q)-2}$) to the second pixel $Px_{(p,q)-2}$. This process will be performed for all pixel groups.

[Step-810]

Next, in the signal processor 20, the corrected expansion coefficient $\alpha'_{i-0}$ is determined from the values of $V_{max}(S)/V_i(S)$ obtained in a plurality of pixel groups in the same manner as in Example 1. Alternatively, the corrected expansion coefficient $\alpha'_{i-0}$ is determined from the predetermined value $\beta_{PD}$ [driving method-A], the corrected expansion coefficient $\alpha'_{i-0}$ is determined on the basis of the definitions of Expression (15-2), Expressions (16-1) to (16-5), or Expressions (17-1) to (17-6) [driving method-B, driving method-C, and driving method-D], or the corrected expansion coefficient $\alpha'_{i-0}$ is determined on the basis of the definitions in the driving method-E.

[Step-820]

Thereafter, in the signal processor 20, the fourth subpixel output signal value $X_{4-(p,q)-2}$ to the (p,q)th pixel group $PG_{(p,q)}$ is obtained from Expression (71-1). [Step-810] and [Step-820] may be performed simultaneously.

[Step-830]

Next, in the signal processor 20, the output signal values $X_{1-(p,q)-2}$, $X_{2-(p,q)-2}$, $X_{1-(p,q)-1}$, $X_{2-(p,q)-1}$, and $X_{3-(p,q)-1}$ to the (p,q)th pixel group are obtained from Expressions (3-A), (3-B), (3-E), (3-F), (3-a'), (3-f), (3-g), (41'-1), (41'-2), and (41'-3). Note that [Step-820] and [Step-830] may be performed simultaneously, or [Step-820] may be performed after [Step-830] has been performed.

When the relationship between the fourth subpixel control first signal value $SG_{1-(p,q)}$ and the fourth subpixel control second signal value $SG_{2-(p,q)}$ satisfies a certain condition, for example, Example 7 is executed, and when the relationship departs from this certain condition, for example, a configuration in which Example 8 executed may be used. For example, when performing a process based on $$X_{4-(p,q)-2}=(SG_{1-(p,q)}+SG_{2-(p,q)})/(2\chi)$$

if the value of $|SG_{1-(p,q)}-SG_{2-(p,q)}|$ is equal to or greater than (or equal to or smaller than) a predetermined value $X''_1$, Example 7 may be executed, or otherwise, Example 8 may be executed. Alternatively, for example, if the value of $|SG_{1-(p,q)}-SG_{2-(p,q)}|$ is equal to or greater than (or equal to or smaller than) the predetermined value $X''_1$, a value based on only $SG_{1-(p,q)}$ or a value based on only $SG_{2-(p,q)}$ can be used as $X_{4-(p,q)-2}$, and Example 7 or Example 8 can be applied. Alternatively, if the value of $(SG_{1-(p,q)}-SG_{2-(p,q)})$ is equal to or greater than a predetermined value $X''_2$ or if the value of $(SG_{1(p,q)}-SG_{2-(p,q)})$ is equal to or less than a predetermined value $X''_3$, Example 7 (or Example 8) may be executed, or otherwise, Example 8 (or Example 7) may be executed.

In Example 7 or Example 8, when expressing the arrangement sequence of subpixels forming a first pixel and a second pixel as [(first pixel) (second pixel)], the sequence is

[(first subpixel R, second subpixel G, third subpixel B) (first subpixel R, second subpixel G, fourth subpixel W)]

or when expressing as [(second pixel), (first pixel)], the sequence is

[(fourth subpixel W, second subpixel G, first subpixel R) (third subpixel B, second subpixel G, first subpixel R)]

but the arrangement sequence is not limited to these arrangement sequences. For example, as the arrangement sequence of [(first pixel) (second pixel)], the following sequence may be used:

[(first subpixel R, third subpixel B, second subpixel G) (first subpixel R, fourth subpixel W, second subpixel G)].

Figure 22:
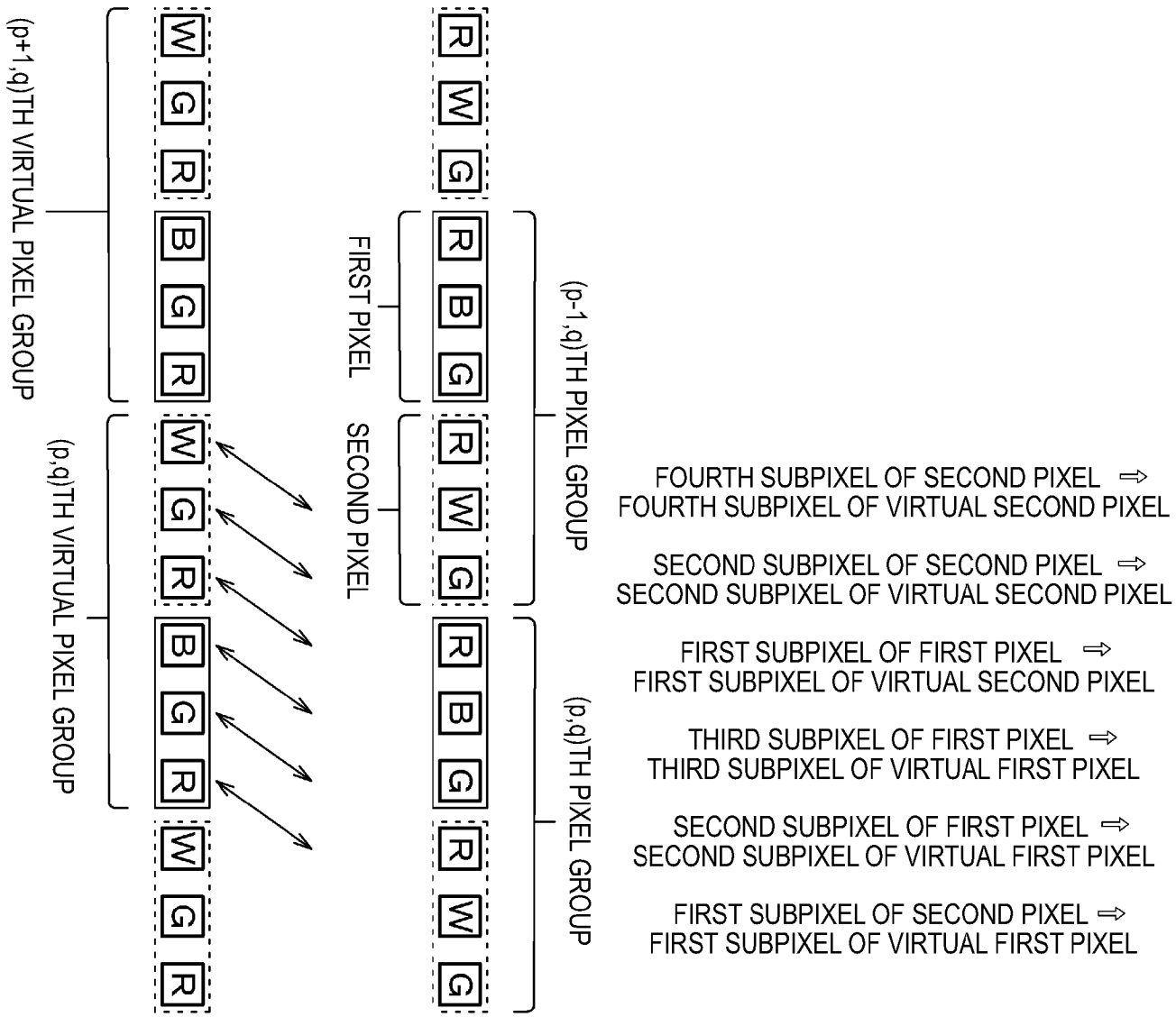
FIG. 22 is a conceptual diagram illustrating a modification of the arrangement of a first subpixel, a second subpixel, a third subpixel, and a fourth subpixel in a first pixel and a second pixel forming a pixel group in Example 8.

Although this state in Example 8 is shown in the upper side of FIG. 22, from another point of view, as shown in a virtual pixel section on the lower side of FIG. 22, the arrangement sequence is equivalent to a sequence where three subpixels of a first subpixel R in a first pixel of a (p,q)th pixel group and a second subpixel G and a fourth subpixel W in a second pixel of a (p−1, q)th pixel group are virtually regarded as (first subpixel R, second subpixel G, fourth subpixel W) in a second pixel of the (p,q)th pixel group. This sequence is also equivalent to a sequence where three subpixels of a first subpixel R in a second pixel of the (p,q)th pixel group and a second subpixel G and a third subpixel B in a first pixel are regarded as a first pixel of the (p,q)th pixel group. For this reason, Example 8 may be applied to a first pixel and a second pixel forming these virtual pixel groups. Although in Example 7 or Example 8, a case where the first direction is a direction from the left hand toward the right hand has been described, the first direction may be a direction from the right hand toward the left hand like the above-described [(second pixel), (first pixel)].

Example 9

Example 9 relates to a method of driving an image display device according to the fourth embodiment of the present disclosure.

Figure 23:
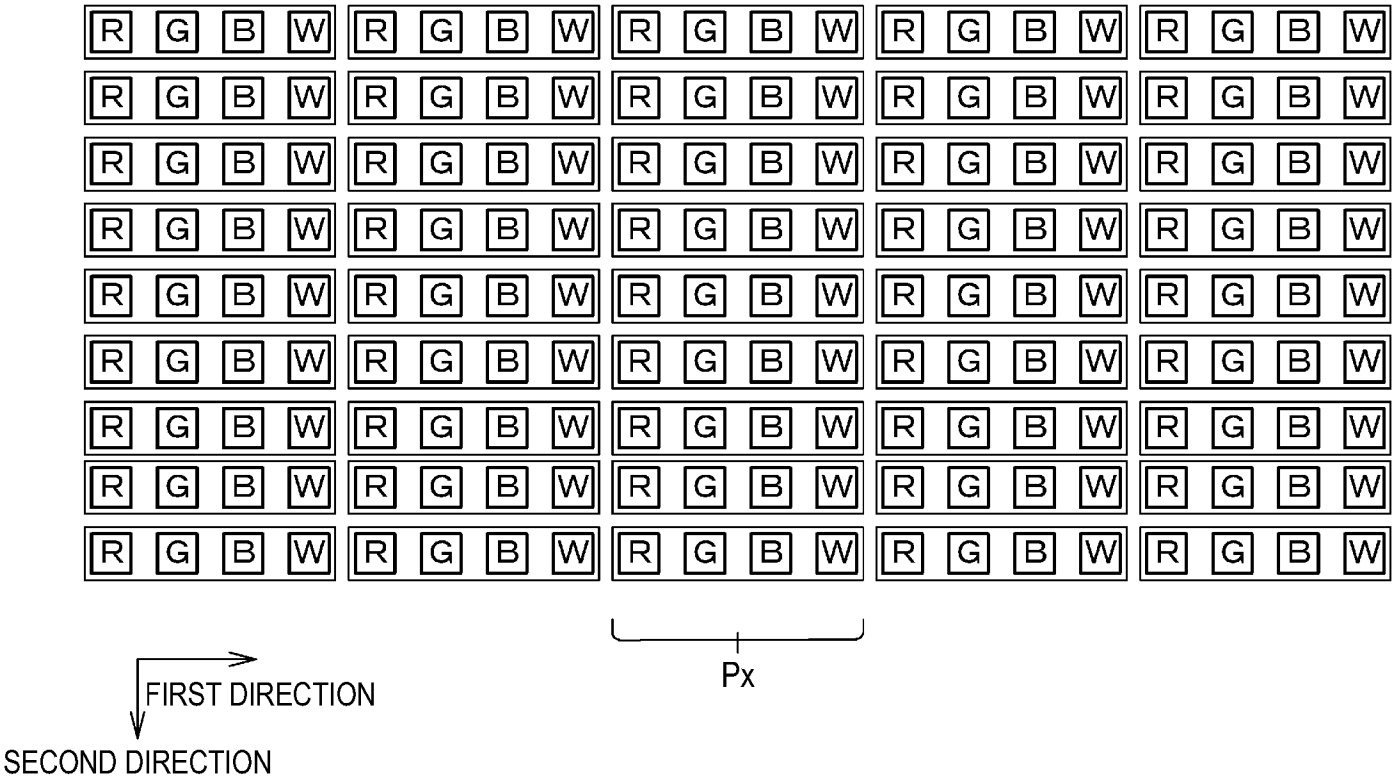
FIG. 23 is a diagram schematically showing an example of the layout of pixels in an image display device of Example 9.

As schematically shown the layout of pixels in FIG. 23, an image display panel 30 of Example 9 has $P_0 \times Q_0$ pixels Px in total of $P_0$ pixels in the first direction and $Q_0$ pixels in the second direction arranged in a two-dimensional matrix. Note that, in FIG. 23, a first subpixel R, a second subpixel G, a third subpixel B, and a fourth subpixel W are surrounded by a solid line. Each pixel Px has a first subpixel R displaying a first primary color (for example, red), a second subpixel G displaying a second primary color (for example, green), a third subpixel B displaying a third primary color (for example, blue), and a fourth subpixel W displaying a fourth color (for example, white), and these subpixels are arranged in the first direction. The shape of a subpixel is a rectangle, and a subpixel is disposed such that the long side of the rectangle is parallel to the second direction, and the short side of the rectangle is parallel to the first direction.

In the signal processor 20, a first subpixel output signal (signal value $X_{1-(p,q)}$) to a pixel $Px_{(p,q)}$ is obtained on the basis of at least a first subpixel input signal (signal value $x_{1-(p,q)}$) and the corrected expansion coefficient $\alpha'_{i-0}$, and output to the first subpixel R. A second subpixel output signal (signal value $X_{2-(p,q)}$) is obtained on the basis of at least a second subpixel input signal (signal value $x_{2-(p,q)}$) and the corrected expansion coefficient $\alpha'_{i-0}$, and output to the second subpixel G. A third subpixel output signal (signal value $X_{3-(p,q)}$) is obtained on the basis of at least a third subpixel input signal (signal value $x_{3-(p,q)}$) and the corrected expansion coefficient $\alpha'_{i-0}$, and output to the third subpixel B.

In Example 9, in regard to a pixel $Px_{(p,q)}$ forming the (p,q)th pixel $Px_{(p,q)}$ (where $1 \le p \le P_0$ and $1 \le q \le Q_0$), a first subpixel input signal having a signal value $x_{1-(p,q)}$, a second subpixel input signal having a signal value $x_{2-(p,q)}$, and a third subpixel input signal having a signal value $x_{3-(p,q)}$ are input to the signal processor 20. The signal processor 20 outputs, in regard to the pixel $Px_{(p,q)}$, a first subpixel output signal having a signal value $X_{1-(p,q)}$ for determining the display gradation of the first subpixel R, a second subpixel output signal having a signal value $X_{2-(p,q)}$ for determining the display gradation of a second subpixel G, a third subpixel output signal having a signal value $X_{3-(p,q)}$ for determining the display gradation of the third subpixel B, and a fourth subpixel output signal having a signal value $X_{4-(p,q)}$ for determining the display gradation of the fourth subpixel W.

In regard to an adjacent pixel adjacent to the (p,q)th pixel, a first subpixel input signal having a signal value $X_{1-(p,q')}$, a second subpixel input signal having a signal value $x_{2-(p,q')}$, and a third subpixel input signal having a signal value $x_{3-(p,q')}$ are input to the signal processor 20.

Note that, in Example 9, the adjacent pixel adjacent to the (p,q)th pixel is the (p,q−1)th pixel. However, the adjacent pixel is not limited thereto, the (p,q+1)th pixel may be used or the (p,q−1)th pixel and the (p,q+1)th pixel may be used.

In the signal processor 20, the fourth subpixel output signal is obtained on the basis of a fourth subpixel control second signal obtained from a first subpixel input signal, a second subpixel input signal, and a third subpixel input signal to the (p,q)th [where p=1, 2, . . . , and $P_0$, and q=1, 2, . . . , and $Q_0$] pixel when counting in the second direction and a fourth subpixel control first signal obtained from a first subpixel input signal, a second subpixel input signal, and a third subpixel input signal to an adjacent pixel adjacent to the (p,q)th pixel in the second direction, and the obtained fourth subpixel output signal is output to the (p,q)th pixel.

Specifically, the fourth subpixel control second signal value $SG_{2-(p,q)}$ is obtained from the first subpixel input signal value $x_{1-(p,q)}$, the second subpixel input signal value $x_{2-(p,q)}$, and the third subpixel input signal value $x_{3-(p,q)}$ to the (p,q)th pixel $Px_{(p,q)}$. The fourth subpixel control first signal value $SG_{1-(p,q)}$ is obtained from the first subpixel input signal value $x_{1-(p,q')}$, the second subpixel input signal value $x_{2-(p,q')}$, and the third subpixel input signal value $x_{3-(p,q')}$ to the adjacent pixel adjacent to the (p,q)th pixel in the second direction. The fourth subpixel output signal is obtained on the basis of the fourth subpixel control first signal value $SG_{1-(p,q)}$ and the fourth subpixel control second signal value $SG_{2-(p,q)}$, and the obtained fourth subpixel output signal value $X_{4-(p,q)}$ is output to the (p,q)th pixel.

In Example 9, the fourth subpixel output signal value $X_{4-(p,q)}$ is obtained from Expressions (42-1) and (91). That is, the fourth subpixel output signal value $X_{4-(p,q)}$ is obtained by arithmetic mean.

$$X_{4-(p,q)} = (SG_{1-(p,q)} + SG_{2-(p,q)})/(2\chi) \quad (42\text{-}1)$$

$$= (\mathrm{Min}_{(p,q)} \cdot \alpha'_{i-0} + \mathrm{Min}_{(p,q)} \cdot \alpha'_{i-0})/(2\chi) \quad (91)$$

Note that the fourth subpixel control first signal value $SG_{1-(p,q)}$ is obtained on the basis of $\mathrm{Min}_{(p,q')}$ and the corrected expansion coefficient $\alpha'_{i-0}$, and the fourth subpixel control second signal value $SG_{2-(p,q)}$ is obtained on the basis of $\mathrm{Min}_{(p,q)}$ and the corrected expansion coefficient $\alpha'_{i-0}$. Specifically, the fourth subpixel control first signal value $SG_{1-(p,q)}$ and the fourth subpixel control second signal value $SG_{2-(p,q)}$ are obtained from Expressions (92-1) and (92-2).

$$SG_{1-(p,q)} = \mathrm{Min}_{(p,q')} \cdot \alpha'_{i-0} \quad (92\text{-}1)$$

$$SG_{2-(p,q)} = \mathrm{Min}_{(p,q')} \cdot \alpha'_{i-0} \quad (92\text{-}2)$$

In the signal processor 20, the output signal values $X_{1-(p,q)}$, $X_{2-(p,q)}$, and $X_{3-(p,q)}$ in the first subpixel R, the second subpixel G, and the third subpixel B can be obtained on the basis of the corrected expansion coefficient $\alpha'_{i-0}$ and the constant $\chi$, and more specifically, can be obtained from Expressions (1-D) to (1-F).

$$X_{1-(p,q)} = \alpha'_{i-0} \cdot x_{1-(p,q)} - \chi \cdot SG_{2-(p,q)} \quad (1\text{-D})$$

$$X_{2-(p,q)} = \alpha'_{i-0} \cdot x_{2-(p,q)} - \chi \cdot SG_{2-(p,q)} \quad (1\text{-E})$$

$$X_{3-(p,q)} = \alpha'_{i-0} \cdot x_{3-(p,q)} - \chi \cdot SG_{2-(p,q)} \quad (1\text{-F})$$

Hereinafter, how to obtain the output signal values $X_{1-(p,q)}$, $X_{2-(p,q)}$, $X_{3-(p,q)}$, and $X_{4-(p,q)}$ in the (p,q)th pixel group $PG_{(p,q)}$ (expansion process) will be described. Note that, as in Example 4, the following process will be performed so as to maintain the ratio of the luminance of the first primary color displayed by (the first subpixel R+the fourth subpixel W), the luminance of the second primary color displayed by (the second subpixel G+the fourth subpixel W), and the luminance of the third primary color displayed by (the third subpixel B+the fourth subpixel W) over the first pixel and the second pixel, that is, in each pixel group. The following process will be performs so as to keep (maintain) color tone. The following process will be also performed so as to keep (maintain) gradation-luminance characteristic (gamma characteristic, γ characteristic).

[Step-900]

First, in the signal processor 20, the saturation $S_i$ and the luminosity $V_i(S)$ in a plurality of pixels are obtained on the basis of subpixel input signal values in a plurality of pixels. Specifically, $S_{(p,q)}$, $S_{(p,q')}$, $V(S)_{(p,q)}$, and $V(S)_{(p,q')}$ are obtained from Expressions similar to Expressions (43-1), (43-2), (43-3), and (43-4) on the basis of a first subpixel input signal value $x_{1-(p,q)}$, a second subpixel input signal value $x_{2-(p,q)}$, and a third subpixel input signal value $x_{3-(p,q)}$ to the (p,q)th pixel $Px_{(p,q)}$ and a first subpixel input signal value $x_{1-(p,q')}$, a second subpixel input signal value $x_{2-(p,q')}$, and a third subpixel input signal value $x_{3-(p,q')}$ to the (p,q−1)th pixel (adjacent pixel). This process will be performed for all pixels.

[Step-910]

Next, in the signal processor 20, the corrected expansion coefficient $\alpha'_{i-0}$ is determined from the values of $V_{max}(S)/V_i(S)$ obtained in a plurality of pixels in the same manner as in Example 1. Alternatively, the corrected expansion coefficient $\alpha'_{i-0}$ is determined from the predetermined value $\beta_{PD}$ [driving method-A], the corrected expansion coefficient $\alpha'_{i-0}$ is determined on the basis of the definitions of Expression (15-2), Expressions (16-1) to (16-5), or Expressions (17-1) to (17-6) [driving method-B, driving method-C, and driving method-D], or the corrected expansion coefficient $\alpha'_{i-0}$ is determined on the basis of the definitions in the driving method-E.

[Step-920]

Thereafter, in the signal processor 20, the fourth subpixel output signal value $X_{4-(p,q)}$ to the (p,q)th pixel $Px_{(p,q)}$ is obtained from Expressions (92-1), (92-2), and (91). Note that [Step-910] and [Step-920] may be performed simultaneously.

[Step-930]

Next, in the signal processor 20, a first subpixel output signal value $X_{1-(p,q)}$ to the (p,q)th pixel $Px_{(p,q)}$ is obtained on the basis of the input signal value $x_{1-(p,q)}$, the corrected expansion coefficient $\alpha'_{i-0}$, and the constant $\chi$. A second subpixel output signal value $X_{2-(p,q)}$ is obtained on the basis of the input signal value $x_{2-(p,q)}$, the corrected expansion coefficient $\alpha'_{i-0}$, and the constant $\chi$. A third subpixel output signal value $X_{3-(p,q)}$ is obtained on the basis of the input signal value $x_{3-(p,q)}$, the corrected expansion coefficient $\alpha'_{i-0}$, and the constant $\chi$. Note that [Step-920] and [Step-930] may be performed simultaneously, or [Step-920] may be performed after [Step-930] has been performed.

Specifically, the output signal values $X_{1-(p,q)}$, $X_{2-(p,q}$, and $X_{3-(p,q)}$ in the (p,q)th pixel $Px_{(p,q)}$ are obtained from Expressions (1-D) to (1-F) described above.

In the method of driving an image display device of Example 9, the output signal values $X_{1-(p,q)}$, $X_{2-(p,q)}$, $X_{3-(p,q)}$, and $X_{4-(p,q)}$ are expanded $\alpha'_{i-0}$ times in the (p,q)th pixel group $PG_{(p,q)}$. For this reason, in order to match the luminance of an image the same as the luminance of an image in an unexpanded state, it is desirable to decrease the luminance of the planar light source device 50 on the basis of the corrected expansion coefficient $\alpha'_{i-0}$. Specifically, it should suffice that the luminance of the planar light source device 50 is $(1/\alpha'_{i-0})$ times. Therefore, it is possible to achieve reduction in power consumption in the planar light source device.

Example 10

Example 10 relates to a method of driving an image display device according to the fifth embodiment of the present disclosure. The layout of pixels and pixel groups in an image display panel of Example 10 is the same as in Example 7, and is the same as that schematically shown in FIG. 20 or 21.

In Example 10, the image display panel 30 has P×Q pixel groups in total of P pixel groups in the first direction (for example, horizontal direction) and Q pixel groups in the second direction (for example, vertical direction) arranged in a two-dimensional matrix. Note that, when the number of pixels forming a pixel group is p0, p0=2. Specifically, as shown in FIG. 20 or 21, in the image display panel 30 of Example 10, each pixel group has a first pixel $Px_1$ and a second pixel $Px_2$ in the first direction. The first pixel $Px_1$ has a first subpixel R displaying a first primary color (for example, red), a second subpixel G displaying a second primary color (for example, green), and a third subpixel B displaying a third primary color (for example, blue). The second pixel $Px_2$ has a first subpixel R displaying a first primary color, a second subpixel G displaying a second primary color, and a fourth subpixel W displaying a fourth color (for example, white). More specifically, the first pixel $Px_1$ has a first subpixel R displaying a first primary color, a second subpixel G displaying a second primary color, and a third subpixel B displaying a third primary color sequentially arranged in the first direction. The second pixel $Px_2$ has a first subpixel R displaying a first primary color, a second subpixel G displaying a second primary color, and a fourth subpixel W displaying a fourth color sequentially arranged in the first direction. A third subpixel B forming a first pixel $Px_1$ and a first subpixel R forming a second pixel $Px_2$ are adjacent to each other. A fourth subpixel W forming a second pixel $Px_2$ and a first subpixel R forming a first pixel $Px_1$ in a pixel group adjacent to this pixel group are adjacent to each other. Note that the shape of a subpixel is a rectangle, and a subpixel is disposed such that the long side of the rectangle is parallel to the second direction, and the short side of the rectangle is parallel to the first direction. Note that, in the example shown in FIG. 20, a first pixel and a second pixel are disposed to be adjacent to each other in the second direction. In the example shown in FIG. 21, a first pixel and a first pixel are disposed to be adjacent to each other in the second direction, and a second pixel and a second pixel are disposed to be adjacent to each other in the second direction.

In the signal processor 20, a first subpixel output signal to a first pixel $Px_1$ is obtained on the basis of at least a first subpixel input signal to the first pixel $Px_1$ and the corrected expansion coefficient $\alpha'_{i-0}$, and output to the first subpixel R of the first pixel $Px_1$, and a second subpixel output signal to the first pixel $Px_1$ is obtained on the basis of at least a second subpixel input signal to the first pixel $Px_1$ and the corrected expansion coefficient $\alpha'_{i-0}$, and output to the second subpixel G of the first pixel $Px_1$. A first subpixel output signal to a second pixel $Px_2$ is obtained on the basis of at least a first subpixel input signal to the second pixel $Px_2$ and the corrected expansion coefficient $\alpha'_{i-0}$, and output to the first subpixel R of the second pixel $Px_2$, and a second subpixel output signal to the second pixel $Px_2$ is obtained on the basis of at least a second subpixel input signal to the second pixel $Px_2$ and the corrected expansion coefficient $\alpha'_{i-0}$, and output to the second subpixel G of the second pixel $Px_2$.

In Example 10, in a first pixel $Px_{(p,q)-1}$ forming a (p,q)th pixel group $PG_{(p,q)}$ (where $1 \le p \le P$ and $1 \le q \le Q$), a first subpixel input signal having a signal value $x_{1-(p,q)-1}$, a second subpixel input signal having a signal value $x_{2-(p,q)-1}$, and a third subpixel input signal having a signal value $x_{3-(p,q)-1}$ are input to the signal processor 20, and in regard to a second pixel $Px_{(p,q)-2}$ forming the (p,q)th pixel group $PG_{(p,q)}$, a first subpixel input signal having a signal value $x_{1-(p,q)-2}$, a second subpixel input signal having a signal value $x_{2-(p,q)-2}$, and a third subpixel input signal having a signal value $x_{3-(p,q)-2}$ are input to the signal processor 20.

In Example 10, in regard to the first pixel $Px_{(p,q)-1}$ forming the (p,q)th pixel group $PG_{(p,q)}$, the signal processor 20 outputs a first subpixel output signal having a signal value $X_{1-(p,q)-1}$ for determining the display gradation of the first subpixel R, a second subpixel output signal having a signal value $X_{2-(p,q)-1}$ for determining the display gradation of the second subpixel G, and a third subpixel output signal having a signal value $X_{3-(p,q)-1}$ for determining the display gradation of the third subpixel B, and in regard to the second pixel $Px_{(p,q)-2}$ forming the (p,q)th pixel group $PG_{(p,q)}$, the signal processor 20 outputs a first subpixel output signal having a signal value $X_{1-(p,q)-2}$ for determining the display gradation of the first subpixel R, a second subpixel output signal having a signal value $X_{2-(p,q)-2}$ for determining the display gradation of the second subpixel G, and a fourth subpixel output signal having a signal value $X_{4-(p,q)-2}$ for determining the display gradation of the fourth subpixel W.

In regard to an adjacent pixel adjacent to the (p,q)th second pixel, a first subpixel input signal having a signal value $x_{1-(p,q')}$, a second subpixel input signal having a signal value $x_{2-(p,q')}$, and a third subpixel input signal having a signal value $x_{3-(p,q')}$ are input to the signal processor 20.

In Example 10, in the signal processor 20, a fourth subpixel output signal (signal value $X_{4-(p,q)-2}$) is obtained on the basis of a fourth subpixel control second signal (signal value $SG_{2-(p,q)}$) in the (p,q)th [where p=1, 2, . . . , and P, and q=2, 3, . . . , Q] second pixel $Px_{(p,q)-2}$ when counting in the second direction and a fourth subpixel control first signal (signal value $SG_{1-(p,q)}$) in an adjacent pixel adjacent to the (p,q)th second pixel $Px_{(p,q)-2}$ in the second direction, and output to the fourth subpixel W of the (p,q)th second pixel $Px_{(p,q)-2}$. Here, the fourth subpixel control second signal (signal value $SG_{2-(p,q)}$) is obtained from the first subpixel input signal (signal value $x_{1-(p,q)-2}$), the second subpixel input signal (signal value $x_{2-(p,q)-2}$), and the third subpixel input signal (signal value $x_{3-(p,q)-2}$) to the (p,q)th second pixel $Px_{(p,q)-2}$. The fourth subpixel control first signal (signal value $SG_{1-(p,q)}$) is obtained from the first subpixel input signal (signal value $x_{1-(p,q')}$) the second subpixel input signal (signal value $x_{2-(p,q')}$), and the third subpixel input signal (signal value $x_{3-(p,q')}$) to an adjacent pixel adjacent to the (p,q)th second pixel in the second direction.

The third subpixel output signal (signal value $X_{3-(p,q)-1}$) is obtained on the basis of at least the third subpixel input signal (signal value $x_{3-(p,q)-2}$) to the (p,q)th second pixel $Px_{(p,q)-2}$ and the third subpixel input signal (signal value $x_{3-(p,q)-1}$) to the (p,q)th first pixel, and output to the third subpixel of the (p,q)th first pixel $Px_{(p,q)-1}$.

Note that, in Example 10, the adjacent pixel adjacent to the (p,q)th pixel is the (p,q−1)th pixel. However, the adjacent pixel is not limited thereto, the (p,q+1)th pixel may be used, or the (p,q−1)th pixel and the (p,q+1)th pixel may be used.

In Example 10, the corrected expansion coefficient $\alpha'_{i-0}$ is determined in each image display frame. The fourth subpixel control first signal value $SG_{1-(p,q)}$ and the fourth subpixel control second signal value $SG_{2-(p,q)}$ are respectively obtained from Expressions (101-1) and (101-2) corresponding to Expressions (2-1-1) and (2-1-2). The control signal value (third subpixel control signal value) $SG_{3-(p,q)}$ is obtained from Expression (101-3).

$$SG_{1-(p,q)}=\mathrm{Min}_{(p,q')}\cdot\alpha'_{i-0} \tag{101-1}$$

$$SG_{2-(p,q)}=\mathrm{Min}_{(p,q)}\cdot\alpha'_{i-0} \tag{101-2}$$

$$SG_{3-(p,q)}=\mathrm{Min}_{(p,q)}\cdot\alpha'_{i-0} \tag{101-3}$$

In Example 10, the fourth subpixel output signal value $X_{4-(p,q)-2}$ is obtained from Arithmetic Mean Expression (102). The output signal values $X_{1-(p,q)-2}$, $X_{2-(p,q)-2}$, $X_{1-(p,q)-1}$, $X_{2-(p,q)-1}$, and $X_{3-(p,q)-1}$ are obtained from Expressions (3-A), (3-S), (3-E), (3-F), (3-a'), (3-f), (3-g), and (101-3).

$$\begin{aligned} X_{4-(p,q)-2} &= (SG_{1-(p,q)} + SG_{2-(p,q)})/(2\chi) \\ &= (\mathrm{Min}_{(p,q')}\cdot\alpha'_{i-0} + \mathrm{Min}_{(p,q)-2}\cdot\alpha'_{i-0})/(2\chi) \end{aligned} \tag{102}$$

-continued $$X_{1-(p,q)-2} = \alpha'_{i-0}\cdot x_{1-(p,q)-2} - \chi\cdot SG_{2-(p,q)} \tag{3-A}$$

$$X_{2-(p,q)-2} = \alpha'_{i-0}\cdot x_{2-(p,q)-2} - \chi\cdot SG_{2-(p,q)} \tag{3-B}$$

$$X_{1-(p,q)-1} = \alpha'_{i-0}\cdot x_{1-(p,q)-1} - \chi\cdot SG_{3-(p,q)} \tag{3-E}$$

$$X_{2-(p,q)-1} = \alpha'_{i-0}\cdot x_{2-(p,q)-1} - \chi\cdot SG_{3-(p,q)} \tag{3-F}$$

$$X_{3-(p,q)-1} = (X'_{3-(p,q)-1} + X'_{3-(p,q)-2})/2 \tag{3-a'}$$

Here, $$X'_{3-(p,q)-1}=\alpha'_{i-0}\cdot x_{3-(p,q)-1}-\chi\cdot SG_{3-(p,q)} \tag{3-f}$$

$$X'_{3-(p,q)-2}=\alpha'_{i-0}\cdot x_{3-(p,q)-2}-\chi\cdot SG_{2-(p,q)} \tag{3-g}$$

Hereinafter, how to obtain the output signal values $X_{1-(p,q)-2}$, $X_{2-(p,q)-2}$, $X_{4-(p,q)-2}$, $X_{1-(p,q)-1}$, $X_{2-(p,q)-1}$, and $X_{3-(p,q)-1}$ in the (p,q)th pixel group $PG_{(p,q)}$ (expansion process) will be described. Note that the following process will be performed so as to keep (maintain) gradation-luminance characteristic (gamma characteristic, γ characteristic). The following process is performed so as to maintain the luminance ratio as much as possible over the first pixel and the second pixel, that is, in each pixel group, and will be performed so as to keep (maintain) color tone as much as possible.

[Step-1000]

First, in the signal processor 20, the saturation $S_i$ and the luminosity $V_i(S)$ in a plurality of pixel groups are obtained on the basis of subpixel input signal values in a plurality of pixels in the same manner as in [Step-400] of Example 4. Specifically, $S_{(p,q)-1}$, $S_{(p,q)-2}$, $V(S)_{(p,q)-1}$, and $V(S)_{(p,q)-2}$ are obtained from Expressions (43-1), (43-2), (43-3), and (43-4) on the basis of the input signal value $x_{1-(p,q)-1}$ of a first subpixel input signal, the input signal value $x_{2-(p,q)-1}$ of a second subpixel input signal, and the input signal value $x_{3-(p,q)-1}$ of a third subpixel input signal to the (p,q)th first pixel $Px_{(p,q)-1}$ and the input signal value $x_{1-(p,q)-2}$ of a first subpixel input signal, the input signal value $x_{2-(p,q)-2}$ of a second subpixel input signal, and the input signal value $x_{3-(p,q)-2}$ of a third subpixel input signal to the second pixel $Px_{(p,q)-2}$. This process will be performed for all pixel groups.

[Step-1010]

Next, in the signal processor 20, the corrected expansion coefficients $\alpha'_{i-0}$ is determined from the values of $V_{max}(S)/V_i(S)$ obtained in a plurality of pixel groups in the same manner as in Example 1. Alternatively, the corrected expansion coefficient $\alpha'_{i-0}$ is determined from the predetermined value $\beta_{PD}$ [driving method-A], the corrected expansion coefficient $\alpha'_{i-0}$ is determined on the basis of the definitions of Expression (15-2), Expressions (16-1) to (16-5), or Expressions (17-1) to (17-6) [driving method-B, driving method-C, and driving method-D], or the corrected expansion coefficient $\alpha'_{i-0}$ is determined on the basis of the definitions in the driving method-E.

[Step-1020]

Thereafter, in the signal processor 20, the fourth subpixel output signal value $X_{4-(p,q)-2}$ to the (p,q)th pixel group $PG_{(p,q)}$ is obtained from Expressions (101-1), (101-2), and (102). [Step-1010] and [Step-1020] may be performed simultaneously.

[Step-1030]

Next, in the signal processor 20, a first subpixel output signal value $X_{1-(p,q)-2}$ to the (p,q)th second pixel $Px_{(p,q)-2}$ is obtained from Expressions (3-A), (3-B), (3-E), (3-F), (3-a'), (3-f), and (3-g) on the basis of the input signal value $x_{1-(p,q)-2}$, the corrected expansion coefficient $\alpha'_{i-0}$, and the constant $\chi$, and a second subpixel output signal value $X_{2-(p,q)-2}$ is obtained on the basis of the input signal value $x_{2-(p,q)-2}$, the corrected expansion coefficient $\alpha'_{i-0}$, and the constant $\chi$. A first subpixel output signal value $X_{1-(p,q)-1}$ to the (p,q)th first pixel $Px_{(p,q)-1}$ is obtained on the basis of the input signal value $x_{1-(p,q)-1}$, the corrected expansion coefficient $\alpha'_{i-0}$, and the constant $\chi$, a second subpixel output signal value $X_{2-(p,q)-1}$ is obtained on the basis of the input signal value $x_{2-(p,q)-1}$, the corrected expansion coefficient $\alpha'_{i-0}$, and the constant $\chi$, and a third subpixel output signal value $X_{3-(p,q)-1}$ is obtained on the basis of the input signal values $x_{3-(p,q)-1}$ and $x_{3-(p,q)-2}$, the corrected expansion coefficient $\alpha'_{i-0}$, and the constant $\chi$. Note that [Step-1020] and [Step-1030] may be performed simultaneously, or [Step-1020] may be performed after [Step-1030] has been performed.

In the method of driving an image display device of Example 10, the output signal values $X_{1-(p,q)-2}$, $X_{2-(p,q)-2}$, $X_{4-(p,q)-2}$, $X_{1-(p,q)-1}$, $X_{2-(p,q)-1}$, and $X_{3-(p,q)-1}$ in the (p,q)th pixel group $PG_{(p,q)}$ are expanded $\alpha'_{i-0}$ times. For this reason, in order to match the luminance of an image the same as the luminance of an image in an unexpanded state, it is desirable to decrease the luminance of the planar light source device 50 on the basis of the corrected expansion coefficient $\alpha'_{i-0}$. Specifically, it should suffice that the luminance of the planar light source device 50 is $(1/\alpha'_{i-0})$ times. Therefore, it is possible to achieve reduction in power consumption in the planar light source device.

Note that, in each pixel group, the ratio of the output signal values in the first pixel and the second pixel $$X_{1-(p,q)-2}:X_{2-(p,q)-2}$$

$$X_{1-(p,q)-1}:X_{2-(p,q)-1}:X_{3-(p,q)-1}$$

is slightly different from the ratio of the input signal values:

$$x_{1-(p,q)-2}:x_{2-(p,q)-2}$$

$$x_{1-(p,q)-1}:x_{2-(p,q)-1}:x_{3-(p,q)-1}.$$

While, when viewing each pixel alone, a slight difference occurs regarding the color tone of each pixel relative to an input signal, when viewing pixels as a pixel group, no problem occurs regarding the color tone of each pixel group.

If the relationship between the fourth subpixel control first signal value $SG_{1-(p,q)}$ and the fourth subpixel control second signal value $SG_{2-(p,q)}$ departs from a certain condition, the adjacent pixel may be changed. That is, when the adjacent pixel is the (p,q−1)th pixel, the adjacent pixel may be changed to the (p,q+1)th pixel, or the adjacent pixel may be changed to the (p,q−1)th pixel and the (p,q+1)th pixel.

Alternatively, if the relationship between the fourth subpixel control first signal value $SG_{1-(p,q)}$ and the fourth subpixel control second signal value $SG_{2-(p,q)}$ departs from the certain condition, that is, for example, if the value of $|SG_{1-(p,q)}-SG_{2-(p,q)}|$ is equal to or greater than (or equal to or smaller than) a predetermined value $X''_1$, a value based on only $SG_{1-(p,q)}$ or a value based on only $SG_{2-(p,q)}$ can be used as the value of $X_{4-(p,q)-2}$, and each example can be applied. Alternatively, if the value of $(SG_{1-(p,q)}-SG_{2-(p,q)})$ is equal to or greater than the predetermined value $X''_2$ or if the value of $(SG_{1-(p,q)}-SG_{2-(p,q)})$ is equal to or less than a predetermined value $X''_3$, an operation to perform a process different from the process in Example 10 may be performed.

Figure 24:
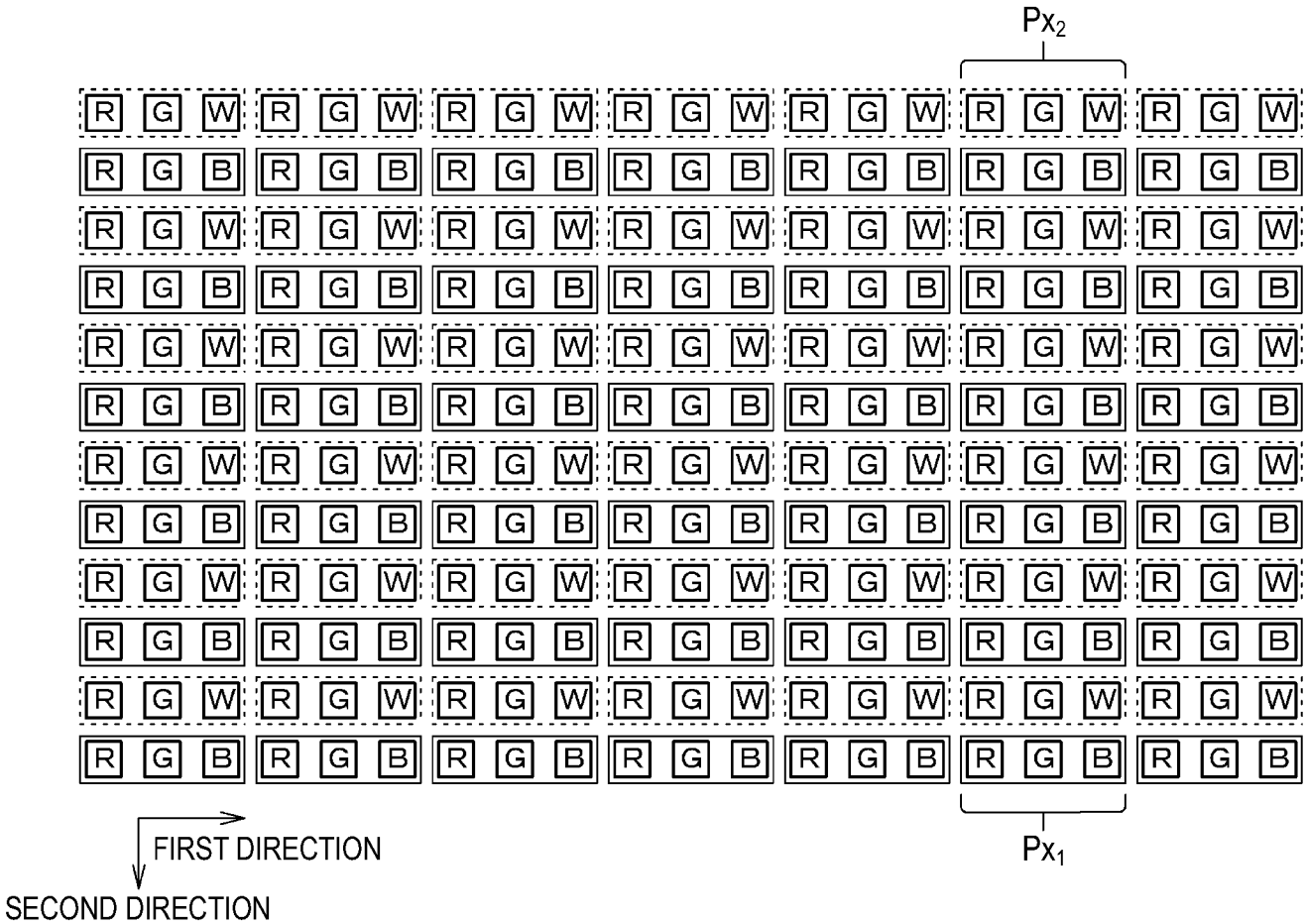
FIG. 24 is a diagram schematically showing still another example of the layout of pixels and pixel groups in the image display device of Example 10.

In some cases, the arrangement of pixel groups described in Example 10 may be changed as follows, and the method of driving an image display device described in Example 10 may be executed substantially. That is, as shown in FIG. 24, there may be used a method of driving an image display device, wherein the image display device includes an image display panel which has P×Q pixels in total of P pixels in a first direction and Q pixels in a second direction arranged in a two-dimensional matrix, and a signal processor, the image display panel has a first pixel array where first pixels are arranged in the first direction and a second pixel array where second pixels are arranged in the first direction, the second pixel array being adjacent to the first pixel array, and the first pixel array and the second pixel array being alternately arranged, the first pixel has a first subpixel R displaying a first primary color, a second subpixel G displaying a second primary color, and a third subpixel B displaying a third primary color, the second pixel has a first subpixel R displaying a first primary color, a second subpixel G displaying a second primary color, and a fourth subpixel W displaying a fourth color, in the signal processor, a first subpixel output signal to a first pixel is obtained on the basis of at least a first subpixel input signal to the first pixel and a corrected expansion coefficient and output to the first subpixel R of the first pixel, a second subpixel output signal to the first pixel is obtained on the basis of at least a second subpixel input signal to the first pixel and the corrected expansion coefficient $\alpha'_{i-0}$, and output to the second subpixel G of the first pixel, a first subpixel output signal to a second pixel is obtained on the basis of at least a first subpixel input signal to the second pixel and the corrected expansion coefficient $\alpha'_{i-0}$, and output to the first subpixel R of the second pixel, and a second subpixel output signal to the second pixel is obtained on the basis of at least a second subpixel input signal to the second pixel and the corrected expansion coefficient $\alpha'_{i-0}$, and output to the second subpixel G of the second pixel, and in the signal processor, further, a fourth subpixel output signal is obtained on the basis of a fourth subpixel control second signal obtained from a first subpixel input signal, a second subpixel input signal, and a third subpixel input signal to a (p,q)th [where p=1, 2, . . . , and P, and q=1, 2, . . . , and Q] second pixel when counting in the second direction and a fourth subpixel control first signal obtained from a first subpixel input signal, a second subpixel input signal, and a third subpixel input signal to a first pixel adjacent to the (p,q)th second pixel in the second direction, and the obtained fourth subpixel output signal is output to the (p,q)th second pixel, and a third subpixel output signal is obtained on the basis of at least a third subpixel input signal to the (p,q)th second pixel and a third subpixel input signal to a first pixel adjacent to the (p,q)th second pixel, and the obtained third subpixel output signal is output to the (p,q)th first pixel.

Although the present disclosure has been described on the basis of the preferred examples, the present disclosure is not limited to these examples. A configuration and structure of a color liquid crystal display, a planar light source device, a planar light source unit, a driving circuit described in the examples is for illustration, and a member, a material, and the like forming these are also for illustration and can be appropriately changed.

Any two driving methods of the first embodiment of the present disclosure (or the driving method-A according to the first embodiment of the present disclosure), the driving method-B according to the first embodiment of the present disclosure, the driving method-C according to the first embodiment of the present disclosure, and the driving method-D according to the first embodiment of the present disclosure may be combined, any three driving methods may be combined, or all of the four driving methods may be combined. Any two driving methods of the second embodiment of the present disclosure (or the driving method-A according to the second embodiment of the present disclosure), the driving method-B according to the second embodiment of the present disclosure, the driving method-C according to the second embodiment of the present disclosure, and the driving method-D according to the second embodiment of the present disclosure may be combined, any three driving methods may be combined, or all of the four driving methods may be combined. Any two driving methods of the third embodiment of the present disclosure (or the driving method-A according to the third embodiment of the present disclosure), the driving method-B according to the third embodiment of the present disclosure, the driving method-C according to the third embodiment of the present disclosure, and the driving method-D according to the third embodiment of the present disclosure may be combined, any three driving methods may be combined, and all of the four driving methods may be combined. Any two driving methods of the fourth embodiment of the present disclosure (or the driving method-A according to the fourth embodiment of the present disclosure), the driving method-B according to the fourth embodiment of the present disclosure, the driving method-C according to the fourth embodiment of the present disclosure, and the driving method-D according to the fourth embodiment of the present disclosure may be combined, any three driving methods may be combined, or all of the four driving methods may be combined. Any two driving methods of the fifth embodiment of the present disclosure (or the driving method-A according to the fifth embodiment of the present disclosure), the driving method-B according to the fifth embodiment of the present disclosure, the driving method-C according to the fifth embodiment of the present disclosure, and the driving method-D according to the fifth embodiment of the present disclosure may be combined, any three driving methods may be combined, or all of the four driving methods may be combined.

Although in the examples, a plurality of pixels (or a set of a first subpixel R, a second subpixel G, and a third subpixel B) of which the saturation $S_i$ and the luminosity $V_i(S)$ should be obtained are all of P×Q pixels (or a set of a first subpixel R, a second subpixel G, and a third subpixel B), or all of $P_0 \times Q_0$ pixel groups, the present disclosure is not limited thereto. That is, a plurality of pixels (or a set of a first subpixel R, a second subpixel G, and a third subpixel B) of which the saturation $S_i$ and the luminosity $V_i(S)$ should be obtained, or pixel groups may be, for example, one for every four pixels or pixel groups or for every eight pixels or pixel groups.

Although in Example 1, the corrected expansion coefficient $\alpha'_{i-0}$ is obtained on the basis of a first subpixel input signal, a second subpixel input signal, a third subpixel input signal, and the like, the corrected expansion coefficient $\alpha'_{i-0}$ may be obtained on the basis of one input signal of a first subpixel input signal, a second subpixel input signal, and a third subpixel input signal (or one input signal of subpixel input signals in a set of a first subpixel R, a second subpixel G, and a third subpixel B, or one input signal of a first input signal, a second input signal, and a third input signal). Specifically, for example, an input signal value $x_{2-(p,q)}$ as to green may be used as an input signal value of any one kind of input signal. In the same manner as in the examples, a signal value $X_{4-(p,q)}$, and further, signal values $X_{1-(p,q)}$, $X_{2-(p,q)}$, and $X_{3-(p,q)}$ obtained from the obtained corrected expansion coefficient $\alpha'_{i-0}$. In this case, instead of $S_{(p,q)}$ and $V(S)_{(p,q)}$ in Expressions (12-1) and (12-2), "1" may be used as the value of $S_{(p,q)}$ (that is, $x_{2-(p,q)}$ is used as the value of $Max_{(p,q)}$ in Expression (12-1), and $Min_{(p,q)}=0$)), and $x_{2-(p,q)}$ may be used as $V(S)_{(p,q)}$. Similarly, the corrected expansion coefficient $\alpha'_{i-0}$ may be obtained on the basis of the input signal values of any two kinds of input signals of a first subpixel input signal, a second subpixel input signal, and a third subpixel input signal (or any two kinds of input signals of subpixel input signals in a set of a first subpixel R, a second subpixel G, and a third subpixel B, or any two kinds of input signals of a first input signal, a second input signal, and a third input signal). Specifically, for example, an input signal value $x_{1-(p,q)}$ as to red and an input signal value $x_{2-(p,q)}$ as to green may be used. A signal value $X_{4-(p,q)}$, and further signal values $X_{1-(p,q)}$, $X_{2-(p,q)}$, and $X_{3-(p,q)}$ may be obtained from the obtained corrected expansion coefficient $\alpha'_{i-0}$ in the same manner as in the examples. Note that, in this case, $S_{(p,q)}$ and $V(S)_{(p,q)}$ of Expressions (12-1) and (12-2) are not used, and as the value of $S_{(p,q)}$, when $x_{1-(p,q)} \geq x_{2-(p,q)}$, $$S_{(p,q)}=(x_{1-(p,q)}-x_{2-(p,q)})/x_{1-(p,q)}$$

$$V(S)_{(p,q)}=x_{1-(p,q)}$$

may be used, and when $x_{1-(p,q)}<x_{2-(p,q)}$, $$S_{(p,q)}=(x_{2-(p,q)}-x_{1-(p,q)})/x_{2-(p,q)}$$

$$V(S)_{(p,q)}=x_{2-(p,q)}$$

may be used. For example, when a color image display device displays a one-colored image, it is sufficient to perform this expansion process. The same applies to other examples.

Figure 25:
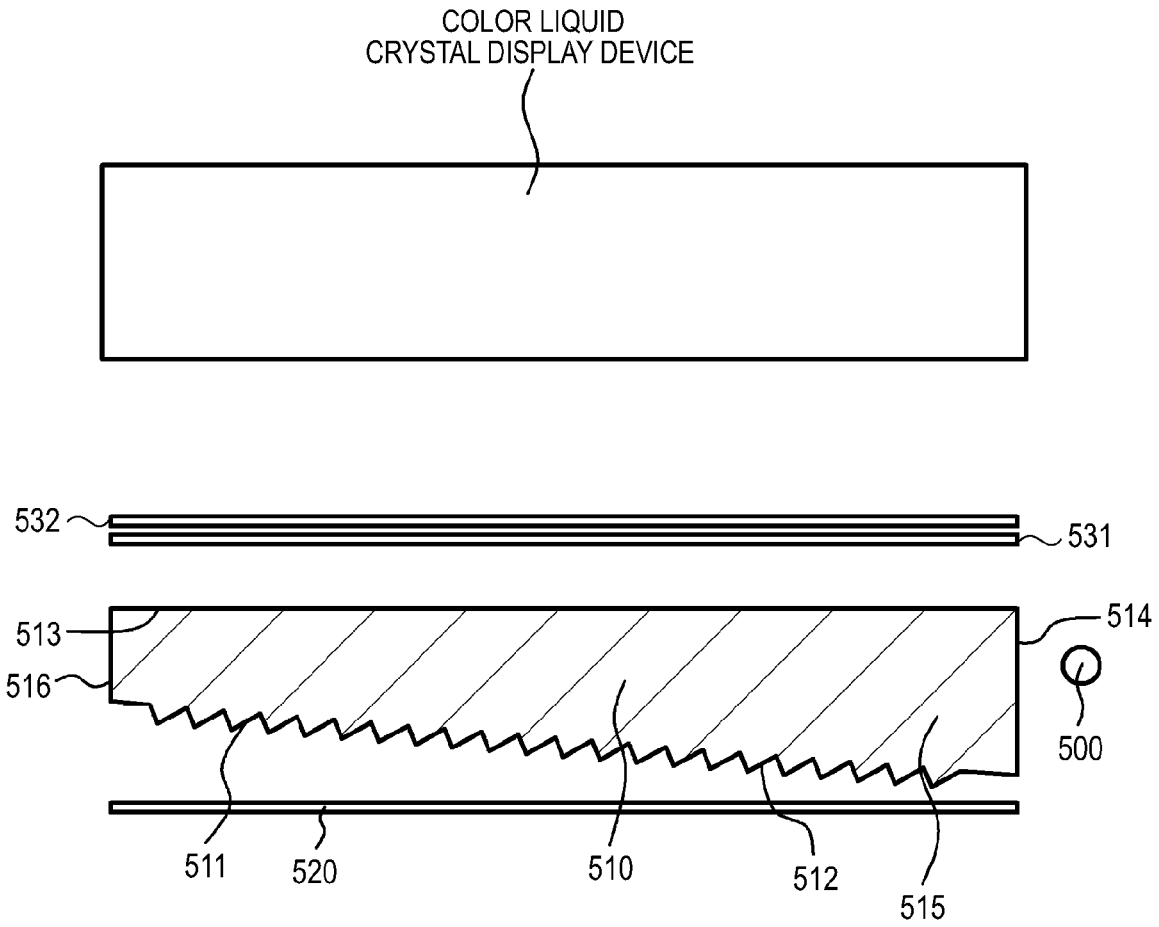
FIG. 25 is a conceptual diagram of an edge light-type (side light-type) planar light source device.

An edge light-type (side light-type) planar light source device may be used. In this case, as shown in a conceptual diagram of FIG. 25, for example, a light guide plate 510 made of polycarbonate resin has a first surface (bottom surface) 511, a second surface (top surface) 513 facing the first surface 511, a first lateral surface 514, a second lateral surface 515, a third lateral surface 516 facing the first lateral surface 514, and a fourth lateral surface facing the second lateral surface 515. A more specific shape of the light guide plate is as a whole a wedge-shaped truncated pyramid in which two opposing lateral surfaces of the truncated pyramid correspond to the first surface 511 and the second surface 513, and the bottom surface of the truncated pyramid corresponds to the first lateral surface 514. A recessed and protruding portion 512 is provided in the surface portion of the first surface 511. The cross-sectional shape of a continuous protruding and recessed portion of the light guide plate 510 taken using a virtual plane perpendicular to the first surface 511 in the first primary color light input direction to the light guide plate 510 is a triangle. That is, the recessed and protruding portion 512 provided in the surface portion of the first surface 511 has a prism shape. The second surface 513 of the light guide plate 510 may be smooth (that is, may have a mirrored surface), or blasted texturing having light diffusion effect may be provided (that is, a minute serrated surface may be provided). A light reflection member 520 is disposed to face the first surface 511 of the light guide plate 510. An image display panel (for example, color liquid crystal display panel) is disposed to face the second surface 513 of the light guide plate 510. A light diffusion sheet 531 and a prism sheet 532 are further disposed between the image display panel and the second surface 513 of the light guide plate 510. First primary color light emitted from a light source 500 is input from the first surface 514 (for example, the surface corresponding to the bottom surface of the truncated pyramid) of the light guide plate 510 to the light guide plate 510, collides against the recessed and protruding portion 512 of the first surface 511 and is scattered, is emitted from the first surface 511, is reflected by the light reflection member 520, is input to the first surface 511 again, is emitted from the second surface 513, passes through the light diffusion sheet 531 and the prism sheet 532, and irradiates the image display panel in various examples.

A fluorescent lamp or a semiconductor laser which emits blue light as first primary color light may be used as a light source instead of a light-emitting diode. In this case, the wavelength $\lambda_1$ of first primary color light corresponding to the first primary color (blue) emitted from the fluorescent lamp or the semiconductor laser may be, for example, 450 nm. A green light-emitting particle corresponding to a second primary color light-emitting particle to be excited by the fluorescent lamp or the semiconductor laser may be a green light-emitting fluorescent particle made of, for example, $SrGa_2S_4$:Eu, and a red light-emitting particle corresponding to a third primary color light-emitting particle may be a red light-emitting fluorescent particle made of, for example, CaS:Eu. Alternatively, when a semiconductor laser is used, the wavelength $\lambda_1$ of first primary color light corresponding to the first primary color (blue) emitted from the semiconductor laser may be 457 nm. In this case, a green light-emitting particle corresponding to a second primary color emitting particle to be excited by the semiconductor layer may be a green light-emitting fluorescent particle made of, for example, $SrGa_2S_4$:Eu, and a red light-emitting particle corresponding to a third primary color light-emitting particle may be a red light-emitting fluorescent particle made of, for example, CaS:Eu. Alternatively, as the light source of the planar light source device, a cold cathode fluorescent lamp (CCFL), a hot cathode fluorescent lamp (HCFL), or an external electrode fluorescent lamp (EEFL) may be used.

The present disclosure may be implemented as the following configurations.

[1] <<Method of Driving Image Display Device: First Form>>

A method of driving an image display device, wherein the image display device includes (A) an image display panel in which pixels each having a first subpixel displaying a first primary color, a second subpixel displaying a second primary color, a third subpixel displaying a third primary color, and a fourth subpixel displaying a fourth color are arranged in a two-dimensional matrix, and (B) a signal processor, in an i-th image display frame, in the signal processor, a first subpixel output signal is obtained on the basis of at least a first subpixel input signal and the corrected expansion coefficient $\alpha'_{i-0}$, and output to the first subpixel, a second subpixel output signal is obtained on the basis of at least a second subpixel input signal and the corrected expansion coefficient $\alpha'_{i-0}$, and output to the second subpixel, a third subpixel output signal is obtained on the basis of at least a third subpixel input signal and the corrected expansion coefficient $\alpha'_{i-0}$, and output to the third subpixel, and a fourth subpixel output signal is obtained on the basis of the first subpixel input signal, the second subpixel input signal, and the third subpixel input signal, and output to the fourth subpixel, the maximum value $V_{max}(S)$ of luminosity with saturation S in an HSV color space enlarged by adding the fourth color as a variable is obtained in the signal processor or stored in the signal processor, and in the i-th image display frame, in the signal processor, (a) saturation $S_i$ and luminosity $V_i(S)$ in a plurality of pixels are obtained on the basis of subpixel input signal values in the plurality of pixels, (b) an expansion coefficient $\alpha_{i-0}$ is obtained on the basis of at least one of the values of $V_{max}(S)/V_i(S)$ obtained in the plurality of pixels, and (c) the corrected expansion coefficient $\alpha'_{i-0}$ is determined on the basis of a corrected expansion coefficient $\alpha'_{(i-j)-0}$ applied in advance in an (i−j)th image display frame (where j is a positive integer equal to or greater than 1) and the expansion coefficient $\alpha_{i-0}$ obtained in the i-th image display frame.

Here, saturation S and luminosity V(S) are represented as follows $$S=(\text{Max}-\text{Min})/\text{Max}$$

$$V(S)=\text{Max}$$

Max: a maximum value among three subpixel input signal values including a first subpixel input signal value, a second subpixel input signal value, and a third subpixel input signal value to the pixel Min: a minimum value among three subpixel input signal values including a first subpixel input signal value, a second subpixel input signal value, and a third subpixel input signal value to the pixel.

[2] <<Method of Driving Image Display Device: Second Form>>

A method of driving an image display device, wherein the image display device includes (A) an image display panel in which pixels each having a first subpixel displaying a first primary color, a second subpixel displaying a second primary color, and a third subpixel displaying a third primary color are arranged in a two-dimensional matrix in a first direction and a second direction, at least a first pixel and a second pixel arranged in the first direction forms a pixel group, and a fourth subpixel displaying a fourth color is arranged between the first pixel and the second pixel in each pixel group, and (B) a signal processor, in an i-th image display frame, in the signal processor, in regard to the first pixel, a first subpixel output signal is obtained on the basis of at least a first subpixel input signal and the corrected expansion coefficient $\alpha'_{i-0}$, and output to the first subpixel, a second subpixel output signal is obtained on the basis of at least a second subpixel input signal and the corrected expansion coefficient $\alpha'_{i-0}$, and output to the second subpixel, and a third subpixel output signal is obtained on the basis of at least a third subpixel input signal and the corrected expansion coefficient $\alpha'_{i-0}$, and output to the third subpixel, in regard to the second pixel, a first subpixel output signal is obtained on the basis of at least a first subpixel input signal and the corrected expansion coefficient $\alpha'_{i-0}$, and output to the first subpixel, a second subpixel output signal is obtained on the basis of at least a second subpixel input signal and the corrected expansion coefficient $\alpha'_{i-0}$, and output to the second subpixel, and a third subpixel output signal is obtained on the basis of at least a third subpixel input signal and the corrected expansion coefficient $\alpha'_{i-0}$, and output to the third subpixel, and in regard to the fourth subpixel, a fourth subpixel output signal is obtained on the basis of a fourth subpixel control first signal obtained from the first subpixel input signal, the second subpixel input signal, and the third subpixel input signal to the first pixel and a fourth subpixel control second signal obtained from the first subpixel input signal, the second subpixel input signal, and the third subpixel input signal to the second pixel, and output to the fourth subpixel, the maximum value $V_{max}(S)$ of luminosity with saturation S in an HSV color space enlarged by adding the fourth color as a variable is obtained in the signal processor or stored in the signal processor, and in the i-th image display frame, in the signal processor, (a) saturation $S_i$ and luminosity $V_i(S)$ in a plurality of pixels are obtained on the basis of subpixel input signal values in the plurality of pixels, (b) an expansion coefficient $\alpha_{i-0}$ is obtained on the basis of at least one of the values of $V_{max}(S)/V_i(S)$ obtained in the plurality of pixels, and (c) the corrected expansion coefficient $\alpha'_{i-0}$ is determined on the basis of a corrected expansion coefficient $\alpha'_{(i-j)-0}$ applied in advance in an (i−j)th image display frame (where j is a positive integer equal to or greater than 1) and the expansion coefficient $\alpha'_{i-0}$ obtained in the i-th image display frame.

Here, saturation S and luminosity V(S) are represented as follows $$S=(\text{Max}-\text{Min})/\text{Max}$$

$$V(S)=\text{Max}$$

Max: a maximum value among three subpixel input signal values including a first subpixel input signal value, a second subpixel input signal value, and a third subpixel input signal value to the pixel Min: a minimum value among three subpixel input signal values including a first subpixel input signal value, a second subpixel input signal value, and a third subpixel input signal value to the pixel.

[3] <<Method of Driving Image Display Device: Third Form>>

A method of driving an image display device, wherein the image display device includes (A) an image display panel in which P×Q pixel groups in total of P pixel groups in a first direction and Q pixel groups in a second direction are arranged in a two-dimensional matrix, and (B) a signal processor, each pixel group has a first pixel and a second pixel in the first direction, the first pixel has a first subpixel displaying a first primary color, a second subpixel displaying a second primary color, and a third subpixel displaying a third primary color, the second pixel has a first subpixel displaying a first primary color, a second subpixel displaying a second primary color, and a fourth subpixel displaying a fourth color, in an i-th image display frame, in the signal processor, a third subpixel output signal to a (p,q)th [where p=1, 2, . . . , and P, and q=1, 2, . . . , and Q] first pixel when counting in the first direction is obtained on the basis of at least a third subpixel input signal to the (p,q)th first pixel, a third subpixel input signal to a (p,q)th second pixel, and a corrected expansion coefficient $\alpha'_{i-0}$, and output to the third subpixel of the (p,q)th first pixel, and a fourth subpixel output signal to the (p,q)th second pixel is obtained on the basis of a fourth subpixel control second signal obtained from a first subpixel input signal, a second subpixel input signal, and the third subpixel input signal to the (p,q)th second pixel, a fourth subpixel control first signal obtained from a first subpixel input signal, a second subpixel input signal, and a third subpixel input signal to an adjacent pixel adjacent to the (p,q)th second pixel in the first direction, and the corrected expansion coefficient $\alpha'_{i-0}$, and output to the fourth subpixel of the (p,q)th second pixel, the maximum value $V_{max}(S)$ of luminosity with saturation S in an HSV color space enlarged by adding a fourth color as a variable is obtained in the signal processor or stored in the signal processor, and in the i-th image display frame, in the signal processor, (a) saturation $S_i$ and luminosity $V_i(S)$ in a plurality of pixels are obtained on the basis of subpixel input signal values in the plurality of pixels, (b) an expansion coefficient $\alpha_{i-0}$ is obtained on the basis of at least one of the values of $V_{max}(S)/V_i(S)$ obtained in the plurality of pixels, and (c) the corrected expansion coefficient $\alpha'_{i-0}$ is determined on the basis of a corrected expansion coefficient $\alpha'_{(i-j)-0}$ applied in advance in an (i−j)th image display frame (where j is a positive integer equal to or greater than 1) and the expansion coefficient $\alpha_{i-0}$ obtained in the i-th image display frame.

Here, saturation S and luminosity V(S) are represented as follows $$S=(\text{Max}-\text{Min})/\text{Max}$$

$$V(S)=\text{Max}$$

Max: a maximum value among three subpixel input signal values including a first subpixel input signal value, a second subpixel input signal value, and a third subpixel input signal value to the pixel Min: a minimum value among three subpixel input signal values including a first subpixel input signal value, a second subpixel input signal value, and a third subpixel input signal value to the pixel.

[4] <<Method of Driving Image Display Device: Fourth Form>>

A method of driving an image display device, wherein the image display device includes (A) an image display panel in which $P_0 \times Q_0$ pixels in total of $P_0$ pixels in a first direction and $Q_0$ pixels in a second direction are arranged in a two-dimensional matrix, and (B) a signal processor, each pixel has a first subpixel displaying a first primary color, a second subpixel displaying a second primary color, a third subpixel displaying a third primary color, and a fourth subpixel displaying a fourth color, in an i-th image display frame, in the signal processor, a first subpixel output signal is obtained on the basis of at least a first subpixel input signal and the corrected expansion coefficient $\alpha'_{i-0}$, and output to the first subpixel, a second subpixel output signal is obtained on the basis of at least a second subpixel input signal and the corrected expansion coefficient $\alpha'_{i-0}$, and output to the second subpixel, a third subpixel output signal is obtained on the basis of at least a third subpixel input signal and the corrected expansion coefficient $\alpha'_{i-0}$, and output to the third subpixel, and a fourth subpixel output signal to a (p,q)th [where p=1, 2, . . . , and $P_0$, and q=1, 2, . . . , and $Q_0$] pixel when counting in the second direction is obtained on the basis of a fourth subpixel control second signal obtained from a first subpixel input signal, a second subpixel input signal, and a third subpixel input signal to the (p,q)th pixel and a fourth subpixel control first signal obtained from a first subpixel input signal, a second subpixel input signal, and a third subpixel input signal to an adjacent pixel adjacent to the (p,q)th pixel in the second direction, and output to the fourth subpixel of the (p,q)th pixel, the maximum value $V_{max}(S)$ of luminosity with saturation S in an HSV color space enlarged by adding the fourth color as a variable is obtained in the signal processor or stored in the signal processor, and in the i-th image display frame, in the signal processor, (a) saturation $S_i$ and luminosity $V_i(S)$ in a plurality of pixels are obtained on the basis of subpixel input signal values in the plurality of pixels, (b) an expansion coefficient $\alpha_{i\text{-}0}$ is obtained on the basis of at least one of the values of $V_{max}(S)/V_i(S)$ obtained in the plurality of pixels, and (c) the corrected expansion coefficient $\alpha'_{i\text{-}0}$ is determined on the basis of a corrected expansion coefficient $\alpha'_{(i\text{-}j)\text{-}0}$ applied in advance in an (i−j)th image display frame (where j is a positive integer equal to or greater than 1) and the expansion coefficient $\alpha_{i\text{-}0}$ obtained in the i-th image display frame.

Here, saturation S and luminosity V(S) are represented as follows $$S=(\text{Max}-\text{Min})/\text{Max}$$

$$V(S)=\text{Max}$$

Max: a maximum value among three subpixel input signal values including a first subpixel input signal value, a second subpixel input signal value, and a third subpixel input signal value to the pixel Min: a minimum value among three subpixel input signal values including a first subpixel input signal value, a second subpixel input signal value, and a third subpixel input signal value to the pixel.

[5] <<Method of Driving Image Display Device: Fifth Form>>

A method of driving an image display device, wherein the image display device includes (A) an image display panel in which P×Q pixel groups in total of P pixel groups in a first direction and Q pixel groups in a second direction are arranged in a two-dimensional matrix, and (B) a signal processor, each pixel group has a first pixel and a second pixel in the first direction, the first pixel has a first subpixel displaying a first primary color, a second subpixel displaying a second primary color, and a third subpixel displaying a third primary color, the second pixel has a first subpixel displaying a first primary color, a second subpixel displaying a second primary color, and a fourth subpixel displaying a fourth color, in an i-th image display frame, in the signal processor, a fourth subpixel output signal is obtained on the basis of a fourth subpixel control second signal obtained from a first subpixel input signal, a second subpixel input signal, and a third subpixel input signal to a (p,q)th [where p=1, 2, . . . , and P and q=1, 2, . . . , and Q] second pixel when counting in the second direction, a fourth subpixel control first signal obtained from a first subpixel input signal, a second subpixel input signal, and a third subpixel input signal to an adjacent pixel adjacent to the (p,q)th second pixel in the second direction, and a corrected expansion coefficient $\alpha'_{i\text{-}0}$, and output to the fourth subpixel of the (p,q)th second pixel, and a third subpixel output signal is obtained on the basis of at least a third subpixel input signal to the (p,q)th second pixel, a third subpixel input signal to a (p,q)th first pixel, and the corrected expansion coefficient $\alpha'_{i\text{-}0}$, and output to the third subpixel of the (p,q)th first pixel, the maximum value $V_{max}(S)$ of luminosity with saturation S in an HSV color space enlarged by adding the fourth color as a variable is obtained in the signal processor or stored in the signal processor, and in the i-th image display frame, in the signal processor (a) saturation $S_i$ and luminosity $V_i(S)$ in a plurality of pixels are obtained on the basis of subpixel input signal values in the plurality of pixels, (b) an expansion coefficient $\alpha_{i\text{-}0}$ is obtained on the basis of at least one of the values of $V_{max}(S)/V_i(S)$ obtained in the plurality of pixels, and (c) the corrected expansion coefficient $\alpha'_{i\text{-}0}$ is determined on the basis of a corrected expansion coefficient $\alpha'_{(i\text{-}j)\text{-}0}$ applied in advance in an (i−j)th image display frame (where j is a positive integer equal to or greater than 1) and the expansion coefficient $\alpha_{i\text{-}0}$ obtained in the i-th image display frame.

Here, saturation S and luminosity V(S) are represented as follows $$S=(\text{Max}-\text{Min})/\text{Max}$$

$$V(S)=\text{Max}$$

Max: a maximum value among three subpixel input signal values including a first subpixel input signal value, a second subpixel input signal value, and a third subpixel input signal value to the pixel Min: a minimum value among three subpixel input signal values including a first subpixel input signal value, a second subpixel input signal value, and a third subpixel input signal value to the pixel.

[6] The Method Described in any One of [1] to [5], wherein, when $\Delta_1>\Delta_2>0$, $\Delta_4>\Delta_3>0$, a first predetermined value is $\epsilon_1$, a second predetermined value is $\epsilon_2$, a third predetermined value is $\epsilon_3$, a fourth predetermined value is $\epsilon_4$, $\epsilon_1<\epsilon_2<0$, and $\epsilon_4>\epsilon_3>0$ , (A) if the value of $(1/\delta_1)=(1/\alpha_{i\text{-}0})-(1/\alpha'_{(i\text{-}j)\text{-}0})$ is smaller than the first predetermined value $\epsilon_1$, the corrected expansion coefficient $\alpha'_{i\text{-}0}$ is calculated on the basis of the following expression, $$(1/\alpha'_{i\text{-}0})=(1/\alpha'_{(i\text{-}j)\text{-}0})-\Delta_1$$

(B) if $(1/\delta_i)$ is equal to or greater than the first predetermined value $\epsilon_1$ and smaller than the second predetermined value $\epsilon_2$, the corrected expansion coefficient $\alpha'_{i\text{-}0}$ is calculated on the basis of the following expression, $$(1/\alpha'_{i\text{-}0})=(1/\alpha'_{(i\text{-}j)\text{-}0})-\Delta_2$$

(C) if $(1/\omega_i)$ is equal to or greater than the second predetermined value $\epsilon_2$ and smaller than the third predetermined value $\epsilon_3$, the corrected expansion coefficient $\alpha'_{i\text{-}0}$ is calculated on the basis of the following expression, $$(1/\alpha'_{i\text{-}0})=(1/\alpha'_{(i\text{-}j)\text{-}0})$$

(D) if $(1/\delta_i)$ is equal to or greater than the third predetermined value $\epsilon_3$ and smaller than the fourth predetermined value $\epsilon_4$, the corrected expansion coefficient $\alpha'_{i-0}$ is calculated on the basis of the following expression, and $$(1/\alpha'_{i-0})=(1/\alpha'_{(i-j)-0})-\Delta_3$$

(E) if $(1/\delta_i)$ is equal to or greater than the fourth predetermined value $\epsilon_4$, the corrected expansion coefficient $\alpha'_{i-0}$ is calculated on the basis of the following expression $$(1/\alpha'_{i-0})=(1/\alpha'_{(i-j)-0})-\Delta_4.$$

[7] The Method Described in any One of [1] to [6], wherein the image display device further includes a planar light source device which illuminates the image display panel, and the brightness of the planar light source device is controlled using the corrected expansion coefficient

[8] The Method Described in any One of [1] to [7], wherein the brightness of the planar light source device which is controlled using the corrected expansion coefficient $\alpha'_{i-0}$ is the brightness of the planar light source device in an (i+k)th image display frame (where $0 \le k \le 5$).

The present disclosure contains subject matter related to that disclosed in Japanese Priority Patent Application JP 2011-166593 filed in the Japan Patent Office on Jul. 29, 2011, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A method of driving an image display device that includes (A) an image display panel in which pixels each having a first subpixel displaying a first primary color, a second subpixel displaying a second primary color, a third subpixel displaying a third primary color, and a fourth subpixel displaying a fourth color are arranged in a two-dimensional matrix, and (B) a signal processor, the method comprising:

(1) in an i-th image display frame, in the signal processor:

(a) obtaining a first subpixel output signal on the basis of at least a first subpixel input signal and a corrected expansion coefficient $\alpha'_{i-0}$, and outputting the first subpixel output signal to the first subpixel, (b) obtaining a second subpixel output signal on the basis of at least a second subpixel input signal and the corrected expansion coefficient $\alpha'_{i-0}$, and outputting the second subpixel output signal to the second subpixel, (c) obtaining a third subpixel output signal on the basis of at least a third subpixel input signal and the corrected expansion coefficient $\alpha'_{i-0}$, and outputting the third subpixel output signal to the third subpixel, and (d) obtaining a fourth subpixel output signal on the basis of the first subpixel input signal, the second subpixel input signal, and the third subpixel input signal, and outputting the fourth subpixel output signal to the fourth subpixel;

(2) obtaining in the signal processor or storing in the signal processor a maximum value $V_{max}(S)$ of luminosity with a saturation S in an HSV color space enlarged by adding the fourth color as a variable; and (3) in the i-th image display frame, in the signal processor:

(a) obtaining a saturation $S_i$ and a luminosity $V_i(S)$ in a plurality of pixels on the basis of subpixel input signal values in the plurality of pixels, (b) obtaining an expansion coefficient $\alpha_{i-0}$ on the basis of at least one of the values of $_{Vmax}(_S)/V_i(_S)$ obtained in the plurality of pixels, and (c) determining the corrected expansion coefficient $\alpha'_{i-0}$ on the basis of a value obtained by (i) calculating a difference between (1) a first reciprocal of the expansion coefficient $\alpha_{i-0}$ obtained in the i-th image display frame and (2) a second reciprocal of a corrected expansion coefficient $\alpha'_{(i-j)-0}$ applied in advance in an (i−j)th image display frame (where j is a positive integer equal to or greater than 1), (ii) obtaining a correction value corresponding to the difference, and (iii) adding or subtracting the correction value to or from the second reciprocal, wherein, the saturation S and the luminosity V(S) are represented as follows:

$$S=(\text{Max}-\text{Min})/\text{Max}$$

$$V(S)=\text{Max}$$

where, Max is a maximum value among three subpixel input signal values including a first subpixel input signal value, a second subpixel input signal value, and a third subpixel input signal value to the pixel, and Min is a minimum value among the three subpixel input signal values including the first subpixel input signal value, the second subpixel input signal value, and the third subpixel input signal value to the pixel;

(a) the correction value includes $\Delta_1$, $\Delta_2$, $\Delta_3$, and $\Delta_4$;

(b) when $\Delta_l>\Delta_2>0$ and $\Delta_4>A>0$, a first predetermined value is $\epsilon_1$, a second predetermined value is $\epsilon_2$, a third predetermined value is $\epsilon_3$, a fourth predetermined value is $\epsilon_4$, $\epsilon_1<\epsilon_2<0$, and $\epsilon_4>\epsilon_3>0$;

(c) if a value of the difference is smaller than the first predetermined value $\epsilon_1$, the corrected expansion coefficient $\alpha'_{i-0}$ is calculated on the basis of the following expression:

$$(1/\alpha'_{i-0})=(1/\alpha'_{(i-j)-0})-\Delta_1;$$

(d) if the value of the difference is equal to or greater than the first predetermined value $\epsilon_1$ and smaller than the second predetermined value $\epsilon_2$ the corrected expansion coefficient $\alpha'_{i-0}$ is calculated on the basis of the following expression:

$$(1/\alpha'_{i-0})=(1/\alpha'_{(i-j)-0})-\Delta_2;$$

(e) if the value of the difference is equal to or greater than the second predetermined value $\epsilon_2$ and smaller than the third predetermined value $\epsilon_3$, the corrected expansion coefficient $\alpha'_{i-0}$ is calculated on the basis of the following expression:

$$(1/\alpha'_{i-0})=(1/\alpha'_{(i-j)-0});$$

(f) if the value of the difference is equal to or greater than the third predetermined value $\epsilon_3$ and smaller than the fourth predetermined value $\epsilon_4$, the corrected expansion coefficient $\alpha'_{i-0}$ is calculated on the basis of the following expression:

$$(1/\alpha'_{i-0})=(1/\alpha'_{(i-j)-0})+\Delta_3;\text{ and}$$

(g) if the value of the difference is equal to or greater than the fourth predetermined value $\epsilon_4$, the corrected expansion coefficient $\alpha'_{i-0}$ is calculated on the basis of the following expression:

$$(1/\alpha'_{i-0})=(1/\alpha'_{(i-j)-0})+\Delta_4.$$

2. A method of driving an image display device that includes (A) an image display panel in which pixels each having a first subpixel displaying a first primary color, a second subpixel displaying a second primary color, and a third subpixel displaying a third primary color are arranged in a two-dimensional matrix in a first direction and a second direction, at least a first pixel and a second pixel arranged in the first direction forms a pixel group, and a fourth subpixel displaying a fourth color is arranged between the first pixel and the second pixel in each pixel group, and (B) a signal processor, the method comprising:

(1) in an i-th image display frame, in the signal processor:

(a) in regard to the first pixel, (i) obtaining a first subpixel output signal on the basis of at least a first subpixel input signal and a corrected expansion coefficient $\alpha'_{i-0}$ and outputting the first subpixel output signal to the first subpixel, (ii) obtaining a second subpixel output signal on the basis of at least a second subpixel input signal and the corrected expansion coefficient $\alpha'_{i-0}$, and outputting the second subpixel output signal to the second subpixel, and (iii) obtaining a third subpixel output signal on the basis of at least a third subpixel input signal and the corrected expansion coefficient $\alpha'_{i-0}$, and outputting the third subpixel output signal to the third subpixel, (b) in regard to the second pixel, (i) obtaining a first subpixel output signal on the basis of at least a first subpixel input signal and a corrected expansion coefficient $\alpha'_{i-0}$, and outputting the first subpixel output signal to the first subpixel, (ii) obtaining a second subpixel output signal on the basis of at least a second subpixel input signal and the corrected expansion coefficient $\alpha'_{i-0}$, and outputting the second subpixel output signal to the second subpixel, and (iii) obtaining a third subpixel output signal on the basis of at least a third subpixel input signal and the corrected expansion coefficient $\alpha'_{i-0}$, and outputting the third subpixel output signal to the third subpixel, and (c) in regard to the fourth subpixel, obtaining a fourth subpixel output signal on the basis of a fourth subpixel control first signal obtained from the first subpixel input signal, the second subpixel input signal, and the third subpixel input signal to the first pixel and a fourth subpixel control second signal obtained from the first subpixel input signal, the second subpixel input signal, and the third subpixel input signal to the second pixel, and outputting the fourth subpixel output signal to the fourth subpixel;

(2) obtaining in the signal processor or storing in the signal processor a maximum value $V_{max}(S)$ of luminosity with a saturation S in an HSV color space enlarged by adding the fourth color as a variable; and (3) in the i-th image display frame, in the signal processor:

(a) obtaining a saturation $S_i$ and a luminosity $V_i(S)$ in a plurality of pixels on the basis of subpixel input signal values in the plurality of pixels, (b) obtaining an expansion coefficient αhd i-0 on the basis of at least one of the values of $V_{max}(S)/V_i(S)$ obtained in the plurality of pixels, and (c) determining the corrected expansion coefficient $\alpha'_{i-0}$ on the basis of a value obtained by (i) calculating a difference between (1) a first reciprocal of the expansion coefficient $\alpha_{i-0}$ obtained in the i-th image display frame and (2) a second reciprocal of a corrected expansion coefficient $\alpha'_{(i-j)-0}$ applied in advance in an (i−j)th image display frame (where j is a positive integer equal to or greater than 1), (ii) obtaining a correction value corresponding to the difference, and (iii) adding or subtracting the correction value to or from the second reciprocal, wherein, the saturation S and the luminosity V(S) are represented as follows:

$$S=(\text{Max}-\text{Min})/\text{Max}$$

$$V(S)=\text{Max}$$

where, Max is a maximum value among three subpixel input signal values including a first subpixel input signal value, a second subpixel input signal value, and a third subpixel input signal value to the pixel, and Min is a minimum value among the three subpixel input signal values including the first subpixel input signal value, the second subpixel input signal value, and the third subpixel input signal value to the pixel;

(a) the correction value includes $\Delta_1$, $\Delta_2$, $\Delta_3$, and $\Delta_4$;

(b) when $\Delta_1>\Delta_2>0$ and $\Delta_4>\Delta_3>0$, a first predetermined value is $\epsilon_1$, a second predetermined value is $\epsilon_2$, a third predetermined value is $\epsilon_3$, a fourth predetermined value is $\epsilon_4$, $\epsilon_1<\epsilon_2<0$, and $\epsilon_4>\epsilon_3>0$;

(c) if a value of the difference is smaller than the first predetermined value $\epsilon_1$, the corrected expansion coefficient $\alpha'_{i-0}$ is calculated on the basis of the following expression:

$$(1/\alpha'_{i-0})=(1/\alpha'_{(i-j)-0})-\Delta_1;$$

(d) if the value of the difference is equal to or greater than the first predetermined value $\epsilon_1$ and smaller than the second predetermined value $\epsilon_2$, the corrected expansion coefficient $\alpha'_{i-0}$ is calculated on the basis of the following expression:

$$(1/\alpha'_{i-0})=(1/\alpha'_{(i-j)-0})-\Delta_2;$$

(e) if the value of the difference is equal to or greater than the second predetermined value $\epsilon_2$ and smaller than the third predetermined value $\epsilon_3$, the corrected expansion coefficient $\alpha'_{i-0}$ is calculated on the basis of the following expression:

$$(1/\alpha'_{i-0})=(1/\alpha'_{(i-j)-0});$$

(f) if the value of the difference is equal to or greater than the third predetermined value $\epsilon_3$ and smaller than the fourth predetermined value $\epsilon_4$, the corrected expansion coefficient $\alpha'_{i-0}$ is calculated on the basis of the following expression:

$$(1/\alpha'_{i-0})=(1/\alpha'_{(i-j)-0})+\Delta_3;\text{ and}$$

(g) if the value of the difference is equal to or greater than the fourth predetermined value $\epsilon_4$, the corrected expansion coefficient $\alpha'_{i-0}$ is calculated on the basis of the following expression:

$$(1/\alpha'_{i-0})=(1/\alpha'_{(i-j)-0})+\Delta_4.$$

3. A method of driving an image display device, wherein the image display device includes (A) an image display panel in which P×Q pixel groups in total of P pixel groups in a first direction and Q pixel groups in a second direction are arranged in a two-dimensional matrix, and (B) a signal processor, each pixel group has a first pixel and a second pixel in the first direction, the first pixel has a first subpixel displaying a first primary color, a second subpixel displaying a second primary color, and a third subpixel displaying a third primary color, the second pixel has a first subpixel displaying the first primary color, a second subpixel displaying the second primary color, and a fourth subpixel displaying a fourth color, the method comprising:

(1) in an i-th image display frame, in the signal processor:

(a) obtaining a third subpixel output signal to a (p,q)th [where p=1, 2, ..., P, and q=1, 2, ..., and Q] first pixel when counting in the first direction on the basis of at least a third subpixel input signal to the (p,q)th first pixel, a third subpixel input signal to a (p,q)th second pixel, and a corrected expansion coefficient $\alpha'_{i-0}$, and outputting the third subpixel output signal to the third subpixel of the (p,q)th first pixel, and (b) obtaining a fourth subpixel output signal to the (p,q)th second pixel on the basis of a fourth subpixel control second signal obtained from a first subpixel input signal, a second subpixel input signal, and the third subpixel input signal to the (p,q)th second pixel, a fourth subpixel control first signal obtained from a first subpixel input signal, a second subpixel input signal, and a third subpixel input signal to an adjacent pixel adjacent to the (p,q)th second pixel in the first direction, and the corrected expansion coefficient $\alpha'_{i-0}$, and outputting the fourth subpixel output signal to the fourth subpixel of the (p,q)th second pixel;

(2) obtaining in the signal processor or storing in the signal processor a maximum value $V_{max}(S)$ of luminosity with a saturation S in an HSV color space enlarged by adding a fourth color as a variable; and (3) in the i-th image display frame, in the signal processor:

(a) obtaining a saturation $S_i$ and a luminosity $V_i(S)$ in a plurality of pixels on the basis of subpixel input signal values in the plurality of pixels, (b) obtaining an expansion coefficient αhd i-0 on the basis of at least one of the values of $V_{max}(S)/V_i(S)$ obtained in the plurality of pixels, and (c) determining the corrected expansion coefficient $\alpha'_{i-0}$, on the basis of a value obtained by (i) calculating a difference between (1) a first reciprocal of the expansion coefficient $\alpha_{i-0}$ obtained in the i-th image display frame and (2) a second reciprocal of a corrected expansion coefficient $\alpha'_{(i-)-0}$ applied in advance in an (i−j)th image display frame (where j is a positive integer equal to or greater than 1), (ii) obtaining a correction value corresponding to the difference, and (iii) adding or subtracting the correction value to or from the second reciprocal, wherein, the saturation S and the luminosity V(S) are represented as follows:

$$S=(\text{Max}-\text{Min})/\text{Max}$$

$$V(S)=\text{Max}$$

where, Max is a maximum value among three subpixel input signal values including a first subpixel input signal value, a second subpixel input signal value, and a third subpixel input signal value to the pixel, and Min is a minimum value among the three subpixel input signal values including the first subpixel input signal value, the second subpixel input signal value, and the third subpixel input signal value to the pixel;

(a) the correction value includes $\Delta_1$, $\Delta_2$, $\Delta_3$, and $\Delta_4$;

(b) when $\Delta_1>\Delta_2>0$ and $\Delta_4>\Delta_3>0$, a first predetermined value is $\epsilon_1$, a second predetermined value is $\epsilon_2$, a third predetermined value is $\epsilon_3$, a fourth predetermined value is $\epsilon_4$, $\epsilon_1<\epsilon_2<0$, and $\epsilon_4>\epsilon_3>0$;

(c) if a value of the difference is smaller than the first predetermined value $\epsilon_1$, the corrected expansion coefficient $\alpha'_{i-0}$ is calculated on the basis of the following expression:

$$(1/\alpha'_{i-0})=(1/\alpha'_{(i-j)-0})-\Delta_1;$$

(d) if the value of the difference is equal to or greater than the first predetermined value $\epsilon_1$ and smaller than the second predetermined value $\epsilon_2$, the corrected expansion coefficient $\alpha'_{i-0}$ is calculated on the basis of the following expression:

$$(1/\alpha'_{i-0})=(1/\alpha'_{(i-j)-0})-\Delta_2;$$

(e) if the value of the difference is equal to or greater than the second predetermined value $\epsilon_2$ and smaller than the third predetermined value $\epsilon_3$, the corrected expansion coefficient $\alpha'_{i-0}$ is calculated on the basis of the following expression:

$$(1/\alpha'_{i-0})=(1/\alpha'_{(i-j)-0});$$

(f) if the value of the difference is equal to or greater than the third predetermined value $\epsilon_3$ and smaller than the fourth predetermined value $\epsilon_4$, the corrected expansion coefficient $\alpha'_{i-0}$ is calculated on the basis of the following expression:

$$(1/\alpha'_{i-0})=(1/\alpha'_{(i-j)-0})+\Delta_3;\text{ and}$$

(g) if the value of the difference is equal to or greater than the fourth predetermined value $\epsilon_4$, the corrected expansion coefficient $\alpha'_{i-0}$ is calculated on the basis of the following expression:

$$(1/\alpha'_{i-0})=(1/\alpha'_{(i-j)-0})+\Delta_4.$$

4. A method of driving an image display device, wherein the image display device includes (A) an image display panel in which $P_0\times Q_0$ pixels in total of $P_0$ pixels in a first direction and $Q_0$ pixels in a second direction are arranged in a two-dimensional matrix, and (B) a signal processor, each pixel has a first subpixel displaying a first primary color, a second subpixel displaying a second primary color, a third subpixel displaying a third primary color, and a fourth subpixel displaying a fourth color, the method comprising:

(1) in an i-th image display frame, in the signal processor:

(a) obtaining a first subpixel output signal on the basis of at least a first subpixel input signal and a corrected expansion coefficient $\alpha'_{i-0}$, and outputting the first subpixel output signal to the first subpixel, (b) obtaining a second subpixel output signal on the basis of at least a second subpixel input signal and the corrected expansion coefficient $\alpha'_{i-0}$, and outputting the second subpixel output signal to the second subpixel, (c) obtaining a third subpixel output signal on the basis of at least a third subpixel input signal and the corrected expansion coefficient $\alpha'_{i-0}$, and outputting the third subpixel output signal to the third subpixel, and (d) obtaining a fourth subpixel output signal to a (p,q)th [where p=1, 2, ..., and $P_0$, and q=1, 2, ..., and $Q_0$ ] pixel when counting in the second direction on the basis of a fourth subpixel control second signal obtained from a first subpixel input signal, a second subpixel input signal, and a third subpixel input signal to the (p,q)th pixel and a fourth subpixel control first signal obtained from a first subpixel input signal, a second subpixel input signal, and a third subpixel input signal to an adjacent pixel adjacent to the (p,q)th pixel in the second direction, and outputting the fourth subpixel output signal to the fourth subpixel of the (p,q)th pixel;

(2) obtaining in the signal processor or storing in the signal processor a maximum value $V_{max}(S)$ of luminosity with saturation S in an HSV color space enlarged by adding the fourth color as a variable; and (3) in the i-th image display frame, in the signal processor:

(a) obtaining a saturation $S_i$ and a luminosity $V_i(S)$ in a plurality of pixels on the basis of subpixel input signal values in the plurality of pixels, (b) obtaining an expansion coefficient αhd i-0 on the basis of at least one of the values of $V_{max}(S)/V_i(S)$ obtained in the plurality of pixels, and (c) determining the corrected expansion coefficient $\alpha'_{i-0}$ on the basis of a value obtained by (i) calculating a difference between (1) a first reciprocal of the expansion coefficient $\alpha_{i-0}$ obtained in the i-th image display frame and (2) a second reciprocal of a corrected expansion coefficient $\alpha'_{(i-j)-0}$ applied in advance in an (i−j)th image display frame (where j is a positive integer equal to or greater than 1), (ii) obtaining a correction value corresponding to the difference, and (iii) adding or subtracting the correction value to or from the second reciprocal, wherein, the saturation S and the luminosity V(S) are represented as follows:

$$S=(\text{Max}-\text{Min})/\text{Max}$$

$$V(S)=\text{Max}$$

where, Max is a maximum value among three subpixel input signal values including a first subpixel input signal value, a second subpixel input signal value, and a third subpixel input signal value to the pixel, and Min is a minimum value among the three subpixel input signal values including the first subpixel input signal value, the second subpixel input signal value, and the third subpixel input signal value to the pixel;

(a) the correction value includes $\Delta_1$, $\Delta_2$, $\Delta_3$, and $\Delta_4$;

(b) when $\Delta_1>\Delta_2>0$ and $\Delta_4>\Delta_3>0$, a first predetermined value is $\epsilon_1$, a second predetermined value is $\epsilon_2$, a third predetermined value is $\epsilon_3$, a fourth predetermined value is $\epsilon_4$, $\epsilon_1<\epsilon_2<0$, and $\epsilon_4>\epsilon_3>0$;

(c) if a value of the difference is smaller than the first predetermined value $\epsilon_1$, the corrected expansion coefficient $\alpha'_{i-0}$ is calculated on the basis of the following expression:

$$(1/\alpha'_{i-0})=(1/\alpha'_{(i-j)-0})-\Delta_1;$$

(d) if the value of the difference is equal to or greater than the first predetermined value $\epsilon_1$ and smaller than the second predetermined value $\epsilon_2$, the corrected expansion coefficient $\alpha'_{i-0}$ is calculated on the basis of the following expression:

$$(1/\alpha'_{i-0})=(1/\alpha'_{(i-j)-0})-\Delta_2;$$

(e) if the value of the difference is equal to or greater than the second predetermined value $\epsilon_2$ and smaller than the third predetermined value $\epsilon_3$, the corrected expansion coefficient $\alpha'_{i-0}$ is calculated on the basis of the following expression:

$$(1/\alpha'_{i-0})=(1/\alpha'_{(i-j)-0});$$

(f) if the value of the difference is equal to or greater than the third predetermined value $\epsilon_3$ and smaller than the fourth predetermined value $\epsilon_4$, the corrected expansion coefficient $\alpha'_{i-0}$ is calculated on the basis of the following expression:

$$(1/\alpha'_{i-0})=(1/\alpha'_{(i-j)-0})+\Delta_3;\text{ and}$$

(g) if the value of the difference is equal to or greater than the fourth predetermined value $\epsilon_4$, the corrected expansion coefficient $\alpha'_{i-0}$ is calculated on the basis of the following expression:

$$(1/\alpha'_{i-0})=(1/\alpha'_{(i-j)-0})+\Delta_4.$$

5. A method of driving an image display device, wherein the image display device includes (A) an image display panel in which P×Q pixel groups in total of P pixel groups in a first direction and Q pixel groups in a second direction are arranged in a two-dimensional matrix, and (B) a signal processor, each pixel group has a first pixel and a second pixel in the first direction, the first pixel has a first subpixel displaying a first primary color, a second subpixel displaying a second primary color, and a third subpixel displaying a third primary color, the second pixel has a first subpixel displaying the first primary color, a second subpixel displaying the second primary color, and a fourth subpixel displaying a fourth color, (1) in an i-th image display frame, in the signal processor:

(a) obtaining a fourth subpixel output signal on the basis of a fourth subpixel control second signal obtained from a first subpixel input signal, a second subpixel input signal, and a third subpixel input signal to a (p,q)th [where p=1, 2, ..., and P and q=1, 2, ..., and Q] second pixel when counting in the second direction, a fourth subpixel control first signal obtained from a first subpixel input signal, a second subpixel input signal, and a third subpixel input signal to an adjacent pixel adjacent to the (p,q)th second pixel in the second direction, and a corrected expansion coefficient $\alpha'_{i-0}$, and outputting the fourth subpixel output signal to the fourth subpixel of the (p,q) th second pixel, and (b) obtaining a third subpixel output signal on the basis of at least a third subpixel input signal to the (p,q)th second pixel, a third subpixel input signal to a (p,q)th first pixel, and the corrected expansion coefficient $\alpha'_{i-0}$, and outputting the third subpixel output signal to the third subpixel of the (p,q)th first pixel;

(2) obtaining in the signal processor or storing in the signal processor a maximum value $V_{max}(S)$ of luminosity with a saturation S in an HSV color space enlarged by adding the fourth color as a variable; and (3) in the i-th image display frame, in the signal processor:

(a) obtaining a saturation $S_i$ and a luminosity $V_i(S)$ in a plurality of pixels on the basis of subpixel input signal values in the plurality of pixels, (b) obtaining an expansion coefficient $\alpha_{i-0}$ on the basis of at least one of the values of $V_{max}(S)/V_i(S)$ obtained in the plurality of pixels, and (c) determining the corrected expansion coefficient $\alpha'_{i-0}$ on the basis of a value obtained by (i) calculating a difference between (1) a first reciprocal of the expansion coefficient $\alpha_{i-0}$ obtained in the i-th image display frame and (2) a second reciprocal of a corrected expansion coefficient $\alpha'_{(i-j)-0}$ applied in advance in an (i−j)th image display frame (where j is a positive integer equal to or greater than 1), (ii) obtaining a correction value corresponding to the difference, and (iii) adding or subtracting the correction value to or from the second reciprocal, wherein, the saturation S and the luminosity V(S) are represented as follows:

$$S=(\text{Max}-\text{Min})/\text{Max}$$

$$V(S)=\text{Max}$$

where, Max is a maximum value among three subpixel input signal values including a first subpixel input signal value, a second subpixel input signal value, and a third subpixel input signal value to the pixel, and Min is a minimum value among the three subpixel input signal values including the first subpixel input signal value, the second subpixel input signal value, and the third subpixel input signal value to the pixel;

(a) the correction value includes $\Delta_1$, $\Delta_2$, $\Delta_3$, and $\Delta_4$;

(b) when $\Delta_1>\Delta_2>0$ and $\Delta_4>\Delta_3>0$, a first predetermined value is $\epsilon_1$, a second predetermined value is $\epsilon_2$, a third predetermined value is $\epsilon_3$, a fourth predetermined value is $\epsilon_4$, $\epsilon_1<\epsilon_2<0$, and $\epsilon_4>\epsilon_3>0$;

(c) if a value of the difference is smaller than the first predetermined value $\epsilon_1$, the corrected expansion coefficient $\alpha'_{i-0}$ is calculated on the basis of the following expression:

$$(1/\alpha'_{i-0})=(1/\alpha'_{(i-j)-0})-\Delta_1;$$

(d) if the value of the difference is equal to or greater than the first predetermined value $\epsilon_1$ and smaller than the second predetermined value $\epsilon_2$, the corrected expansion coefficient $\alpha'_{i-0}$ is calculated on the basis of the following expression:

$$(1/\alpha'_{i-0})=(1/\alpha'_{(i-j)-0})-\Delta_2;$$

(e) if the value of the difference is equal to or greater than the second predetermined value $\epsilon_2$ and smaller than the third predetermined value $\epsilon_3$, the corrected expansion coefficient $\alpha'_{i-0}$ is calculated on the basis of the following expression:

$$(1/\alpha'_{i-0})=(1/\alpha'_{(i-j)-0});$$

(f) if the value of the difference is equal to or greater than the third predetermined value $\epsilon_3$ and smaller than the fourth predetermined value $\epsilon_4$, the corrected expansion coefficient $\alpha'_{i-0}$ is calculated on the basis of the following expression:

$$(1/\alpha'_{i-0})=(1/\alpha'_{(i-j)-0})+\Delta_3;\text{ and}$$

(g) if the value of the difference is equal to or greater than the fourth predetermined value $\epsilon_4$, the corrected expansion coefficient $\alpha'_{i-0}$ is calculated on the basis of the following expression:

$$(1/\alpha'_{i-0})=(1/\alpha'_{(i-j)-0})+\Delta_4.$$

6. The method according to claim 1, wherein:

the image display device further includes a planar light source device which illuminates the image display panel, and a brightness of the planar light source device is controlled using the corrected expansion coefficient $\alpha'_{i-0}$.

7. The method according to claim 6, wherein:

the brightness of the planar light source device which is controlled using the corrected expansion coefficient $\alpha'_{i-0}$ is a brightness of the planar light source device in an (i+k)th image display frame (where $0\leq k\leq 5$).

* * * * *